US012075827B2

(12) United States Patent
Yamada et al.

(10) Patent No.: US 12,075,827 B2
(45) Date of Patent: Sep. 3, 2024

(54) CARTRIDGE, ATOMIZATION UNIT, AND NON-COMBUSTION SUCTION DEVICE

(71) Applicant: Japan Tobacco Inc., Tokyo (JP)

(72) Inventors: Manabu Yamada, Tokyo (JP); Kentaro Matsuda, Tokyo (JP); Takashi Oda, Tokyo (JP); Hirofumi Matsumoto, Tokyo (JP); Keisuke Morita, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 595 days.

(21) Appl. No.: 17/238,733

(22) Filed: Apr. 23, 2021

(65) Prior Publication Data

US 2021/0235757 A1 Aug. 5, 2021

Related U.S. Application Data

(63) Continuation of application No. PCT/JP2018/046818, filed on Dec. 19, 2018.

(30) Foreign Application Priority Data

Oct. 26, 2018 (CN) ..... 201811283974.X

(51) Int. Cl.
*A24F 40/42* (2020.01)
*A24F 40/10* (2020.01)
*A24F 40/44* (2020.01)

(52) U.S. Cl.
CPC ..... *A24F 40/42* (2020.01); *A24F 40/10* (2020.01); *A24F 40/44* (2020.01)

(58) Field of Classification Search
CPC ..... A24F 40/42; A24F 40/10; A24F 40/44; A24F 40/40
USPC ..... 131/329
See application file for complete search history.

(56) References Cited

U.S. PATENT DOCUMENTS

| | | | | |
|---|---|---|---|---|
| 9,320,300 | B2 * | 4/2016 | Hon | A24F 40/40 |
| 9,532,605 | B2 * | 1/2017 | Yamada | A24F 40/50 |
| 9,956,357 | B2 | 5/2018 | Chen | |
| 10,051,894 | B2 * | 8/2018 | Gavrielov | A24F 40/46 |
| 2016/0286865 | A1 * | 10/2016 | King | H02J 50/10 |
| 2017/0150753 | A1 * | 6/2017 | Macko | H05B 1/0244 |
| 2018/0027879 | A1 * | 2/2018 | Gavrielov | A24F 40/60 |

FOREIGN PATENT DOCUMENTS

| | | | |
|---|---|---|---|
| EP | 3 078 808 | A1 | 10/2016 |
| WO | WO2015/077645 | A1 | 5/2015 |

OTHER PUBLICATIONS

Extended European Search Report for European Application No. 18937926.8, dated Sep. 1, 2022.

* cited by examiner

*Primary Examiner* — Alexander Gilman

(74) *Attorney, Agent, or Firm* — Birch, Stewart, Kolasch & Birch, LLP

(57) ABSTRACT

A cartridge according to an embodiment of the present invention used in a non-combustion suction device having a suction port, has a tank; a first liquid retainer: and a second liquid retainer. The tank is capable of storing liquid. The first liquid retainer is capable of retaining the liquid in the tank and configured to supply the liquid to the heater. The second liquid retainer is in contact with the first liquid retainer and capable of retaining the liquid through the first liquid retainer. The second liquid retainer and the heater are separated from each other.

19 Claims, 28 Drawing Sheets

CARTRIDGE, ATOMIZATION UNIT, AND NON-COMBUSTION SUCTION DEVICE

CROSS REFERENCE TO RELATED APPLICATIONS

This application is a Continuation of PCT International Application No. PCT/JP2018/046818, filed on Dec. 19, 2018, which claims priority under 35 U.S.C. 119(a) to Patent Application No. 201811283974.X, filed in China on Oct. 26, 2018, all of which are hereby expressly incorporated by reference into the present application.

TECHNICAL FIELD

The present invention relates to a cartridge, an atomization unit, and a non-combustion suction device.

BACKGROUND ART

Conventionally, a non-combustion suction device (hereinafter simply referred to as a suction device) configured to aspirate steam (for example, an aerosol) atomized by heating has been known. There is a device having an atomization unit in which atomizable liquid (for example, an aerosol source) is stored and a main body unit in which a storage battery is mounted as this kind of suction device.

The atomization unit has a tank formed in a bottomed cylindrical shape in which the liquid is stored, a cotton formed in a disc shape and having liquid absorbency, the cotton partitioning the tank into a liquid storage room at a bottom side and an opening room at a side of an opening portion, a wick connected to the cotton, and a heater heating the wick while being electrically connected to the storage battery. The liquid is stored in the liquid storage room of the tank. The liquid is absorbed by the cotton. The wick absorbs up the liquid in the cotton.

According to such a configuration, in the suction device, the heater disposed in the atomization unit generates heat by the power supplied from the storage battery. Accordingly, the liquid absorbed up by the wick is heated and atomized. A user can suction the atomized steam together with the air through a suction port disposed in the main body unit.

CITATION LIST

Patent Document

[Patent Document 1]
U.S. Pat. No. 9,956,357

SUMMARY OF INVENTION

Technical Problem

However, according to the prior art described above, when the cotton and the wick is saturated, there is possibility that the liquid leaks out. In this case, there is possibility that the liquid transmits from a gap between an external circumferential surface of the cotton and an internal circumferential surface of the tank to the internal circumferential surface of the tank so as to leak out to the rooms disposed in the wick and the heater.

An object of the present invention is to provide a cartridge, an atomization unit, and a non-combustion suction device that can prevent unnecessary liquid leakage to the rooms.

Solution to Problem

A cartridge according to a first aspect used in a non-combustion suction device having a suction port includes a tank capable of storing liquid, a first liquid retainer capable of retaining the liquid in the tank and configured to supply the liquid to the heater, and a second liquid retainer being in contact with the first liquid retainer and separated from the heater, the second liquid retainer being capable of retaining the liquid through the first liquid retainer.

According to a second aspect, in the cartridge according to the first aspect, an opening portion coming in contact with the first liquid retainer may be formed in the tank.

According to a third aspect, in the cartridge according to the first aspect or the second aspect, the second liquid retainer may be connected with the tank via the first liquid retainer.

According to a fourth aspect, in the cartridge according to any one of the first aspect to the third aspect, the second liquid retainer may be disposed at an opposite side with respect to the suction port side of the tank.

According to a fifth aspect, in the cartridge according to any one of the first aspect to the fourth aspect, when viewing the opposite side of the suction port from the suction port, at least part of a first contact portion between the opening portion of the tank and the first liquid retainer and a second contact portion between the first liquid retainer and the second liquid retainer may be shifted with each other.

According to a sixth aspect, in the cartridge according to any one of the first aspect to the fifth aspect, the first liquid retainer may be formed in a plate shape having a suction-port-side surface at the suction port side and an opposite-suction-port-side surface at an opposite side of the suction port, wherein the suction-port-side surface may be in contact with the tank and the opposite-suction-port-side surface is in contact with the second liquid retainer.

According to a seventh aspect, in the cartridge according to any one of the first aspect to the sixth aspect, when viewing the opposite side of the suction port side from the suction port side, the suction port, the second liquid retainer may be disposed at a position overlapping a region between the external lateral surface of the first liquid retainer and the internal lateral surface of the tank.

According to an eighth aspect, in the cartridge according to any one of the first aspect to the seventh aspect, the second liquid retainer may be a porous member.

According to a ninth aspect, in the cartridge according to any one of the first aspect to the eighth aspect, a space capable of storing the liquid may be formed in the second liquid retainer.

An atomization unit according to a tenth aspect has a tank formed in a bottomed cylindrical shape, a partition plate configured to partition the tank into a liquid storage room at the bottom side of the tank and an opening room at a side of an opening portion of the tank, and a container having a cylindrical portion fitted into an internal circumferential surface at the opening room side of the tank, wherein liquid is accommodated in the liquid storage room, and a liquid retainer is formed between an external circumferential surface of the cylindrical portion and an internal circumferential surface of the opening room in the tank.

According to an eleventh aspect, in the atomization unit according to the tenth aspect, the liquid retainer may store the liquid leaked from the gap between the external circumferential surface of the partition plate and the internal circumferential surface of the tank.

According to a twelfth aspect, in the atomization unit according to the tenth aspect or the eleventh aspect, part of the liquid retainer may be communicated with the external side of the tank.

According to a thirteenth aspect, in the atomization unit according to any one of the tenth aspect to the twelfth aspect, the partition plate may have liquid absorbency.

According to a fourteenth aspect, in the atomization unit according to any one of the tenth aspect to the thirteenth aspect, the liquid retainer may be a concave portion formed in at least one of the external circumferential surface of the cylindrical portion or the internal circumferential surface of the tank.

According to a fifteenth aspect, in the atomization unit according to the fourteenth aspect, the liquid retainer may be formed such that a gap between the external circumferential surface of the cylindrical portion and the internal circumferential surface of the tank gradually becomes wider toward the opening portion of the tank.

According to a sixteenth aspect, in the atomization unit according to the fourteenth aspect or the fifteenth aspect, a narrow portion communicating with the concave portion may be formed in the gap between the external circumferential surface of an end portion at the partition plate side in the cylindrical portion and the internal circumferential surface of the tank.

According to a seventeenth aspect, in the atomization unit according to the sixteenth aspect, an end of the narrow portion opposite to the concave portion may be covered by the partition plate.

According to an eighteenth aspect, in the atomization unit according to any one of the fourteenth aspect to the seventeenth aspect, the concave portion may be formed over the whole circumference of either of the external circumferential surface of the cylindrical portion or the internal circumferential surface of the tank.

According to a nineteenth aspect, in the atomization unit according to any one of the tenth aspect to the eighteenth aspect, the partition plate may be formed from fibers and a support member fitted into the internal circumferential surface of the tank to support the partition plate may be disposed in a surface at the liquid storage room side of the partition plate.

According to a twentieth aspect, the atomization unit according to any one of the tenth aspect to the nineteenth aspect may include a wick having liquid absorbency and disposed inside the container while being connected to the partition plate, and a heater disposed inside the container and configured to heat the wick without combustion.

According to a twenty-first aspect, in the atomization unit according to any one of the tenth aspect to the twentieth aspect, the tank may have a flow path penetrating the bottom and the partition plate.

According to a twenty-second aspect, in the atomization unit according to the twenty-first aspect, the flow path may be disposed at a center in a radial direction of the tank and formed in a tubular shape along an axial direction, and a rib may be disposed across the internal circumferential surface of the tank and the external circumferential surface of the flow path.

A non-combustion suction device according to a twenty-third aspect includes the atomization unit according to any one of the tenth aspect to the twenty-second aspect, a container-retaining cylinder configured to accommodate the atomization unit, and a mouthpiece attached to the container-retaining cylinder, wherein the opening room is communicated with the mouthpiece.

DESCRIPTION OF EMBODIMENTS

Hereinafter, an embodiment of the present invention will be described with reference to FIGURES.

[Suction Device]

Figure 1:
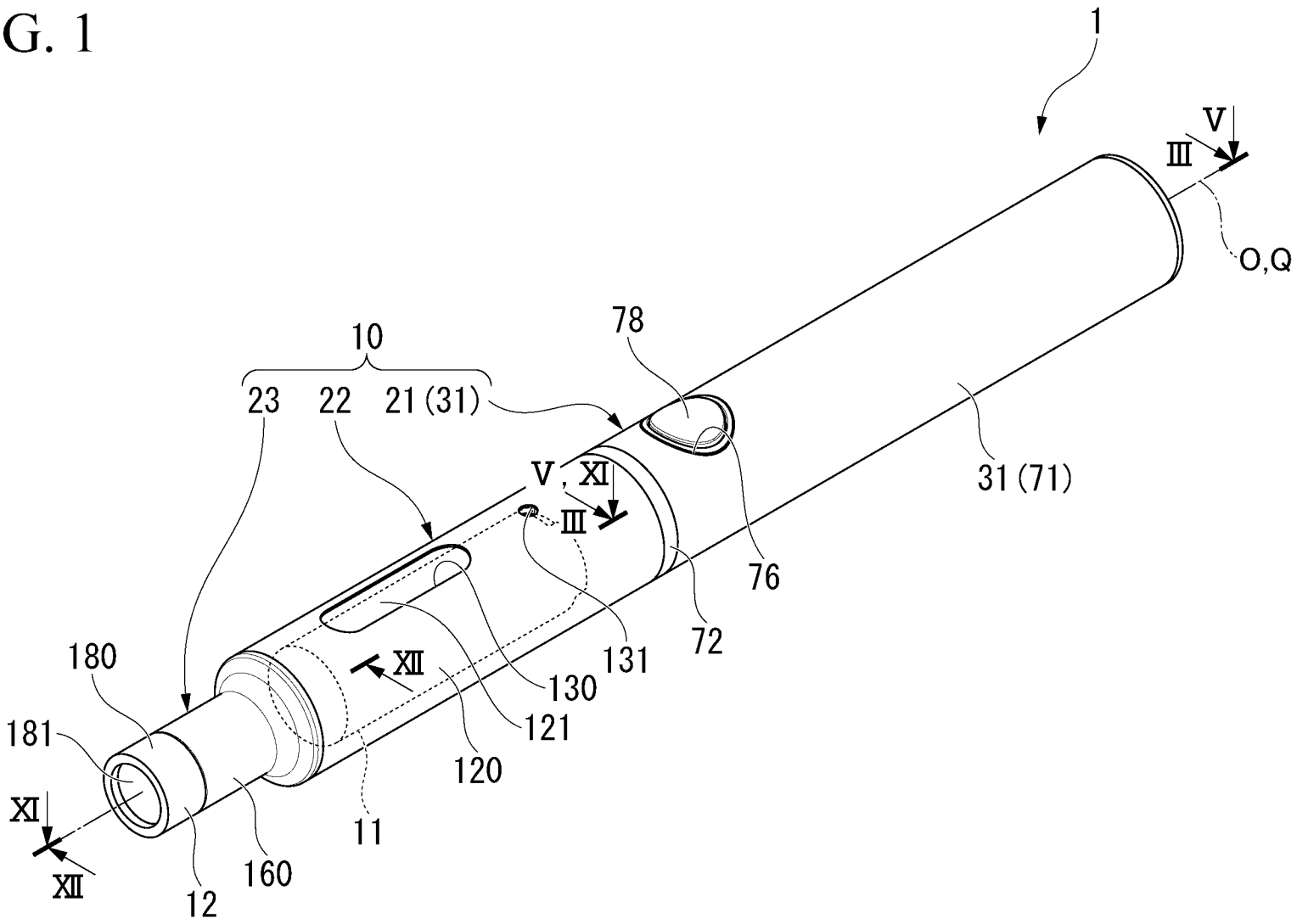
FIG. 1 is a perspective view showing a non-combustion suction device according to an embodiment.

FIG. 1 is a perspective view showing a suction device.

A suction device 1 shown in FIG. 1 is a so-called non-combustion suction device configured for tasting the flavor of tobacco by inhaling aerosol atomized by heating through the tobacco.

The suction device 1 includes a main body unit 10, a tobacco capsule 12, and a cartridge (also referred as an atomization unit) 11 attached to the main body unit 10 configured to be attachable to and detachable from the main body unit 10.

[Main Body Unit]

Figure 2:
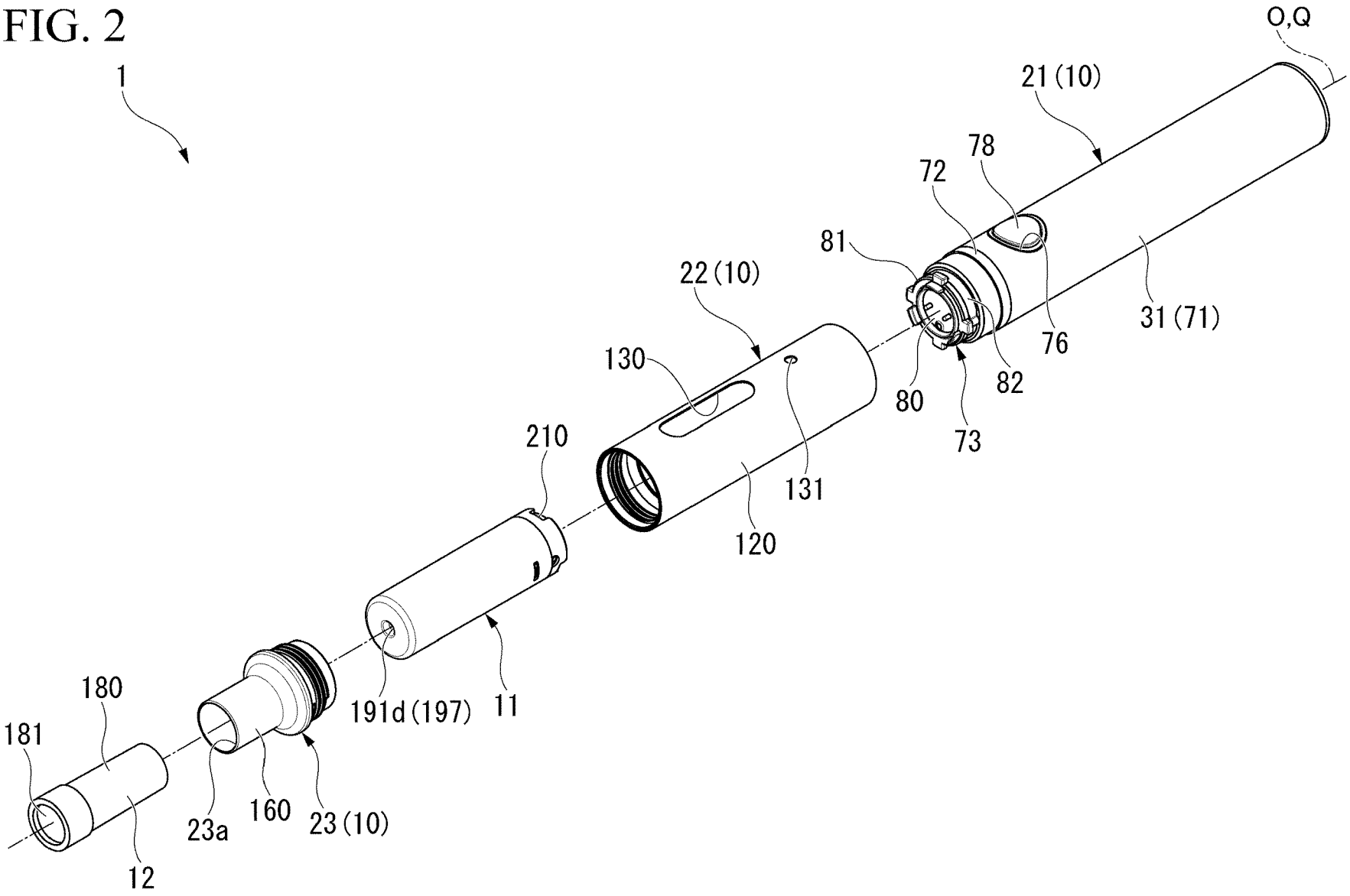
FIG. 2 is an exploded perspective view showing the non-combustion suction device according to the embodiment.

FIG. 2 is an exploded perspective view of the suction device 1.

As shown in FIG. 2, the main body unit 10 includes a power unit 21, a retention unit 22, and a mouthpiece (also referred as a suction port) 23. The power unit 21, the retention unit 22, and the mouthpiece 23 are formed in cylindrical shapes with an axis O as a central axis respectively and disposed to be arranged on the axis O. In the following description, the direction along the axis O is described as an axial direction (a normal direction). In the axial direction, a side from the mouthpiece 23 toward the power unit 21 can be referred to as an opposite-suction-port side or a first end direction side, and a side from the power unit 21 toward the mouthpiece 23 can be referred to as a suction-port side or a second end direction side. A direction intersecting with the axis O in a plan view seen from the axial direction may be referred to as a radial direction, and a direction around the axis O may be referred to as a circumferential direction. In this specification, the recitation "direction" means two directions, and in a case of indicating one of the "directions", the recitation "side" is disclosed.

[Power Unit]

Figure 3:
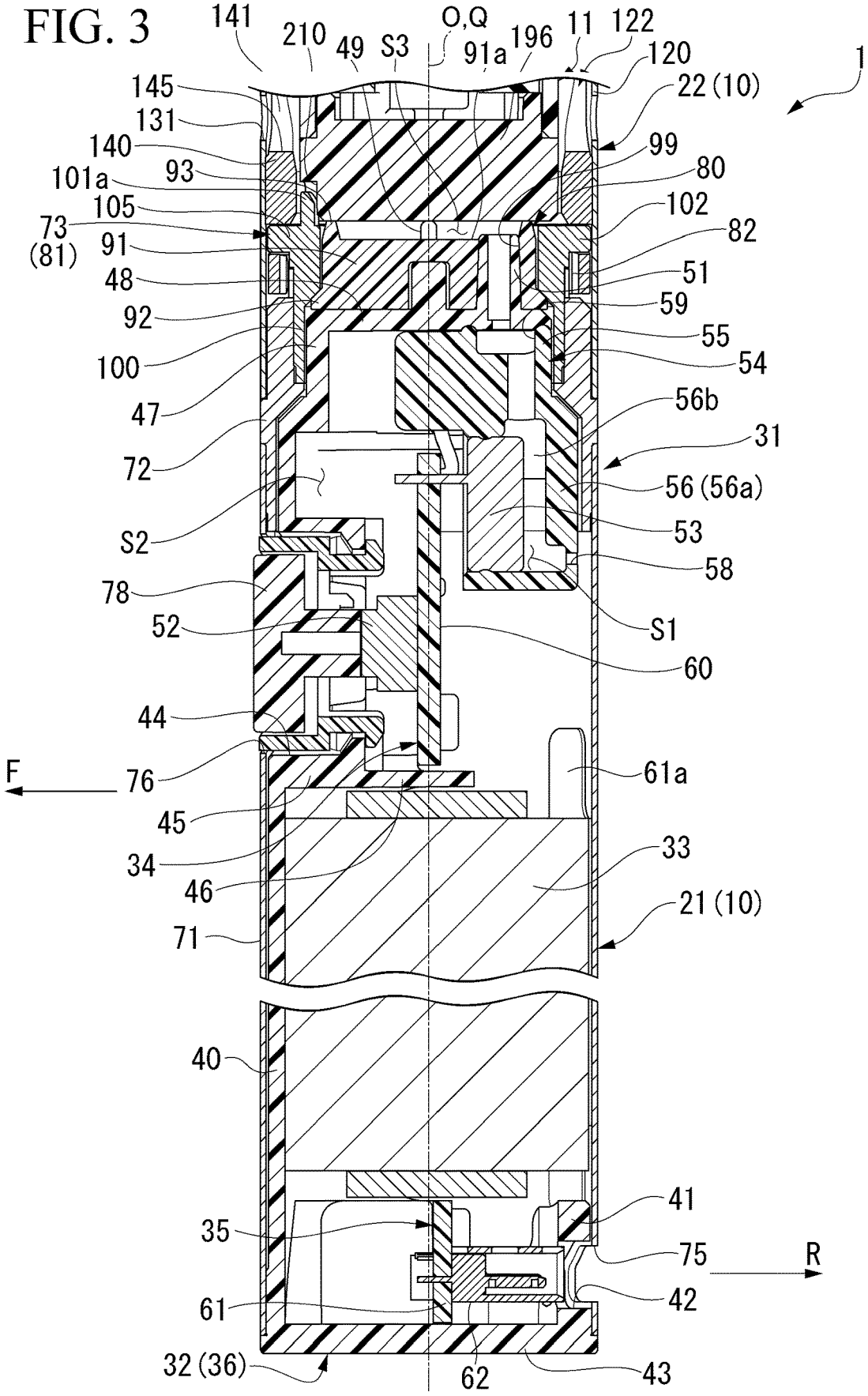
FIG. 3 is a cross-sectional view corresponding to line III-III in FIG. 1.

FIG. 3 is a cross-sectional view corresponding to line III-III in FIG. 1.

As shown in FIG. 3, the power unit 21 includes a housing 31 and a holder assembly accommodated in the housing 31.

[Holder Assembly]

Figure 4:
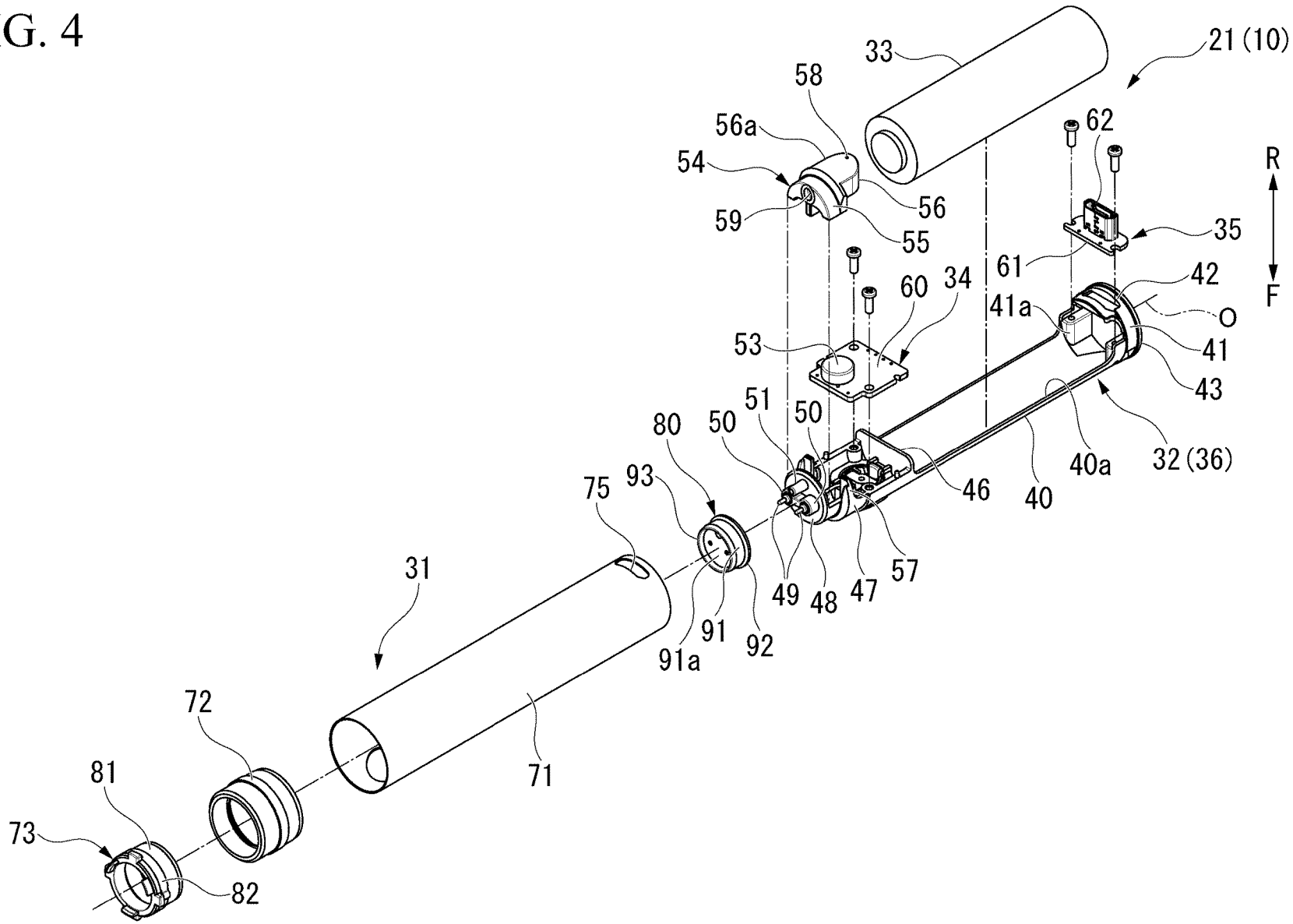
FIG. 4 is an exploded perspective view showing a power unit according to the embodiment.

FIG. 4 is an exploded perspective view showing the power unit 21.

As shown in FIG. 3 and FIG. 4, a holder assembly 32 is configured by mounting a storage battery 33, a substrate module (first substrate module 34 and second substrate module 35) and the like on a storage-battery holder 36.

For example, the storage-battery holder 36 is integrally formed from a resin material. The storage-battery holder 36 has a base portion 40. The base portion 40 is formed in a semi-cylindrical shape with the axis O as a central axis. In the base portion 40, if an assembly opening 40*a* (see FIG. 4) for receiving the storage battery 33 and the like opens outward in the radial direction, the base portion 40 may be formed in a shape besides the semi-cylindrical shape.

In the base portion 40, a press-fit cylindrical portion 41 extends to an end portion at an opposite side with respect to the retention unit 22 in the axial direction. The press-fit cylindrical portion 41 is formed in a cylindrical shape with the axis O as a central axis. In the press-fit cylindrical portion 41, a connector-passage hole 42 penetrating the press-fit cylindrical portion 41 in the radial direction is formed in part of the press-fit cylindrical portion 41 in the circumferential direction. In the press-fit cylindrical portion 41, an opening portion positioned at an opposite side with respect to the retention unit 22 in the axial direction is blocked by a blocking portion 43. The blocking portion 43 is formed in a circular shape having a larger diameter than that of the press-fit cylindrical portion 41.

A button opening 44 (see FIG. 3) is formed in a part of the base portion 40 positioned at the retention unit 22 side in the axial direction. The button opening 44 penetrates part of the base portion 40 in the circumferential direction of the base portion 40 in the radial direction. For example, the above-described connector-passage hole 42 and the button opening 44 are arranged in different positions at 180 degrees in the circumferential direction. According to the present embodiment, the radial direction through each center of the connector-passage hole 42 and the button opening 44 arranged in the circumferential direction is referred to as a front-rear direction. In this case, as shown in FIG. 3 and FIG. 4, the connector-passage hole 42 side with respect to the axis O is referred to as a rear side R, and the button opening 44 side with respect to the axis O is referred to as a front side F. The positions of the connector-passage hole 42 and the button opening 44 may be suitable changed.

In the base portion 40, a button-guide tube 45 extending to the rear side is formed in an opening edge of the button opening 44. The button-guide tube 45 surrounds the circumference of the button opening 44.

In the base portion 40, a partition wall 46 configured to partition the base portion 40 in the axial direction is formed in a portion positioned at the opposite side of the retention unit 22 more than the button opening 44 in the axial direction.

Figure 5:
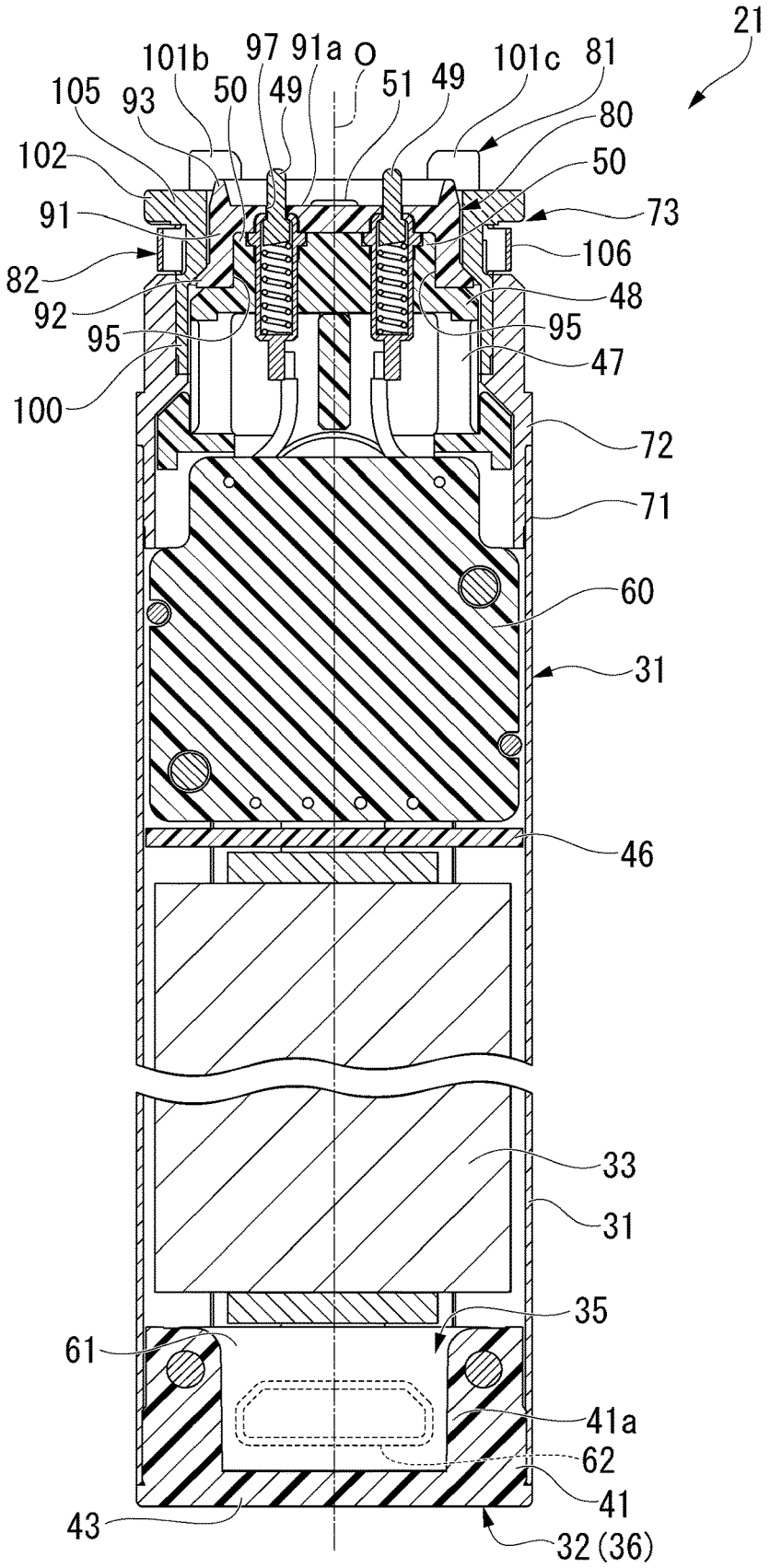
FIG. 5 is a cross-sectional view corresponding to line V-V in FIG. 1.

FIG. 5 is a cross-sectional view corresponding to line V-V in FIG. 1.

As shown in FIG. 3 to FIG. 5, a step portion 47 communicates with an end portion positioned at the retention unit 22 side of the base portion 40 in the axial direction. The step portion 47 is formed in a semi-cylindrical shape to be coaxial with the base portion 40, and a distance from the axis O in the radial direction gradually decreases as approaching the retention unit 22 in the axial direction. A connection pedestal 48 communicates with an end edge positioned at the retention unit 22 side in the axial direction in the step portion 47. The connection pedestal 48 is formed in a circular shape with the axis O as a central axis. A pair of electrode retainers 50 and a communication port 51 are formed in the connection pedestal 48.

As shown in FIG. 4 and FIG. 5, the pair of electrode retainers 50 are formed in tubular shapes protruding toward the retention unit 22 in the axial direction. The pair of the electrode retainers 50 are positioned at two sides of the axis O in the radial direction. According to the present embodiment, the pair of the electrode retainers 50 are arranged in a direction (hereinafter, may be referred to as a left-right direction) orthogonal to the above-described front-rear direction among the radial directions. Each electrode retainer 50 extends in the axial direction and is communicated with each other in the radial direction.

As shown in FIG. 3 and FIG. 4, the communication port 51 protrudes from a portion that is positioned at the rear side in the radial direction with respect to the axis O in the connection pedestal 48 toward the retention unit 22 side in the axial direction.

As shown in FIG. 5, a pin electrode 49 is individually held by each electrode retainer 50. The pin electrode 49 is configured from a pin-shaped electrode main body that is elastically supported in a tubular case. The pin electrode 49 is configured that the electrode main body penetrates the electrode retainer 50 in the axial direction in a state in which the tubular case is fitted into the electrode retainer 50. In two end portions of the pin electrode 49 (electrode main body) in the axial direction, the end portion positioned at the opposite side of the retention unit 22 in the axial direction is connected to a first substrate 60 via electrode wirings in the storage-battery holder 36.

The storage battery 33 is formed in a cylindrical shape with the axis O as the axial direction. The storage battery 33 is accommodated in a portion in the base portion 40 that is positioned at the opposite side of the retention unit 22 in the axial direction with respect to the partition wall 46. A power source included in the suction device 1 as a rechargeable and dischargeable power source is not be limited to a secondary battery such as the storage battery 33 and the like and may be a supercapacitor and the like. The power source may be a primary battery.

As shown in FIG. 3 and FIG. 4, the first substrate module 34 is disposed in a part of the base portion 40 positioned at the retention unit 22 side in the axial direction with respect to the partition wall 46. More specifically, the first substrate module 34 has a first substrate 60, a switching element 52 (see FIG. 3), and a pressure sensor 53.

The first substrate 60 is configured to have the front-rear direction as a thickness direction. More specifically, the first substrate 60 is fixed to the base portion 40 by screws and the like in a state of being placed on an opening end surface of the assembly opening 40*a*. The first substrate 60 is connected to the storage battery 33 via a first connection wiring (not shown). In the example shown in FIG. 3, the first substrate 60 is positioned on the axis O.

The switching element 52 is disposed at a position overlapping the button opening 44 on a front surface (first principal plane) of the first substrate 60 when viewed from the front-rear direction. According to the present embodiment, the switching element 52 is surface mounted on the first substrate 60. However, the switching element 52 may be mounted on the first substrate 60 in a state in which a connection terminal extending from the switching element 52 is inserted through the penetration hole of the first substrate 60.

The pressure sensor 53 is disposed at the retention unit 22 side with respect to the switching element 52 in the axial direction on a rear surface (second principal plane) of the first substrate 60. In other words, the pressure sensor 53 is disposed at a position that does not overlap the switching element 52 in a planar view in the front-rear direction. According to the present embodiment, the pressure sensor 53 is disposed at the position shifting to the retention unit 22 side in the axial direction with respect to the switching element 52; however, the configuration is not limited thereto. In other words, if the switching element 52 and the pressure sensor 53 are disposed at misaligned positions in the in-plane direction of the first substrate 60, the switching element 52 and the pressure sensor 53 may be disposed at misaligned positions at the opposite side of the retention unit 22 in the axial direction and may be disposed at misaligned positions in the left-right direction among the radial directions.

The pressure sensor 53 may be configured by adopting an electrostatic capacitance type sensor for example. In other words, the pressure sensor 53 is configured to detect behavior of diaphragm deforming in response to pressure change as the change of electrostatic capacitance. The pressure sensor 53 according to the present embodiment is mounted on the first substrate 60 in the state in which a connection terminal extending from the pressure sensor 53 is inserted through the penetration hole of the first substrate 60. However, the pressure sensor 53 may be surface mounted on the first substrate 60.

A sensor holder 54 is attached to the pressure sensor 53. The sensor holder 54 is formed from a resin material such as a silicone resin and the like that is softer than the storage-battery holder 36 and has elasticity. The sensor holder 54 has an attachment portion 55 being attached to the storage-battery holder 36 and a cover 56 for covering the pressure sensor 53.

The attachment portion 55 is formed in a semicircular shape. The attachment portion 55 is assembled to the storage-battery holder 36 in a state of being abut by the above-described connection pedestal 48 from the opposite side of the retention unit 22 in the axial direction. A clipping piece 57 (see FIG. 4) is formed in the step portion 47 and configured to retain the attachment portion 55 in the space between the connection pedestal 48 and the step portion 47 in the axial direction. The clipping piece 57 protrudes from two end surfaces of a circular arc in the circumferential direction, wherein the circular arc is positioned at an external side in the radial direction (left-right direction) of the step portion 47.

The cover 56 communicates with the attachment portion 55 at the opposite side of the retention unit 22 in the axial direction. The cover 56 is formed in a cap shape that opens at the front side. A spacer 56*b* swelling toward the front side is formed in a bottom wall portion 56*a* of the cover 56. The pressure sensor 53 is fitted into the cover 56 in a state of being abut by the spacer 56*a*. Accordingly, a gap in the radial direction is formed between the internal surface of the bottom wall portion 56*a* and the pressure sensor 53. An air replacement hole 58 penetrating the bottom wall portion 56*a* in the radial direction is formed in the bottom wall portion 56*a*.

A communication passage 59 communicating the inside of the communication port 51 and the inside of the cover 56 is formed in the above-described attachment portion 55. The communication passage 59 extends along the axial direction in the attachment portion 55. An end portion of the communication passage 59 at the opposite side of the retention unit 22 in the axial direction opens on the internal circumferential surface of the cover 56. On the other hand, an end portion of the communication passage 59 at the retention unit 22 side in the axial direction opens on a surface facing the retention unit 22 side in the axial direction in the attachment portion 55. According to the present embodiment, a minimum inner diameter of the communication passage 59 is larger than a maximum inner diameter of the air replacement hole 58. In the communication passage 59, at least the inner diameter of the end portion at the retention unit 22 side in the axial direction is larger than the inner diameter of the communication port 51.

According to the present embodiment, the communication port 51 and the communication passage 59 are disposed at a position where at least part of the communication port 51 and the communication passage 59 overlaps the pressure sensor 53 when viewed in the axial direction. However, the communication port 51 and the communication passage 59 may be disposed at a position shifting from the pressure sensor 53 when viewed in the axial direction.

As shown in FIGS. 3-5, the second substrate module 35 is disposed at the opposite side of the first substrate module 34 in the axial direction to sandwich the storage battery 33 therebetween. In other words, the substrate modules 34, 35 according to the present embodiment are disposed at two sides in the axial direction to sandwich the storage battery 33 therebetween. The second substrate module 35 has a second substrate 61 and a female connector 62.

The second substrate 61 is accommodated in the press-fit cylindrical portion 41 having the radial direction (front-rear direction) as the thickness direction. As shown in FIG. 5, the second substrate 61 is fixed to a boss portion 41*a* by screws in a state of being placed on the boss portion 41*a*, wherein the boss portion 41*a* protrudes inwardly from the press-fit cylindrical portion in the radial direction. The second substrate is connected to the first substrate 61 via a second wiring 61*a*. In other words, the second wiring 61*a* is drawn to pass through the circumference of the storage battery 33 in the axial direction at the external side of the storage-battery holder 36.

As shown in FIGS. 3-4, the female connector 62 is used as a device for the power charge of the storage battery 33, and a male connector (not shown) drawn from an external power source is inserted into and pulled from the female connector 62. According to the present embodiment, for example, a USB (Universal Serial Bus) connector is adopted as the female connector 62. However, the female connector 62 is not limited to the USB connector. The female connector 62 is not necessary to be used for the power charge and may be used as a device for communication, for example.

The female connector 62 is implemented on the second substrate 61 in a state in which the opening portion faces the rear side. A tip end portion (an end portion close to the opening portion) of the female connector 62 is inserted into the connector-passage hole 42. However, the female connector 62 may be retracted to the internal side from the connector-passage hole 42 in the radial direction.

(Housing)

As shown in FIGS. 3-4, the housing 31 has an exterior cylindrical portion 71, an intervenient member 72, and a connection mechanism 73.

The exterior cylindrical portion 71 is formed in a cylindrical shape having the axis O as a central axis. The holder assembly 32 is inserted into the exterior cylindrical portion 71 through an opening portion positioned at the opposite side of the retention unit 22 in the axial direction. More specifically, the holder assembly 32 is assembled to the exterior cylindrical portion 71 in a state in which the press-fit cylindrical portion 41 of the storage battery 36 is pressed to fit into an end portion of the exterior cylindrical portion 71 positioned at the opposite side of the retention unit 22. Accordingly, the holder assembly 32 is accommodated into the exterior cylindrical portion 71 in a state in which an end portion positioned at the retention unit 22 side protrudes from the exterior cylindrical portion 71. An opening portion of the exterior cylindrical portion 71 positioned at the opposite side of the retention unit 22 in the axial direction is blocked by the blocking portion 43 of the storage-battery holder 36.

A connector exposure hole 75 is formed in a portion overlapping the connector-passage hole 42 and the female connector 62 viewed in the radial direction in the end portion of the exterior cylindrical portion 71 positioned at the opposite side of the retention unit 22 in the axial direction. The connector exposure hole 75 penetrates the exterior cylindrical portion 71 in the radial direction. According to the present embodiment, a configuration that the female connector 62 opens in the radial direction is described, the female connector 62 may open in the axial direction.

A button exposure hole 76 is formed in a portion overlapping the button opening 44 viewed in the radial direction in the end portion of the exterior cylindrical portion 71 at the retention unit 22 side. The button exposure hole 76 penetrates the exterior cylindrical portion 71 in the radial direction.

The button 78 is accommodated in the button exposure hole 76 and the button opening 44. The button 78 is configured to be movable in the radial direction in a state of being supported by the button-guide tube 45. The button 78 operates to press the switch element 52 while moving inward in the radial direction. A surface of the button 78 is exposed to an external circumferential surface of the exterior cylindrical portion 71 through the button exposure hole 76. The button 78 is not limited to a configuration moving in the radial direction, for example, the button 78 may be configured to slide in the axial direction. A configuration operating the suction device 1 by a touch sensor or the like instead of the button 78 may be configured.

The intervenient member 72 is formed in a cylindrical shape with the axis O as a central axis. The intervenient member 72 is fitted into an interval between the holder assembly 32 and the exterior cylindrical portion 71 from the retention unit 22 side in the axial direction. Accordingly, a portion between the holder assembly 32 and the exterior cylindrical portion 71 is sealed in the opening portion of the exterior cylindrical portion 71 positioned at the retention unit 22 side in the axial direction.

As shown in FIG. 3, a space surrounded by the sensor holder 54 in the housing 31 configures a pressure change room S1 in which a pressure changes through the communication port 51 in response to the usage (suction) of the suction device 1. On the other hand, in the housing 31, space other than the pressure change room S1 configures a constant pressure room S2 in which the atmospheric pressure applies. According to the present embodiment, among the storage battery 33 and the substrate modules 34, 35, the configurations other than the pressure sensor 53 are accommodated in the constant pressure room S2. However, if at least the pressure sensor 53 is accommodated in the pressure change room S1, components other than the pressure sensor 53 may be accommodated in the pressure change room S1. In the housing 31, a liquid detection seal and the like may be provided so as to understand infiltration of the liquid.

(Connection Mechanism)

As shown in FIG. 4 and FIG. 5, the connection mechanism 73 has a connection cap 80, a first connection member 81, and an annular piece 82.

The connection cap 80 is formed from a resin material being softer than the storage-battery holder 36 and having elasticity such as the silicone resin and the like. The connection cap 80 is attached to the connection pedestal 48 from the retention unit 22 side in the axial direction. The connection cap 80 has a base portion 91, a flange portion 92, and a surrounding convex portion 93.

As shown in FIG. 5, the base portion 91 is formed in a cylindrical shape having the axis O as a central axis. In the base portion 91, accommodation concave portions 95 recessed toward the retention unit 22 side in the axial direction are formed in positions overlapping each electrode retainer 50 in the planar view respectively. Each accommodation concave portion 95 extends in the axial direction and the accommodation concave portions 95 are communicated in the radial direction. In the base portion 91, an electrode insertion hole 97 is formed at the position overlapping each accommodation concave portion 95 in the planar view. The electrode insertion hole 97 penetrates the base portion 91 in the axial direction and communicates with the inside of the accommodation concave portion 95.

As shown in FIG. 3, in the base portion 91, a port insertion hole 99 is formed at the position overlapping the communication port 51 in the planar view. The port insertion hole 99 penetrates the base portion 91 in the axial direction.

As shown in FIG. 3 and FIG. 5, in the connection cap 80, the electrode retainer 50 is accommodated in each accommodation concave portion 95, and the communication port 51 is inserted into the port insertion hole 99. Accordingly, the connection cap 80 is assembled with the storage-battery holder 36 in a state of abutting with an end surface of the connection pedestal 48 facing the retention unit 22 side in the axial direction. In such state, the pin electrode 49 protrudes toward the retention unit 22 side in the axial direction from the base portion 91 and through the electrode insertion hole 97. The communication port 51 protrudes toward the retention unit 22 side in the axial direction from the base portion 91 and through the port insertion hole 99. In other words, the surface facing the retention unit 22 side in the connection cap 80 (base portion 91) forms a base surface 91*a* from which the pin electrode 49 protrudes and where the communication port 51 opens.

The flange portion 92 expands outwardly in the radial direction in the end portion of the base portion 91 at the opposite side of the retention unit 22 in the axial direction.

The surrounding convex portion 93 protrudes in the axial direction from the end surface of the base portion 91 facing the retention unit 22 side in the axial direction. More specifically, the surrounding convex portion 93 is formed in an annular shape extending along an external circumferential edge of the base portion 91. In other words, the surrounding convex portion 93 is configured to surround the pin electrode 49 and the communication port 51 together at a separated position at the external side in the radial direction with respect to the pin electrode 49 and the communication port 51. If the surrounding convex portion 93 is the configuration to surround the circumference of the pin electrode 49 and the communication port 51 together, the surrounding convex portion 93 may be positioned at an internal side in the radial direction with respect to the external circumferential edge of the base portion 91. The surrounding convex portion 93 is not limited to the annular shape and may be formed in a polygonal shape or the like. According to the present embodiment, the phrase "surrounding" is not limited to a configuration extending continuously and also includes the configuration extending intermittently. In other words, the surrounding convex portion 93 according to the present embodiment may be suitably changed if the surrounding convex portion 93 is the configuration surrounding the circumference of the pin electrode 49 and the communication port 51 together.

The surrounding convex portion 93 is formed in a triangle shape having a sharp tip end toward the retention unit 22 side in the axial direction in a vertical cross-sectional view along the axial direction. A protrusion height of the surrounding convex portion 93 from the base portion 91 is higher than the communication port 51 and lower than the pin electrode 49. However, the protrusion height of the surrounding convex portion 93 may be higher than the pin electrode 49. The shape of the surrounding convex portion 93 in the vertical cross-sectional view is not limited to the triangle shape.

The first connection member 81 has a base cylindrical portion 100, a vertical engagement convex portion (from first vertical engagement convex portion 101*a* to third vertical engagement convex portion 101*c*), and a horizontal engagement convex portion 102.

The base cylindrical portion 100 is formed in a multi-stage cylindrical shape having the axis O as a central axis, and a dimeter decreases by steps toward the retention unit 22 side in the axial direction. An end portion in the base cylindrical portion 100 positioned at the opposite side of the retention unit 22 in the axial direction is fitted into the internal side of the intervenient member 72. In this state, an end portion in the base cylindrical portion 100 at the retention unit 22 side in the axial direction surrounds the circumference of the connection cap 80 in a state of sandwiching the flange portion 92 in an interval with the connection pedestal 48 in the axial direction. An external flange portion 105 expanding outwardly in the radial direction is formed in the end portion in the base cylindrical portion 100 at the retention unit 22 side in the axial direction.

Figure 6:
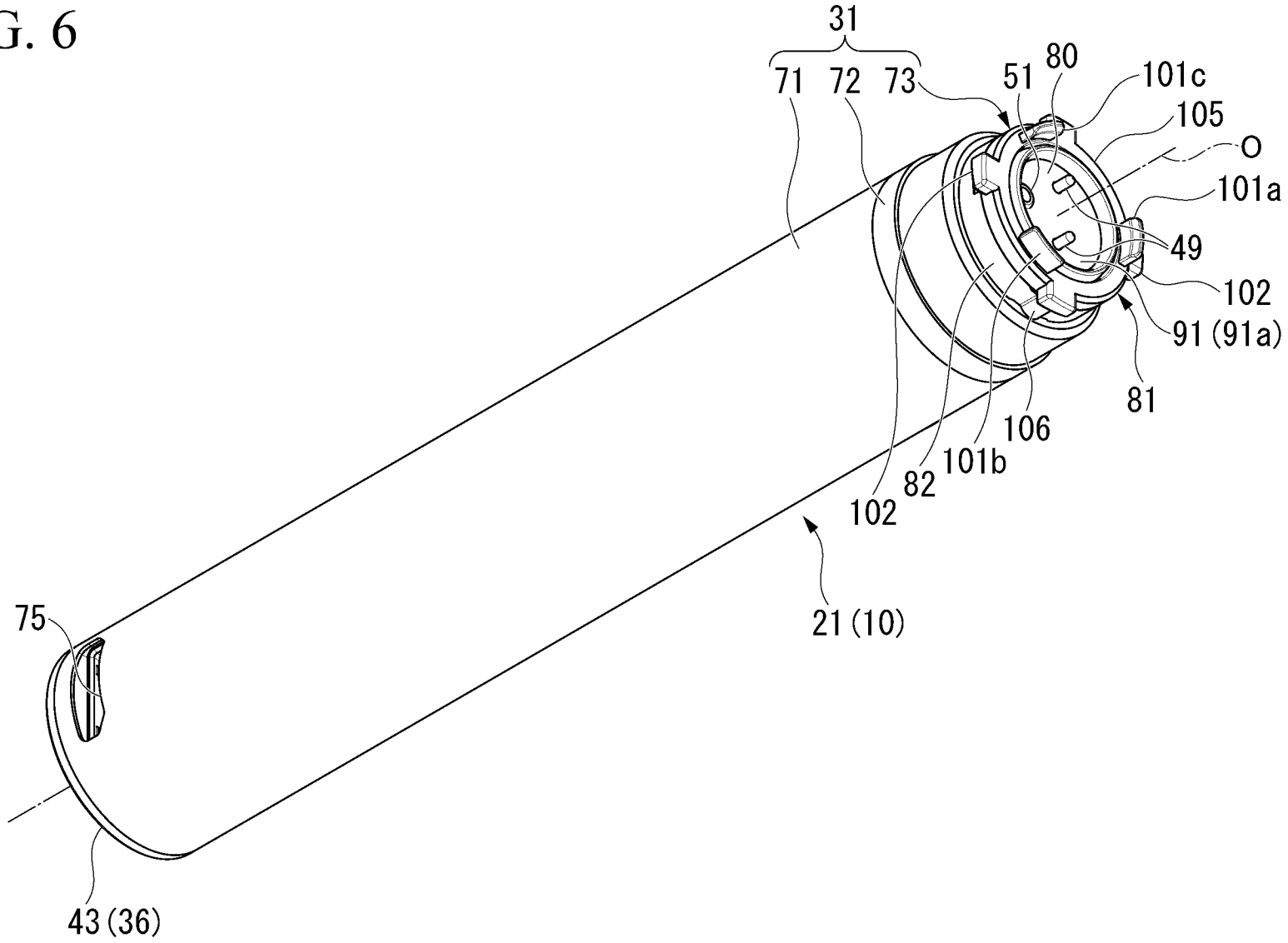
FIG. 6 is a perspective view showing the power unit according to the embodiment.

FIG. 6 is a perspective view of the power unit 21.

As shown in FIG. 5 and FIG. 6, the vertical engagement convex portions 101*a*-101*c* protrude toward the retention unit 22 side in the axial direction from the base cylindrical portion 100. A plurality of the vertical engagement convex portions 101*a*-101*c* are formed to be separated at intervals in the circumferential direction. According to the present embodiment, each of the vertical engagement convex portions 101*a*-101*c* are evenly disposed in the circumferential direction by a 120-degree interval. The vertical engagement convex portions 101*a*-101*c* may be single or multiple. A pitch of the vertical engagement convex portions 101*a*-101*c* may be suitably changed. In this case, the multiple vertical engagement convex portions 101*a*-101*c* may be unevenly disposed.

Figure 7:
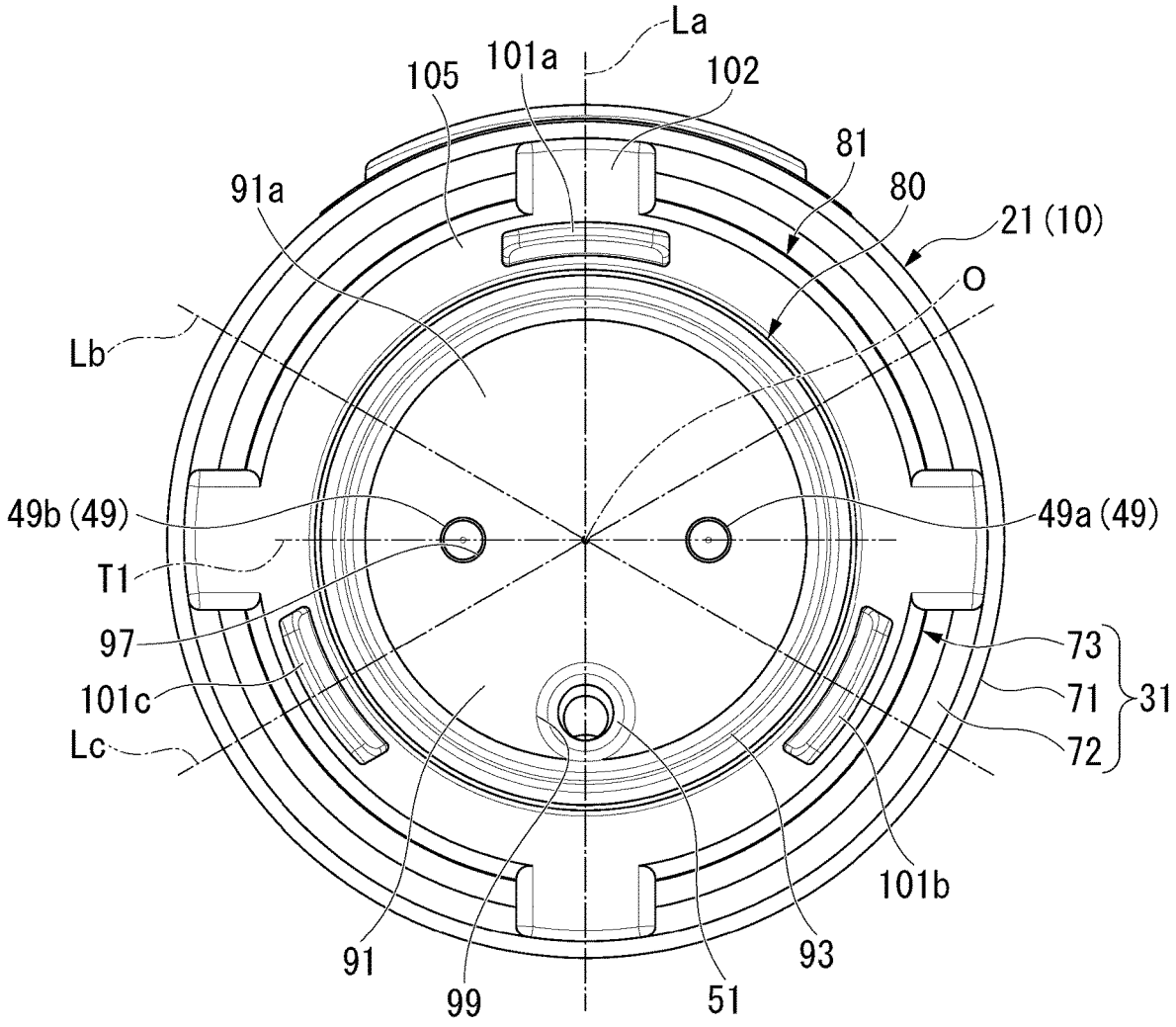
FIG. 7 is a plan view showing the power unit according to the embodiment viewed from a retaining unit side in an axial direction.

FIG. 7 is a planar view showing the power unit 21 viewed from the retention unit 22 side.

As shown in FIG. 7, each of the vertical engagement convex portions 101*a*-101*c* is disposed so as to cause the pin electrode 49 not to be disposed on virtual straight lines La-Lc connecting the center in the circumferential direction of each vertical engagement convex portion 101*a*-101*c* and the axis O. More specifically, the pin electrodes 49 are disposed at positions being line symmetry with respect to the virtual straight line La connecting the first vertical engagement convex portion 101*a* and the axis O. In other words, a virtual straight line T1 connecting each pin electrode 49 is orthogonal to the virtual straight line La and distances from the virtual straight line La to each pin electrode 49 are the same as each other.

As shown in FIG. 5 and FIG. 6, an end edge in each vertical engagement convex portion 101*a*-101*c* positioned at the retention unit 22 side in the axial direction is positioned at the retention unit 22 side in the axial direction more than the pin electrode 49. Each vertical engagement convex portion 101*a*-101*c* is formed in a rectangle shape in a side view from the radial direction respectively. In an end portion at the retention unit 22 side in the axial direction in each vertical engagement convex portion 101*a*-101*c*, a surface facing the internal side in the radial direction is formed as an inclined surface whose thickness in the radial direction gradually becomes thinner toward the retention unit 22 side in the axial direction. The inclined surface functions as a guide for smoothly guiding each vertical engagement convex portion 101*a*-101*c* to an engagement concave portion 210 of the cartridge 11 described below.

The horizontal engagement convex portion 102 protrudes outwardly in the radial direction from the external flange portion 105. The horizontal engagement convex portion 102 is formed in a rectangle shape in the planar view. A plurality of the horizontal engagement convex portions 102 are formed to be separated by intervals in the circumferential direction. According to the present embodiment, each of the horizontal engagement convex portions 102 is evenly disposed in the circumferential direction by a 90-degree interval. According to the present embodiment, a single horizontal engagement convex portion 102 is disposed at the same position with the first vertical engagement convex portion 101*a* in the circumferential direction. The horizontal engagement convex portion 102 may be single or multiple. A pitch of the horizontal engagement convex portions 102 may be suitably changed. In this case, multiple horizontal engagement convex portions 102 may be unevenly disposed.

The annular piece 82 is formed in a thin annular shape. The base cylindrical portion 100 is inserted into the annular piece 82 from the retention unit 22 side in the axial direction such that the annular piece 82 is clipped between the intervenient member 72 and the external flange portion 105 in the axial direction. As shown in FIG. 5, a bending portion 106 is formed in a portion of the annular piece 82 in the circumferential direction. The bending portion 106 is formed in an arch shape expanding outwardly in the radial direction. The bending portion 106 is configured to be elastically deformable in the radial direction. The bending portion 106 is positioned at the internal side in the radial direction more than an external end surface of the horizontal engagement convex portion 102.

A plurality of the bending portions 106 are formed to be separated by intervals in the circumferential direction. For example, the bending portions 106 are disposed at the same positions in the circumferential direction of a pair of horizontal engagement convex portions 102 that are opposed with each other in the radial direction (left-right direction) among the horizontal engagement convex portions 102. However, a number of the bending portions 106 may be suitably changed. For example, the bending portion 106 may be formed corresponding to each horizontal engagement convex portion 102, or the bending portion 106 may be formed corresponding to only one horizontal engagement convex portion 102.

(Retaining Unit)

Figure 8:
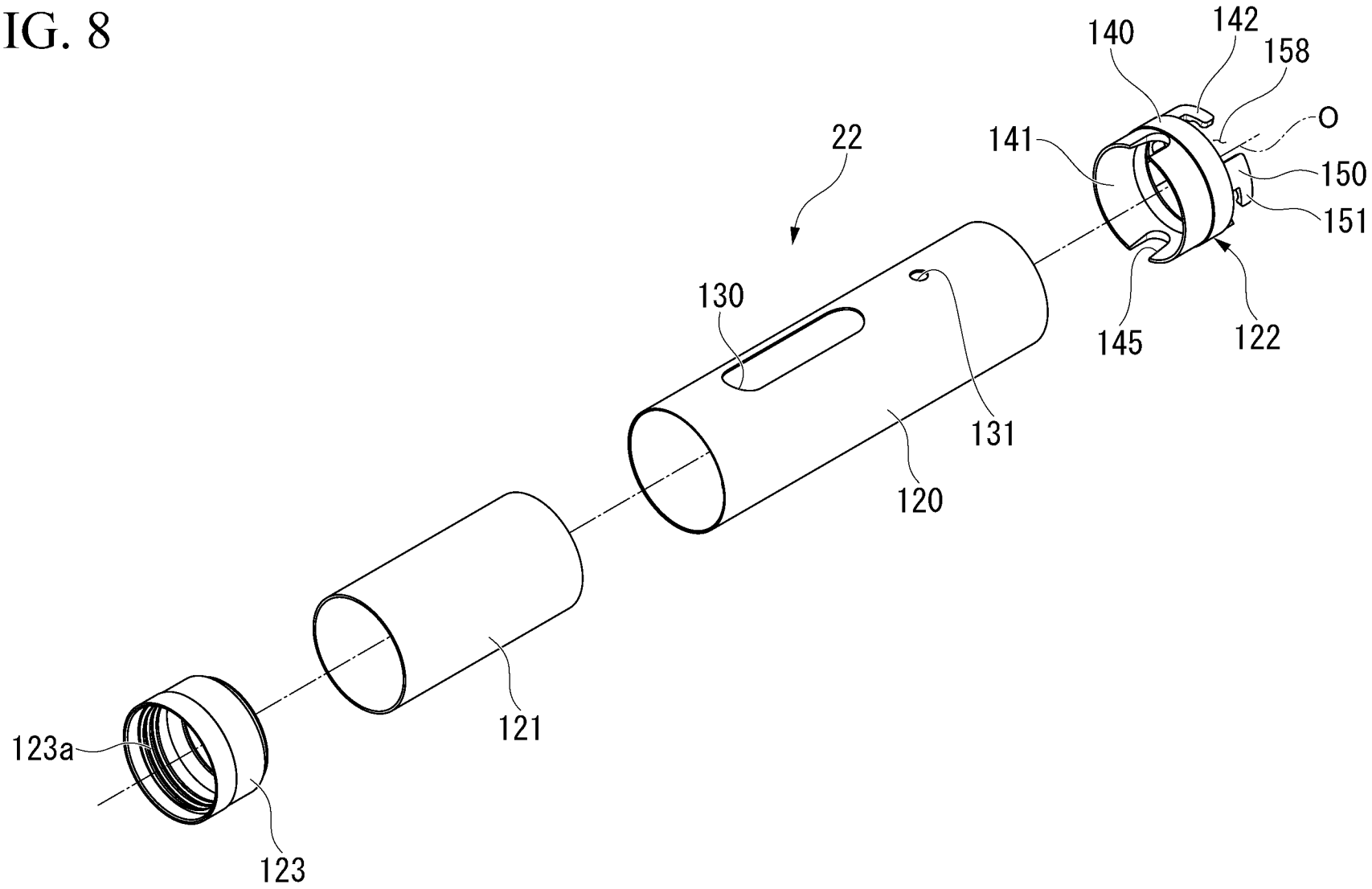
FIG. 8 is an exploded perspective view showing the retaining unit according to the embodiment.

FIG. 8 is an exploded perspective view of the retention unit 22.

As shown in FIG. 8, the retention unit 22 is attached to the main body unit 10 so as to be attachable to and detachable from the main body unit 10. More specifically, the retention unit 22 has a container-retaining cylinder 120, a transmission cylinder 121, a second connection member 122, and a sleeve 123.

The container-retaining cylinder 120 is formed in a cylindrical shape with the axis O as a central axis. An observation hole 130 is formed in a central portion of the container-retaining cylinder 120 in the axial direction. The observation hole 130 penetrates the container-retaining cylinder 120 in the radial direction. The observation hole 130 is formed in an oval shape with the axial direction as a longitudinal direction. The observation hole 130 is formed in a portion of the container-retaining cylinder 120 being opposed with each other in the radial direction. A number, a position, a shape and the like of the observation hole 130 may be suitably changed.

A ventilation hole 131 is formed in a portion of the container-retaining cylinder 120 positioned at the power unit 21 side in the axial direction more than the observation hole 130. The ventilation hole 131 penetrates the container-retaining cylinder 120 in the radial direction. The ventilation hole 131 causes the inside and outside of the retention unit 22 to be communicated with each other. The ventilation hole 131 is formed in a portion of the container-retaining cylinder 120 being opposed with each other in the radial direction (front-rear direction). A number, a position, a shape and the like of the ventilation hole 131 may be suitably changed.

The transmission cylinder 121 is formed from a material having optical transparency. The transmission cylinder 121 is inserted into the container-retaining cylinder 120. More specifically, the transmission cylinder 121 is positioned at the mouthpiece 23 side in the axial direction more than the ventilation hole 131 in the container-retaining cylinder 120 to cover the observation hole 130 from the internal side in the radial direction. In other words, the user can visually recognize the inside of the retention unit 22 through the observation hole 130 and the transmission cylinder 121. The retention unit 22 may be configured without the observation hole 130 and the transmission cylinder 121.

The second connection member 122 is locked by the first connection member 81 at the time of attaching the retention unit 22 to the main body unit 10. More specifically, the second connection member 122 has a fitting cylinder 140, a guide cylinder 141, and a locking piece 142.

The fitting cylinder 140 is formed in a cylindrical shape with the axis O as a central axis. The fitting cylinder 140 is fitted into a portion of the container-retaining cylinder 120 positioned at the power unit 21 side in the axial direction more than the transmission cylinder 121 by press fitting or the like.

The guide cylinder 141 is disposed to be coaxial with the fitting cylinder 140. The guide cylinder 141 extends to the mouthpiece 23 side in the axial direction from the fitting cylinder 140. The guide cylinder 141 is formed in a tapered cylindrical shape whose internal diameter gradually increases toward the mouthpiece 23 side in the axial direction. An external diameter of the guide cylinder 141 is smaller than an external diameter of the fitting cylinder 140. In the guide cylinder 141, a clearance portion 145 is formed at a position overlapping the ventilation hole 131 in a side view viewed from the radial direction. For example, the clearance portion 145 is formed in a U shape having an opening at the mouthpiece 23 side in the axial direction. The ventilation hole 131 opens to the inside of the retention unit 22 through the clearance portion 145. The shape of the clearance portion 145 only has to be configured to cause at least part of the ventilation hole 131 to be exposed in the retention unit 22. In a case in which the guide cylinder 141 and the ventilation hole 131 are disposed in different positions in the axial direction, the guide cylinder 141 may be configured without the clearance portion 145.

Figure 9:
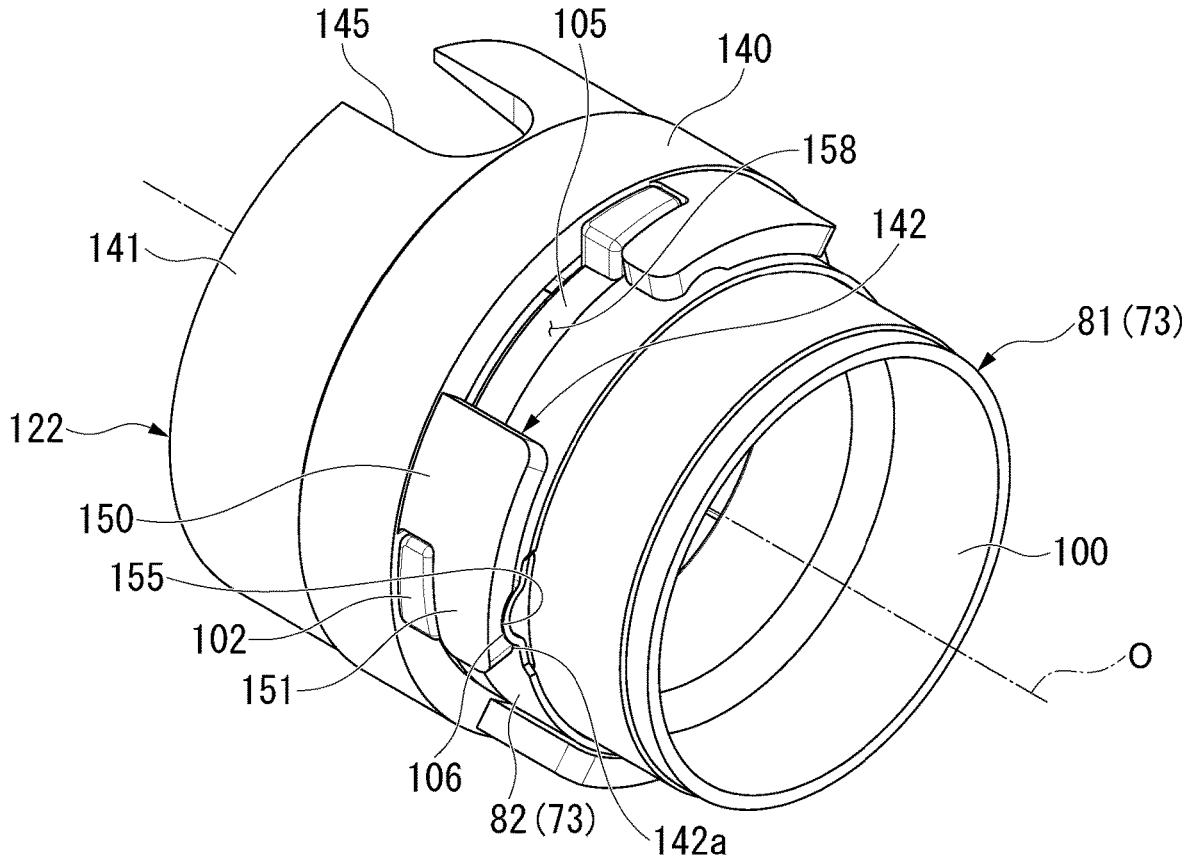
FIG. 9 is a perspective view showing a connection structure of a first connection member and a second connection member according to the embodiment.

FIG. 9 is a perspective view showing a connection structure of the first connection member 81 and the second connection member 122.

As shown in FIG. 8 and FIG. 9, the locking piece 142 protrudes toward the power unit 21 side in the axial direction from the fitting cylinder 140. The locking piece 142 is formed in a L shape in a side view viewed from the radial direction. More specifically, the locking piece 142 has a vertical extending portion 150 and a horizontal extending portion 151.

The vertical extending portion 150 protrudes toward the power unit 21 side in the axial direction from the fitting cylinder 140.

As shown in FIG. 9, the horizontal extending portion 151 extends from an end portion of the vertical extending portion 150 at the power unit 21 side toward one side only in the circumferential direction.

Figure 10:
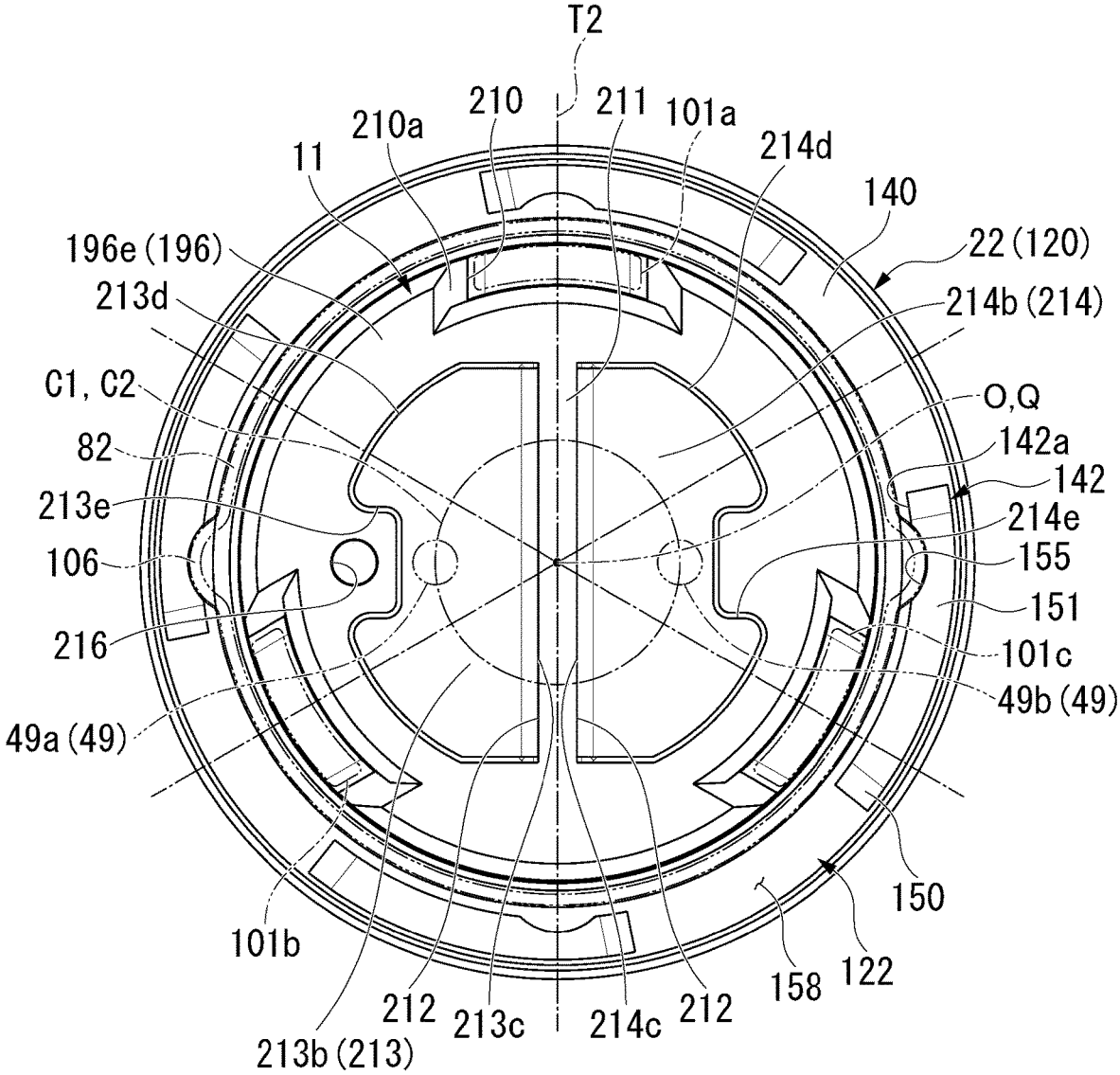
FIG. 10 is a plan view showing the retaining unit and a cartridge according to the present embodiment viewed from the power unit side in the axial direction.

FIG. 10 is a planar view of the retention unit 22 and the cartridge 11 viewed from the power unit 21 side in the axial direction.

As shown in FIG. 9 and FIG. 10, in the horizontal extending portion 151, an engagement concave portion 155 recessed toward the external side in the radial direction is formed in the end portion at the one side of the circumferential direction. The engagement concave portion 155 is formed in a semicircular shape toward the external side in the radial direction.

A plurality of the locking pieces 142 are formed to be separated by intervals in the circumferential direction. According to the present embodiment, each of the locking pieces 142 is evenly disposed in the circumferential direction by a 90-degree interval. Between two adjacent locking pieces 142 in the circumferential direction, an engagement groove 158 is formed for the horizontal engagement convex portion 102 to be inserted. The engagement groove 158 is formed in an L shape in the side view.

As shown in FIG. 2 and FIG. 9, the power unit 21 and the retention unit 22 are configured to be attachable and detachable by connecting the locking piece 142 and the horizontal engagement convex portion 102. In other words, in order to connect the power unit 21 and the retention unit 22, the horizontal engagement concave portion 102 is inserted into the engagement groove 158 in the axial direction, and then the power unit 21 and the retention unit 22 are relatively rotated around the axis O. Accordingly, the horizontal engagement concave portion 102 is engaged between the horizontal extending portion 151 and the fitting cylinder 140 in the axial direction. During the procedure when the power unit 21 and the retention unit 22 are relatively rotated around the axis O, the bending portion 106 of the annular piece 82 are fitted into the engagement concave portion 155. Accordingly, the bending portion 106 is engaged with the engagement concave portion 155 in the circumferential direction. As a result, the power unit 21 and the retention unit 22 are assembled with each other in a state in which position alignment in the axial direction and the circumferential direction is finished.

As shown in FIG. 9, in the engagement groove 158 according to the present embodiment, a portion between the fitting cylinder 140 and the horizontal extending portion 151 is formed in a tapered shape with a width in the axial direction that gradually becomes narrower from the other side toward the one side in the circumferential direction. More specifically, an end surface of the horizontal extending portion 151 facing the mouthpiece 23 side in the axial direction is formed in an inclined surface extending toward the power unit 21 side in the axial direction from the other side toward the one side in the circumferential direction.

The horizontal engagement convex portion 102 is formed in a tapered shape with a width in the axial direction that gradually becomes narrower from the other side toward the one side in the circumferential direction. More specifically, an end surface of the horizontal engagement convex portion 102 facing the opposite side of the retention unit 22 in the axial direction is formed in an inclined surface extending to the mouthpiece 23 side in the axial direction from the one side toward the other side in the circumferential direction. Accordingly, it is possible to prevent interference of the horizontal extending portion 151 and the horizontal engagement convex portion 102 and improve the assembling workability at the time of connecting the power unit 21 with the retention unit 22.

As shown in FIG. 8, the sleeve 123 is fitted into part of the container-retaining cylinder 120 that is positioned at the mouthpiece 23 side more than the transmission cylinder 121 in the axial direction by being pressed or the like. The transmission cylinder 121 is held in the axial direction between the second connection member 122 and the sleeve 123. A female screw portion 123*a* is formed on an internal circumferential surface of the sleeve 123.

(Mouthpiece)

Figure 11:
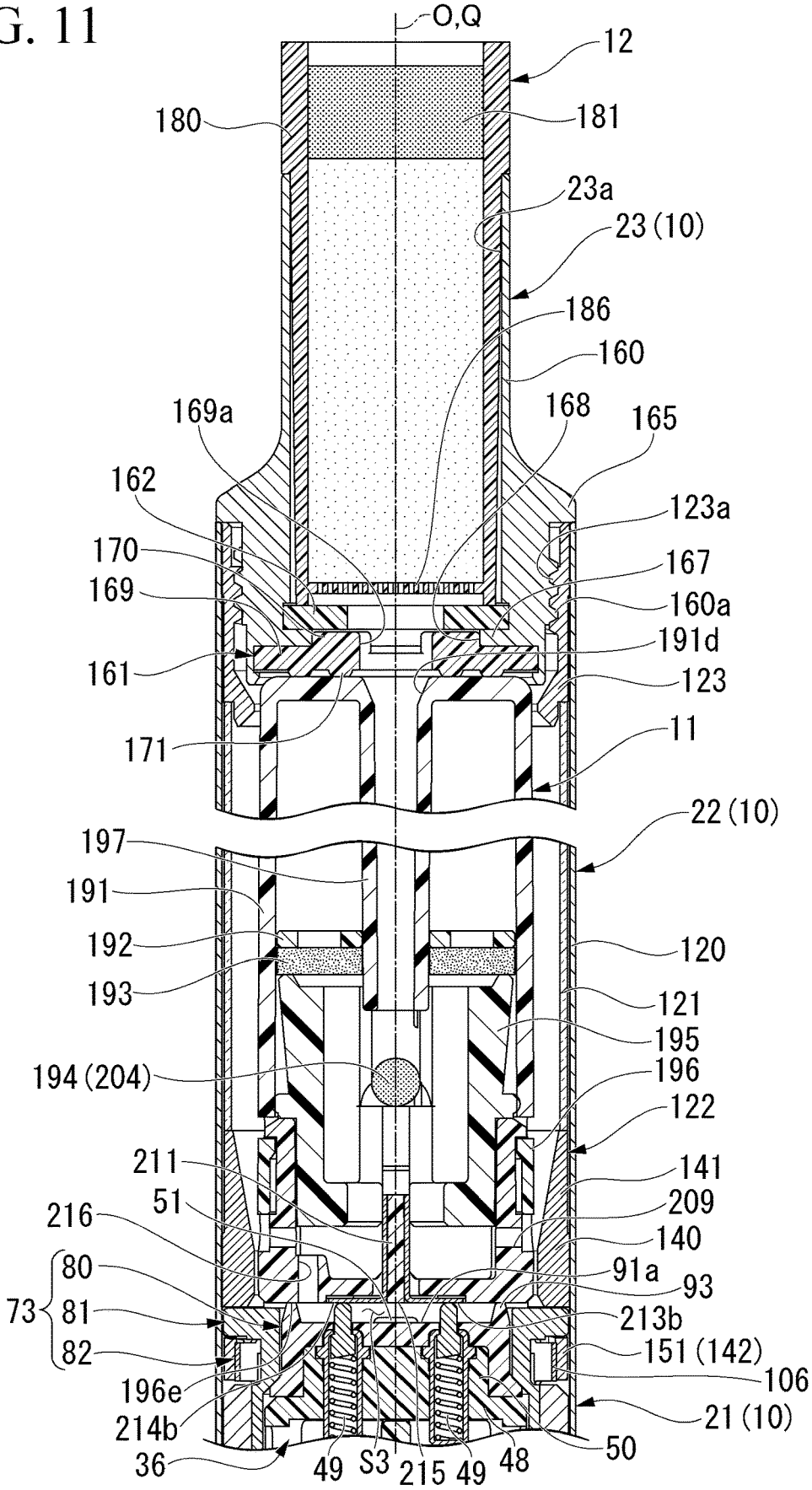
FIG. 11 is a cross-sectional view corresponding to line XI-XI in FIG. 1.
Figure 12:
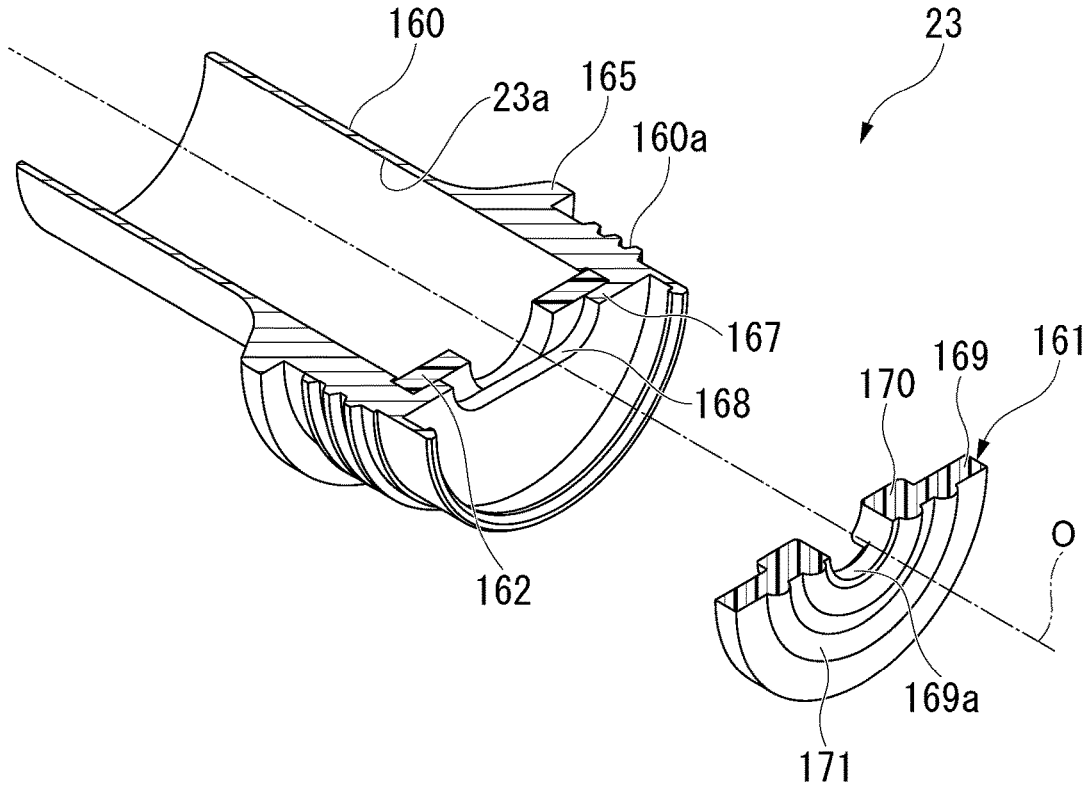
FIG. 12 is an exploded perspective view showing a mouthpiece corresponding to line XII-XII in FIG. 1.

FIG. 11 is a cross-sectional view along line XI-XI in FIG. 1. FIG. 12 is an exploded perspective view of the mouthpiece 23 corresponding to line XII-XII in FIG. 1.

As shown in FIG. 11 and FIG. 12, the mouthpiece 23 has a mouthpiece main body 160 and a slip prevention member (first slip prevention member 161 and second slip prevention member 162).

A suction port 23*a* being capable of accommodating the tobacco capsule 12 is formed in the mouthpiece 23. The mouthpiece main body 160 is formed in a multi-stage cylindrical shape with the axis O as a central axis. A male screw portion 160*a* is formed in an end portion of the mouthpiece main body 160 at the retention unit 22 side in the axial direction. The male screw portion 160*a* of the mouthpiece main body 160 is screwed to the female screw portion 123*a* of the sleeve 123 to be attachable thereto and detachable therefrom. The mouthpiece main body 160 may be a configuration attaching to or detaching from the sleeve 123 by a method besides the screwing (for example, fitting or the like).

In the mouthpiece main body 160, an abutting flange 165 is formed in a portion positioned at the opposite side of the retention unit 22 in the axial direction with respect to the male screw portion 160*a*. The abutting flange 165 is formed in an annular shape extending outwardly in the radial direction. The abutting flange abuts on the retention unit 22 in the axial direction in a state in which the mouthpiece 23 is attached to the retention unit 22. The abutting flange 165 is configured such that an external diameter of the abutting flange 165 gradually decreases away from the retention unit 22 in the axial direction.

A partitioning portion 167 configured to partition the inside of the mouthpiece main body 160 in the axial direction is formed in an end portion of the mouthpiece main body 160 at the retention unit 22 side in the axial direction. In the partitioning portion 167, a penetration hole 168 penetrating the partitioning portion 167 is formed at a position overlapping the axis O. For example, the penetration hole 168 is formed in an oval shape having one direction of the radial direction as a longitudinal direction. A shape of the penetration hole 168 in a planar view may be a perfect circle shape, a polygonal shape or the like.

For example, the first slip prevention member 161 is integrally formed from a resin material such as a silicone resin or the like. The first slip prevention member 161 has a ring portion 169, a fitting protrusion 170, and an engagement protrusion 171.

The ring portion 169 is fitted in the mouthpiece main body 160 from the retention unit 22 side in the axial direction. Position alignment of the first slip prevention member 161 in the axial direction with respect to the mouthpiece main body 160 is performed by the ring portion 169 abutting the partitioning portion 167 in the axial direction.

A communication hole 169*a* is formed in a center of the ring portion 169. The communication hole 169*a* is formed to cause the inside of the retention unit 22 and the inside of the mouthpiece main body 160 to be communicated via the penetration hole 168.

A pair of the fitting protrusions 170 are formed at positions facing each other in the radial direction and sandwiching the communication hole 169*a* therebetween in the internal circumferential edge of the ring portion 169. The fitting protrusions 170 protrude toward the opposite side of the retention unit 22 in the axial direction from the ring portion 169. Each of the fitting protrusions 170 is fitted to two end portions of the penetration hole 168 in the radial direction. Accordingly, position alignment of the first slip prevention member 161 with the mouthpiece main body 160 in the circumferential direction is performed. Accordingly to the present embodiment, the configuration that the fitting protrusions 170 are fitted into the penetration hole 168 is described; however, a configuration that the fitting protrusions 170 are fitted into other hole besides the penetration hole 168 may be configured.

The engagement protrusion 171 protrudes toward the retention unit 22 side in the axial direction from the ring portion 169. The engagement protrusion 171 is formed in a circular shape having the axis O as a center. According to the present embodiment, two of the engagement protrusions 171 are formed in a concentric circular shape. The first slip prevention member 161 may be a configuration without the engagement protrusion 171.

For example, the second slip prevention member 162 is integrally formed from the resin material such as the silicone resin or the like. The second slip prevention member 162 is fitted into the mouthpiece main body 160 from the opposite side of the retention unit 22 in the axial direction. The position alignment of the second slip prevention member 162 with respect to the mouthpiece main body 160 in the axial direction is performed by being abutted by the partitioning portion 167 in the axial direction.

(Tobacco Capsule)

As shown in FIG. 2 and FIG. 11, the tobacco capsule 12 is attached into the mouthpiece main body 160 from the opposite side of the retention unit 22 in the axial direction so as to be attachable thereto and detachable therefrom. The tobacco capsule 12 has a capsule portion 180 and a filter portion 181.

As shown in FIG. 11, the capsule portion 180 is formed in a bottomed cylindrical shape having the axis O as a central axis. In the capsule portion 180, in a bottom wall portion 186 for blocking an opening portion at the retention unit 22 side in the axial direction, a mesh opening penetrating the bottom wall portion 186 in the axial direction is formed.

The filter portion 181 is fitted into the capsule portion 180 from the opposite side of the retention unit 22 in the axial direction. Tobacco is sealed in a space formed by the capsule portion 180 and the filter portion 181.

(Cartridge)

As shown in FIG. 2, the cartridge 11 is configured to store the liquid aerosol source while atomizing the liquid aerosol source. The cartridge 11 is accommodated in the transmission cylinder 121 of the retention unit 22.

Figure 13:
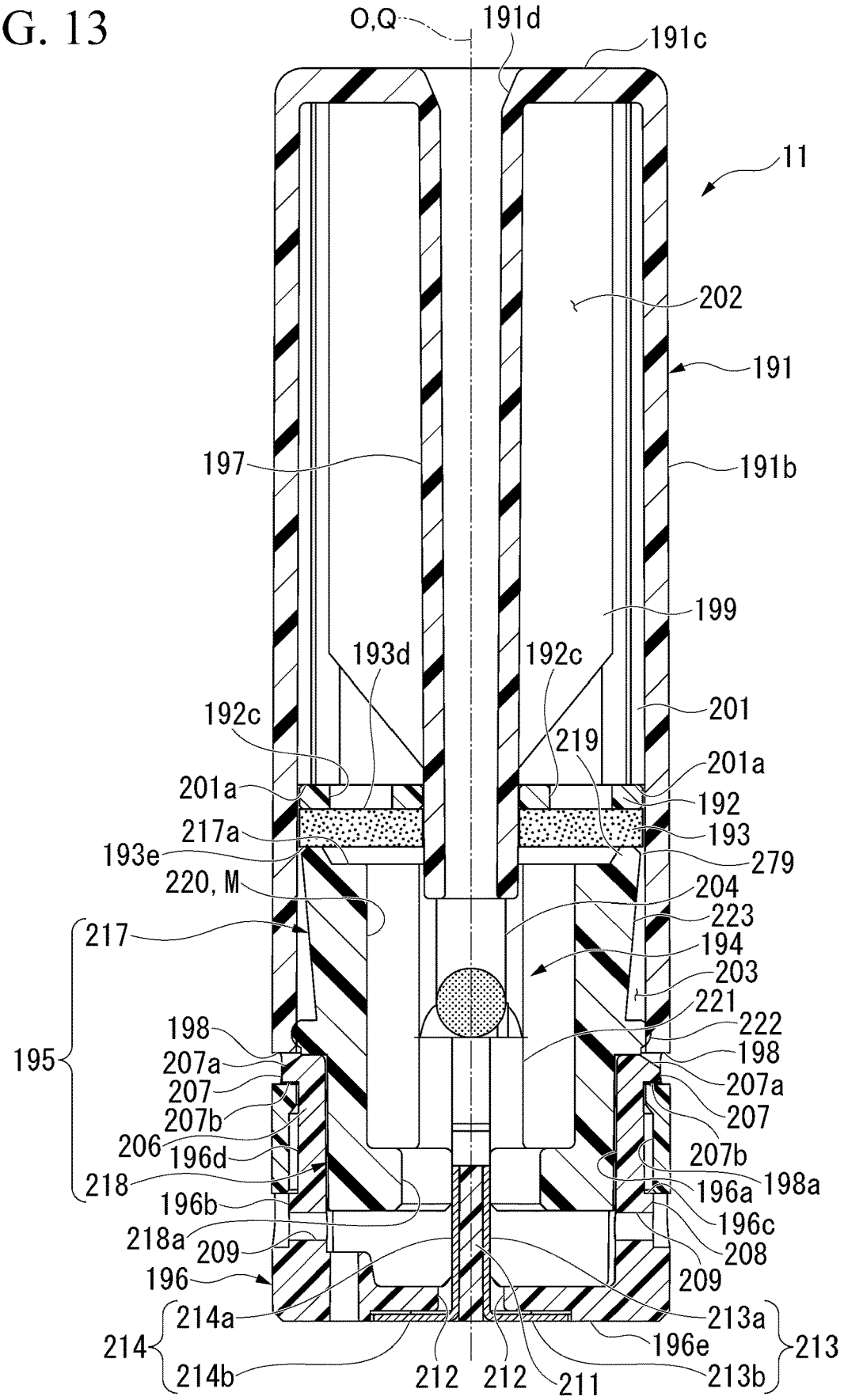
FIG. 13 is a cross-sectional view showing the cartridge according to the present embodiment along the axial direction.
Figure 14:
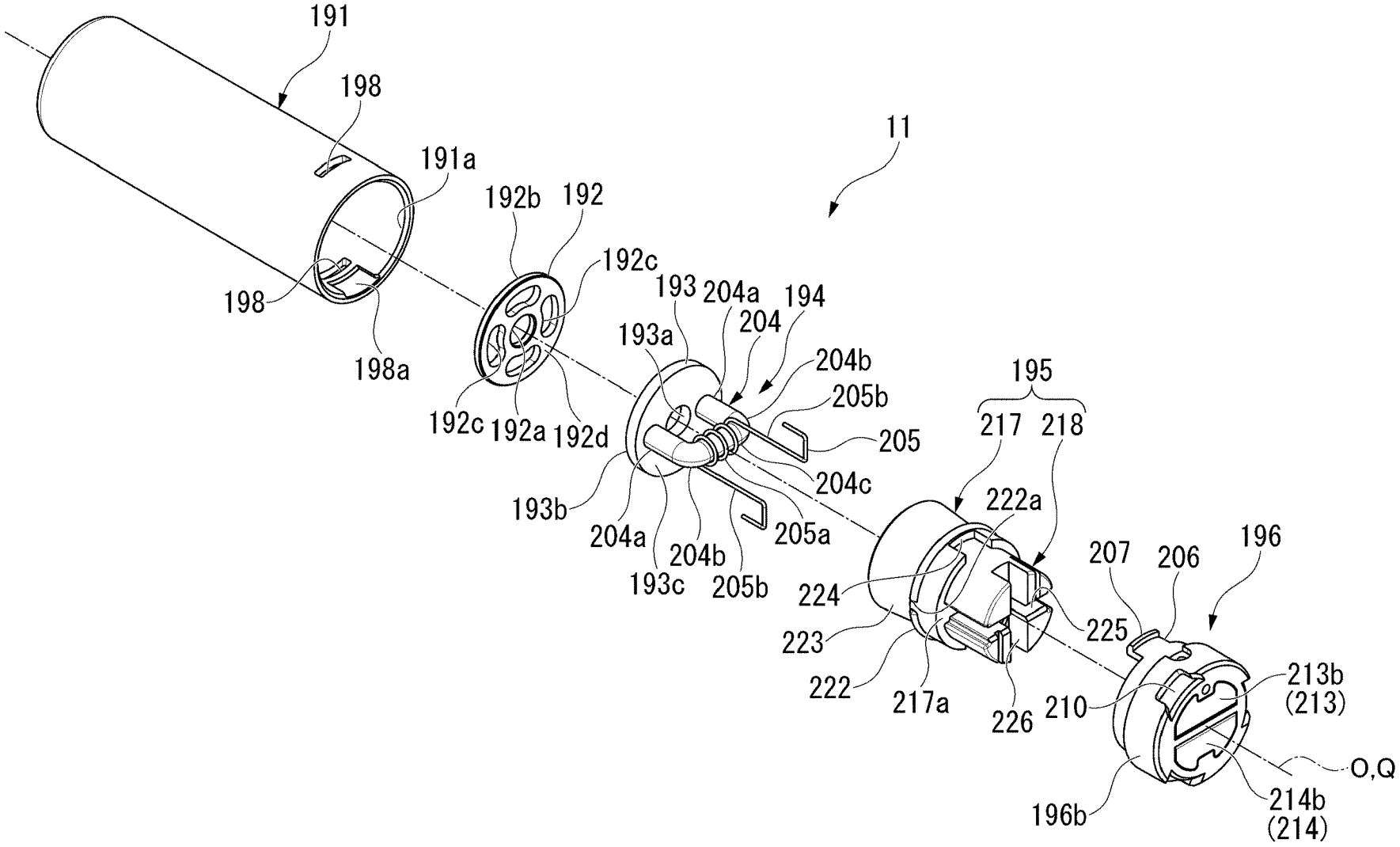
FIG. 14 is an exploded perspective view showing the cartridge according to the present embodiment.

FIG. 13 is a cross-sectional view of the cartridge 11 along the axial direction. FIG. 14 is an exploded perspective view of the cartridge 11.

As shown in FIG. 13 and FIG. 14, the cartridge 11 has a tank 191 formed in a bottomed cylindrical shape, a gasket (also referred to as a support member) 192 formed in a substantially disc shape and accommodated in the tank 191, a liquid retention body (also referred to as a partition plate and a first liquid retaining portion) 193 formed in a substantially disc shape, a heater 194, an atomization container (referred to as a container) 195, and a heater holder 196 configured to block an opening portion 191*a* of the tank 191.

Figure 15:
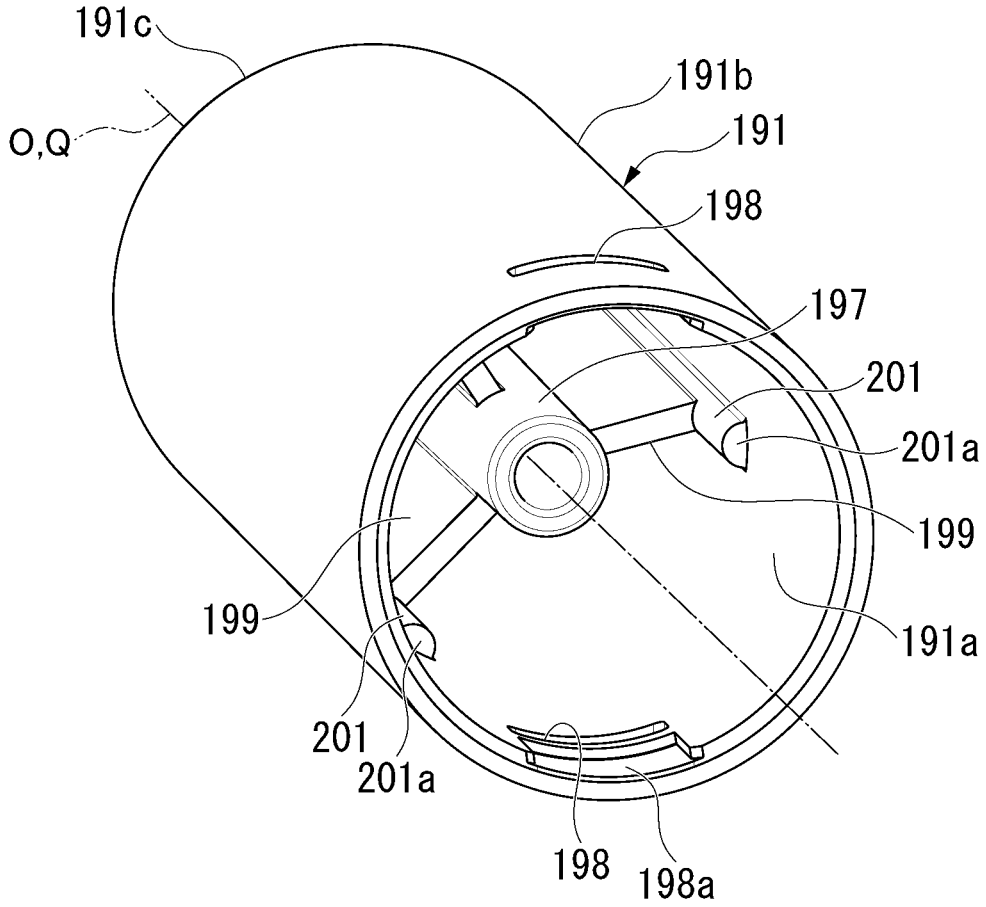
FIG. 15 is a perspective view showing the tank according to the present embodiment viewed from the opening portion side.

FIG. 15 is a perspective view of the tank 191 viewed from the opening portion 191*a* side.

As shown in FIG. 13 to FIG. 15, two engagement holes 198 are formed at a slightly bottom portion 191*c* side more than the opening portion 191*a* in a circumferential wall 191*b* of the tank 191. The engagement hole 198 is configured for fixing the heater holder 196 to the tank 191. The engagement hole 198 is formed in a rectangle shape viewed from the radial direction to become long in the circumferential direction. The two engagement holes 198 are disposed to be opposite to each other and to sandwich an axis Q of the tank 191 at two side of the axis Q. The axis Q coincides with the axis O of the main body unit 10 in a state in which the cartridge 11 is accommodated in the transmission cylinder 121. The axis Q is the common axis of each portion configuring the cartridge 11. Hereinafter, the axis Q is not only described as the axis Q of the tank 191, but also used in the description of each portion configuring the cartridge 11.

A guide concave portion 198*a* is formed on an internal circumferential surface slightly close to the opening portion 191*a* from the engagement hole 198 in the circumferential wall 191*b* of the tank 191. The guide concave portion 198*a* also opens at the opening portion 191*a* side. The guide concave portion 198*a* functions to guide an engagement piece 206 described below when fixing the heater holder 196 to the tank 191.

In the bottom portion 191*c* of the tank 191, a penetration hole 191*d* penetrating the bottom portion 191*c* at the center in the radial direction is formed. A flow passage tube (also referred to as a flow passage) 197 is formed in an annular shape and integrally formed in a circumferential edge of the penetration hole 191*d* to protrude from the internal surface of the bottom portion 191*c* to the inside of the tank 191. Accordingly, the inside of the flow passage tube 197 and the penetration hole 191*d* are communicated with each other. The flow passage tube 197 is a flow passage of the atomized aerosol. The flow passage tube 197 extends in a space from the bottom portion 191*c* to a position slightly close to the opening portion 191*a* with respect to a substantially center in the axial direction of the tank 191.

Between the internal circumferential surface of the circumferential wall 191*b* and an external circumferential surface of the flow passage tube 197, a plurality of ribs 199 (three according to the present embodiment) across the circumferential surface 191*b* and the flow passage 197 are integrally formed. The plurality of ribs 199 are disposed at equal intervals in the circumferential direction so as to be in a radial pattern viewed from the axial direction. The plurality of ribs 199 extend in a space from the bottom portion 191*c* of the tank 191 to a position slightly in front of an end portion (tip end) at the opening portion 191*a* side of the flow passage tube 197. The plurality of ribs 199 are configured to support the flow passage tube 197.

In the internal circumferential surface of the circumferential wall 191*b*, a convex portion 201 is integrally formed at the position where the ribs 199 are formed. The convex portion 201 extends along the ribs 199 in the axial direction.

The convex portion 201 is formed in a space from the bottom portion 191*c* of the tank 191 to a position between an end portion (tip end) at the opening portion 191*a* side of the rib 199 and a tip end of the flow passage tube 197. The convex portion 201 functions to enhance a mechanical strength of the tank 191 while performing position alignment of the gasket 192.

The gasket 192 is formed to have an external diameter substantially the same as the internal diameter of the tank 191. The gasket 192 is configured to perform position alignment of a liquid retention body 193 described below while maintaining an orientation of the liquid retention body 193. In other words, the gasket 192 supports the liquid retention body 193 described below. An insertion hole 192*a* capable of being inserted by the flow passage tube 197 is formed in a center in the radial direction of the gasket 192. The gasket 192 is accommodated in the tank 191 such that the flow passage tube 197 is inserted into the insertion hole 192*a*. A surface 192*b* is abutted by the end surface 201*a* of the convex portion 201 such that position alignment of the gasket 192 in the tank 191 is performed. In the state in which the position alignment of the gasket 192 is performed, an external circumferential surface of the gasket 192 comes in contact with the internal circumferential surface of the tank 191. The insertion hole 192*a* of the gasket 192 comes in contact with the external circumferential surface of the flow passage tube 197.

A plurality of opening portions 192*c* (four according to the present embodiment) are formed in a major portion between the insertion hole 192*a* and the external circumferential surface of the gasket 192. The opening portion 192*c* is formed in an arc shape viewed from the axial direction. The plurality of opening portions 192*c* are formed by equal intervals in the circumferential direction. Two side sandwiching the gasket 192 in the tank 191 are communicated with each other via the opening portion 192*c*. The liquid retention body 193 is disposed on another surface 192*d* at the opposite side of the surface 192*b* of the gasket 192.

The liquid retention body 193 is a porous member having liquid absorbency. The liquid retention body 193 is formed from a cotton type fibrous material, for example. The liquid retention body 193 and the gasket 192 are formed in almost the same substantial disc shape. In other words, the liquid retention body 193 is formed to have an external diameter substantially the same as the internal diameter of the tank 191. An insertion hole 193*a* into which the flow passage tube 197 is insertable is formed in a center in the radial direction of the liquid retention body 193. The flow passage tube 197 is inserted into the insertion hole 193*a* and the liquid retention body 193 overlaps the other surface 192*d* of the gasket 192 such that position alignment of the liquid retention body 193 is performed. An external circumferential surface (also referred to as external lateral surface) of the liquid retention body 193 comes in contact with the internal circumferential surface (also referred to as internal lateral surface) of the tank 191. The insertion hole 193*a* of the liquid retention body 193 comes in contact with the external circumferential surface of the flow passage tube 197.

The inside of the tank 191 is partitioned into a liquid storage room 202 at the bottom portion 191 side and an opening room 203 at the opening portion 191*a* side by the liquid retention body 193. In other words, the liquid retention body 193 is in contact with the opening portion 191*a* of the tank 191. The liquid retention body 193 has a suction-port-side surface 193*b* facing the mouthpiece 23 side and in contact with the other surface 192*d* of the gasket 192 and an opposite-suction-port-side surface 193*c* at the opposite side of the suction-port-side surface 193*b*. The suction-port-side surface 193*b* is in contact with the liquid storage room 202 of the tank 191 via the opening portion 192*c* of the gasket 192. Hereinafter, a contact portion of the suction-port-side surface 193*b* of the liquid retention body 193 and the tank 191 (liquid storage room 202) is referred to as a first contact portion 193*d*. An area of the first contact portion 193*d* is not the same as the whole area of the suction-port-side surface 193*b* of the liquid retention body 193 and smaller than the area of the suction-port-side surface 193*b* due to the part via the gasket 192.

The liquid aerosol source is stored in the liquid storage room 202. The opening room 203 is a room for atomizing the aerosol source suctioned by the liquid retention body 193.

The opposite-suction-port-side surface 193*c* of the liquid retention body 193 is exposed to the opening room 203. The heater 194 is disposed so as to be connected to the opposite-suction-port-side surface 193*c* of the liquid retention body 193 exposed to the opening room 203.

The heater 194 is a configuration for atomizing the liquid aerosol source. The heater 194 is accommodated in the opening room 203. The heater 194 has a wick 204 formed in a substantial U shape, and an electrical heating wire 205 for heating the wick 204. The wick 204 is a porous member formed in a substantial cylindrical shape and having liquid absorbency. The wick 204 is bent and deformed to a substantial U shape.

More specifically, the wick 204 is configured by two axial-direction extending portions 204*a* extending in the axial direction and a radial-direction extending portion 204*c* by connecting two end portions of the two axial-direction extending portions 204*a* via a bending portion 204*b*. The other end of the axial-direction extending portion 204*a* is connected to the liquid retention body 193. Accordingly, the aerosol source absorbed by the liquid retention body 193 is suctioned by the wick 204.

The electrical heating wire 205 has an electrical heating wire main body 205*a* formed in a helical shape to surround the circumference of the radial-direction extending portion 204*c* of the wick 204, and two terminal portions 205*b* extending from two terminals of the electrical heating wire main body 205*a* toward the heater holder 196 side along the axial direction. When the wick 204 is heated by the electrical heating wire 205, the aerosol source absorbed by the wick 204 is atomized. Tip ends of the two terminal portions 205*b* are turned back toward the liquid retention body 193 side. The two terminal portions 205*b* are connected to the heater holder 196.

Figure 16:
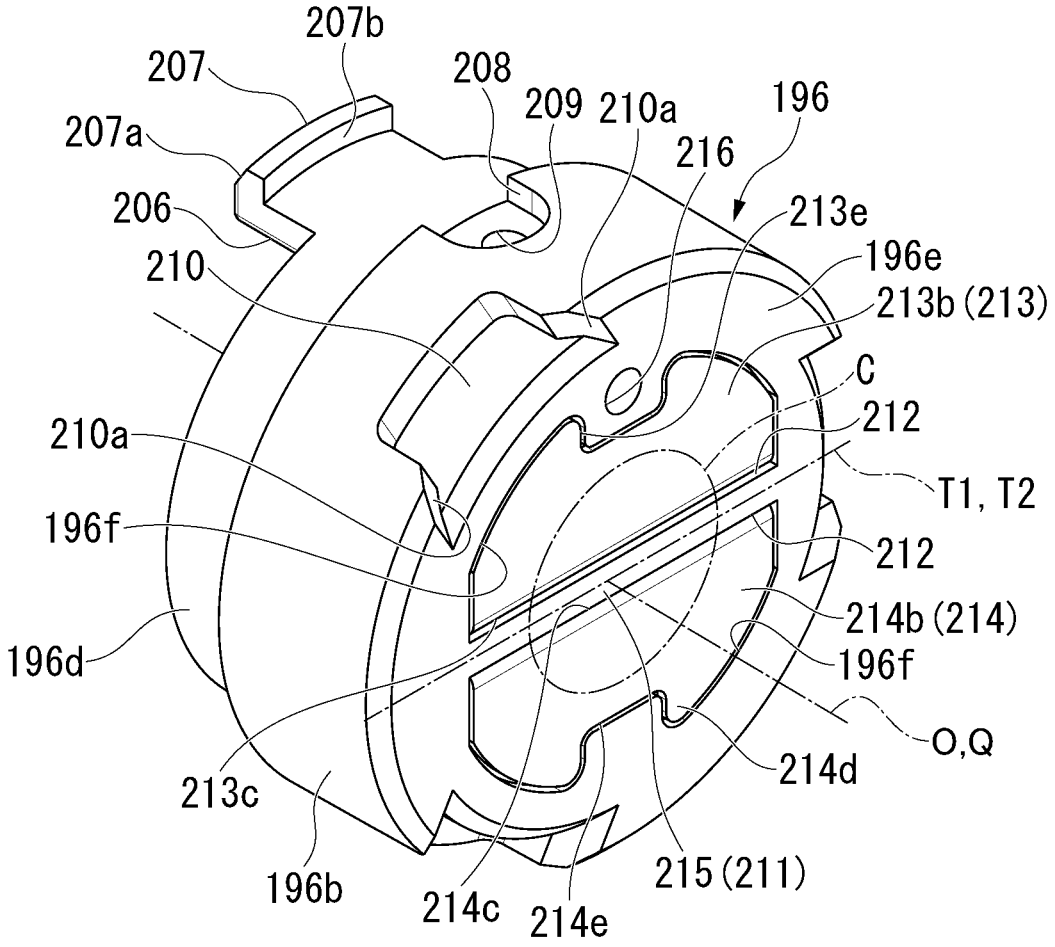
FIG. 16 is a perspective view showing a heater retainer according to the present embodiment viewed from the power unit side.

FIG. 16 is a perspective view showing the heater holder 196 viewed from the power unit 21 side (first side in the axial direction).

As shown in FIG. 13 and FIG. 16, the heater holder 196 is formed in a substantial bottomed cylindrical shape. An opening portion 196*a* of the heater holder 196 is directed to the tank 191 side and the opening portion 191*a* of the tank 191 is blocked.

A circumferential wall 196*b* of the heater holder 196 is formed to have an external diameter substantially the same as the external diameter of the circumferential wall 191*b* of the tank 191. A fitting portion 196*d* whose diameter is reduced via a step surface 196*c* is formed in a space between a substantial center and the opening portion 196 in the external circumferential surface of the circumferential wall 196*b*. The fitting portion 196*d* is fitted into the internal circumferential surface of the circumferential wall 191*b* in the tank 191. An end portion at the opening portion 191*a* side in the circumferential wall 191*b* of the tank 191 is in contact with the step surface 196*c* of the circumferential wall 196*b*. Accordingly, position alignment of the heater holder 196 with respect to the tank 191 in the axial direction is performed.

Two engagement pieces 206 are integrally formed at positions corresponding to the two engagement holes 198 of the tank 191 in an end portion at the opening portion 196*a* side of the fitting portion 196*d*. The two engagement pieces 206 protrude toward the corresponding engagement holes 198. In other words, the two engagement pieces 206 are disposed to be opposite to each other at two side of the axis Q of the heater holder 196 to sandwich the axis Q.

The engagement pieces 206 is engaged with the engagement holes 198 of the tank 191 so as to integrate the tank 191 with the heater holder 196. The engagement pieces 206 are formed to be elastically deformable in the radial direction. An engagement claw 207 insertable into the engagement hole 198 of the tank 191 is formed at a tip end of the engagement piece 206 to protrude outwardly in the radial direction.

The engagement claw 207 is formed to have a triangle cross-sectional shape corresponding to a planar surface defined by the axial direction and the radial direction. In other words, the engagement claw 207 has a surface at a tip end side formed as an inclined surface 207*a* that is inclined toward the base end side (the fitting portion 196*d* side) towards the outward in the radial direction. On the other hand, a flat surface 207*b* at the base end side of the engagement claw 207 is orthogonal with the axial direction.

A concave portion 208 arranged in the axial direction with the engagement claw 207 is formed in part of an external circumferential surface apart from the fitting portion 196*d* in the circumferential wall 196*b* of the heater holder 196. The concave portion 208 opens toward the outward in the radial direction and the step surface 196*c* side. A first air-suction hole 209 penetrating the circumferential wall 196*b* in the thickness direction is formed in the concave portion 208. The inside and the outside of the circumferential wall 196*b* are communicated via the first air-suction hole 209.

Three engagement concave portions 210 are formed at a bottom portion 196*e* side in the circumferential wall 196*b* of the heater holder 196. The three engagement concave portions 210 are disposed by equal intervals in the circumferential direction (by 120-degree intervals in the circumferential direction) and at positions apart from the positions where the concave portion 208 is formed. The engagement concave portions 210 are formed to open toward the outward in the radial direction and the bottom portion 196*e* side. A tapered flattening portion 210*a* is formed at the bottom portion 196*e* side of the engagement concave portion 210 such that the width of the engagement concave portion 210 in the circumferential direction gradually becomes wider towards the bottom portion 196*e*.

The vertical engagement convex portions (convex portions) 101*a*-101*c* of the first connection member 81 are inserted into the three engagement concave portions 210 respectively. Accordingly, the heater holder 196 (cartridge 11) is connected with the first connection member 81 while position alignment of the heater holder 196 (cartridge 11) and the first connection member 81 in the circumferential direction is performed.

In the bottom portion 196*e* of the heater holder 196, a connection wall 211 is integrally formed in a substantial plate shape standing from the internal surface in the axial direction. The connection wall 211 extends along the radial direction through the axis Q of the heater holder 196, and two ends in the longitudinal direction of the radial direction are connected to the internal surface of the circumferential wall 196*b*. The inside of the heater holder 196 is partitioned into two rooms by such connection wall 211.

In the bottom portion 196*e* of the heater holder 196, two slits 212 are formed. The two slits 212 are disposed on two surfaces in the plate-thickness direction of the connection wall 211.

Electrodes 213, 214 are disposed on the two surfaces in the plate-thickness direction of the connection wall 211 respectively. The electrodes 213, 214 have extraction electrodes 213*a*, 214*a* disposed on the connection wall 211 and connection electrodes (first planar electrode and second planar electrode) 213*b*, 214*b* extending in a bending manner from the extraction electrodes 213*a*, 214*a* to the external surface of the bottom portion 196*e* via the corresponding slits 212 respectively. Two terminal portions 205*b* of the electrical heating wires 205 configuring the heater 194 are connected to the extraction electrodes 213*a*, 214*a* respectively.

The connection electrodes 213*b*, 214*b* are formed in a substantially semicircular shape at two sides in the radial direction to sandwich an insulation portion 215 described below. More specifically, the two connection electrodes 213*b*, 214*b* are disposed to cause sides 213*c*, 214*c* in a linear shape when viewed from the axial direction to face each other in the radial direction. Two connection electrodes 213*b*, 214*b* are disposed to cause arc-shaped sides 213*d*, 214*d* in an arc shape when viewed from the axial direction to configure an external circumferential portion. An end portion of the connection wall 211 is interposed between the sides 213*c*, 214*c* of the two connection electrodes 213*b*, 214*b*. A tip end of the pin electrode (electrode main body) 49 held by each electrode retainer 50 is in contact with each of the connection electrodes 213*b*, 214*b* in a state in which the heater holder 196 (cartridge 11) is connected with the first connection member 81. In other words, the bottom portion 196*e* of the heater holder 196 functions as an electrode configuration surface being opposite to the base surface 91*a* in the axial direction in a state in which the cartridge 11 is attached to the main body unit 10.

Each of the connection electrodes 213*b*, 214*b* is at least formed on a rotation locus of the pin electrode 49 (first pin electrode 49*a* and second pin electrode 49*b*) in a case when the power unit 21 and the cartridge 11 are relatively rotated around the axis O (axis Q). In other words, each of the connection electrodes 213*b*, 214*b* is formed in a region including both of a first virtual circle C1 with the axis O as a center and through the first pin electrode 49*a*, and a second virtual circle C2 with the axis O as a center and through the second pin electrode 49*b*. According to the present embodiment, the pin electrodes 49*a*, 49*b* are disposed in a line symmetry manner such that the virtual circles C1, C2 are coincided with each other.

The end portion of the connection wall 211 interposed between the sides 213*c*, 214*c* of the two connection electrodes 213*b*, 214*b* extends along the radial direction through the axis Q of the heater holder 196; in other words, the connection wall 211 is disposed on a virtual straight line T1 in a predetermined direction among the virtual straight lines T1 connecting two pin electrodes 49. The predetermined direction is coincided with a virtual straight line T2 through a center in the circumferential direction of one engagement concave portion 210 among the three engagement concave portions 210 formed in the heater holder 196 and the axis Q of the heater holder 196. The connection wall 211 is formed with a width in a short direction (circumferential direction around the axis Q) that is a little larger than a diameter of each pin electrode 49.

The end portion of the connection wall 211 is disposed in this way to function as the insulation portion 215 partitioning the connection electrodes 213*b*, 214*b* in the circumferential direction. By disposing the insulation portion 215 on the virtual straight line T2 through the center in the circumferential direction of one engagement concave portion 210 and the axis Q of the heater holder 196, the two connection electrodes 213*b*, 214*b* are in contact with the tip ends of each pin electrode 49 respectively in the state in which the heater holder 196 (cartridge 11) and the first connection member 81 are connected with each other. In other words, there is no possibility for either of the two connection electrodes 213*b*, 214*b* to come in contact with the two pin electrodes 49 simultaneously. In this manner, the connection electrodes 213*b*, 214*b* are formed in a semicircular shape at two sides of the radial direction to sandwich the virtual straight line T2 (insulation portion 215) and include the virtual circles C1, C1, and expand outwardly (arc-shaped sides 213*d*, 214*d*) and inwardly (sides 213*c*, 214*c*) in the radial direction.

Concave portions 213*e*, 214*e* recessed inwardly in the radial direction are formed in a substantial center in the circumferential direction in the arc-shaped sides 213*d*, 214*d* of the two connection electrodes 213*b*, 214*b*. In the bottom portion 196*e* of the heater holder 196, a second air-suction hole 216 penetrating the bottom portion 196*e* in the thickness direction is formed at a position corresponding to one concave portion 213*e* between the positions corresponding to the concave portions 213*e*, 214*e* of the connection electrodes 213*b*, 214*b*. The inside and the outside of the bottom portion 196*e* are communicated via the second air-suction hole 216.

A concave portion 196*f* having the same shape with the connection electrodes 213*b*, 214*b* viewed from the axial direction is formed at the position corresponding to the connection electrodes 213*b*, 214*b* in the bottom portion 196*e*. The connection electrodes 213*b*, 214*b* are accommodated in the concave portion 196*f*. By forming the concave portion 196*f*, surfaces of the connection electrodes 213*b*, 214*b* and a surface of a portion of the bottom portion 196*e* where the connection electrodes 213*b*, 214*b* are not disposed are positioned on the same plane. A portion of the atomization container 195 is accommodated so as to be fitted in the internal circumferential surface of the circumferential wall 196*b* in the heater holder 196.

As shown in FIG. 11, the external circumferential portion of the bottom portion 196*e* comes in contact with the surrounding convex portion 93 in the axial direction in the state in which the cartridge 11 is attached in the retention unit 22. Accordingly, a space surrounded by the bottom portion 196*e* and the connection cap 80 (the base surface 91*a* and the surrounding convex portion 93) forms a buffer space S3 communicating the communication port 51 and the second air-suction hole 216. In the example shown in FIG. 11, the communication port 51 and the second air-suction hole 216 are separate from each other in the axial direction and disposed at positions departing from each other in the circumferential direction. The communication port 51 and the second air-suction hole 216 may be disposed at positions departing from each other in the radial direction.

The communication port 51 according to the present embodiment is communicated with the inside of the flow passage tube 197 via the buffer space S3 and the second air-suction hole 216. A portion of the bottom portion (second surface) 196*e* in contact with the surrounding convex portion 93 is formed in a flat surface orthogonal with the axial direction. The portion of the bottom portion 196*e* in contact with the surrounding convex portion 93 may be a convex surface, a concave surface, an inclined surface or the like.

According to the present embodiment, the surrounding convex portion 93 is in close contact with the bottom portion 196*e* in an elastically deformation state since the cartridge 11 is pressed by the mouthpiece 23. However, the surrounding concave portion 93 and the bottom portion 196*e* do not have to be in close contact with each other and may be separated from each other. In other words, if it is possible to generate a negative pressure in the pressure change room S1 via the communication port 51 during the suction, a micro gap may be generated between the surrounding convex portion 93 and the bottom portion 196*e*.

Figure 17:
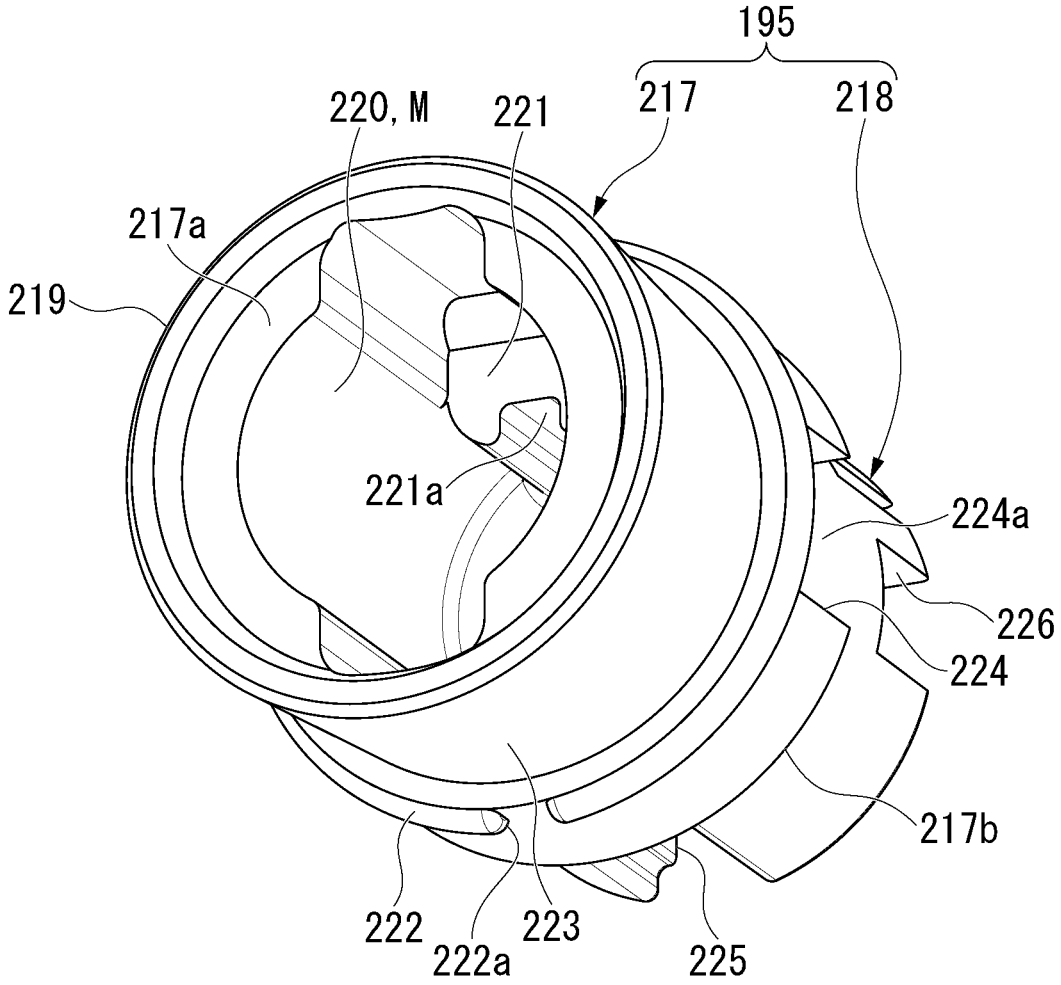
FIG. 17 is a perspective view showing an atomization container according to the present embodiment viewed from a liquid retainer body side.

FIG. 17 is a perspective view showing the atomization container 195 viewed from the liquid retention body 193 side (second side in the axial direction).

The atomization container 195 shown in FIG. 13, FIG. 14, and FIG. 17 is formed from the resin material having the elasticity such as the silicone resin or the like. The atomization container 195 is disposed in a space between the opposite-suction-port-side surface 193*c* of the liquid retention body 193 and the vicinity of the bottom portion 196*e* of the heater holder 196 in the axial direction. In other words, the atomization container 195 is formed in a substantial cylindrical shape so as to surround the circumference of the heater 194, and the atomization container 195 is integrally formed by a cylinder portion 217 fitting to the internal circumferential surface of the circumferential surface 191*b* in the tank 191 and a fitting portion 218 in a substantial block shape and fitting to the internal circumferential surface of the circumferential surface 196*b* in the heater holder 196.

A step surface 217*a* is formed in a major portion at a center in the radial direction in an end portion at the liquid retention body 193 side of the cylinder portion 217. By forming the step surface 217*a*, a protrusion portion 219 in a ring shape is formed that the external circumferential portion of the cylinder portion 217 protrudes toward the liquid retaining boy 193 side. An end portion of the protrusion portion 219 is in contact with the opposite-suction-port-side surface 193*c* of the liquid retention body 193. An external diameter of the protrusion portion 219 is substantially the same or a little smaller than the internal diameter of the circumferential wall 191*b* in the tank 191.

An accommodation concave portion 220 is formed in a major portion of the step surface 217*a* corresponding to the shape of the heater 194. The accommodation concave portion 220 becomes an atomization room M configured to store the aerosol atomized by the heater 194. The atomization room M is communicated with the flow passage tube 197 of the tank 191.

A bearing surface 221 to which the bending portion 204*b* of the wick 204 configuring the heater 194 is placed is formed in the accommodation concave portion 220. A concave portion 221*a* for avoiding interference of the terminal portion 205*b* of the electrical heating wire 205 configuring the heater 194 is formed in a surface at the internal side in the radial direction of the bearing surface 221.

A seal portion 222 being close to the fitting portion 218 is formed in the external circumferential surface of the cylinder portion 217. The seal portion 222 is formed across the whole circumference except for a notch portion 222*a* described below and to protrude outwardly in the radial direction. The seal portion 222 functions to secure a sealing performance between the cylinder portion 217 and the circumferential wall 191*b* of the tank 191, and functions to prevent the atomization container 195 from slipping from the tank 191.

An external diameter of the sealing portion 222 is a little larger than the internal diameter of the circumferential wall 191*b* of the tank 191. Accordingly, in a state in which the atomization container 195 is accommodated in the tank 191, the seal portion 222 is compressed in the axial direction. Therefore, the sealing performance of the seal portion 222 is secured, and the slipping of the atomization container 195 from the tank 191 is prevented due to the friction resistance of the seal portion 222.

Two notch portions 222*a* are formed in the seal portion 222. The two notch portions 222*a* are disposed to be opposite to each other at two sides of the axis Q of the tank 191 to sandwich the axis Q. The external air and a liquid accumulation portion 223 described below are communicated with each other by the notch portions 222*a*.

The liquid accumulation portion (referred to as liquid retaining portion or second liquid retaining portion) 223 is formed in the external circumferential surface of the cylinder portion 217 between the tip end of the protrusion portion 219 and the seal portion 222. The liquid accumulation portion 223 is configured to temporarily accumulate leaked aerosol source in a case in which the liquid aerosol source stored in the liquid storage room 202 of the tank 191 is leaked via the internal circumferential surface of the circumferential wall 191*b* of the tank 191 when the liquid retention body 193 and the wick 204 are saturated.

The liquid accumulation portion 223 is a concave portion (also referred to as a space) configured by obliquely forming the whole external circumferential surface of the cylinder portion 217 such that a gap between the external circumferential surface of the cylinder portion 217 and the circumferential wall 191*b* of the tank 191 gradually becomes narrower from the seal portion 222 toward the tip end of the protrusion portion 219. In other words, the liquid accumulation portion 223 is the concave portion where the gap between the external circumferential surface of the cylinder portion 217 and the circumferential wall 191*b* of the tank 191 gradually becomes wider towards the opening portion 191*a* of the tank 191. Since the liquid accumulation portion 223 is formed in this manner, a narrow portion 279 where a micro gap is generated between the protrusion portion 219 and the circumferential wall 191*b* of the tank 191 is formed in the vicinity of the protrusion portion 219 of the cylinder portion 217.

The liquid accumulation portion 223 is formed in the external circumferential surface of the cylinder portion 217 and the cylinder portion 217 is formed in a substantial cylindrical shape surrounding the circumference of the heater 194. In other words, the liquid accumulation portion 223 and the heater 194 are disposed to be separated from each other in the radial direction via the cylinder portion 217. The electrical heating wire 205 of the heater 194 and the liquid accumulation portion 223 are formed to be separated from each other in the radial direction, and the electrical heating wire 205 and the liquid accumulation portion 223 are not in contact with each other.

The end portion of the protrusion portion 219 in the cylinder portion 217 is in contact with the opposite-suction-port-side surface 193*c* of the liquid retention body 193. The external circumferential surface of the liquid retention body 193 is in contact with the internal circumferential surface of the tank 191. Accordingly, the narrow portion 279 formed between the protrusion portion 219 of the cylinder portion 217 and the circumferential wall 191*b* of the tank 191 is covered (blocked) by the external circumferential portion of the liquid retention body 193.

In other words, the narrow portion 279 of the liquid accumulation portion 223 is in contact with the opposite-suction-port-side surface 193*c* of the liquid retention body 193. The narrow portion 279 (liquid accumulation portion 223) is disposed at a position overlapping the external circumferential surface of the liquid retention body 193 and the internal circumferential surface of the tank 191 viewed from the axial direction (viewing the opposite-suction-port side from the mouthpiece 23).

The suction-port-side surface 193*b* of the liquid retention body 193 is in contact with the liquid storage room 202 of the tank 191 via the gasket 192 such that the liquid accumulation portion 223 is connected with the tank 191 via the liquid retention body 193. The liquid accumulation portion 223 is disposed at the opposite side of the suction port more than the tank 191 (liquid storage room 202). The liquid accumulation portion 223 (narrow portion 279) is in contact with the opposite-suction-port-side surface 193*c* of the liquid retention body 193. Hereinafter, a contact portion of the opposite-suction-port-side surface 193*c* and the liquid accumulation portion 223 (narrow portion 279) is referred to as a second contact portion 193*e*.

The second contact portion 193*e* is positioned at an external circumferential portion of the liquid retention body 193; however, the first contact portion 193*d* is disposed at the position opposite to the opening portion 192*c* of the gasket 192 in the axial direction being apart from the external circumferential portion of the liquid retention body 193. In other words, the first contact portion 193*d* and the second contact portion 193*e* do not overlap each other when viewed from the axial direction (viewing the opposite side of the suction port from the mouthpiece 23).

A concave portion 224 receiving the engagement piece 206 is formed at a position corresponding to the engagement piece 206 at the heater holder 196 side more than the seal portion 222 in the external circumferential surface of the cylinder portion 217. The engagement piece 206 is inserted into the concave portion 224 such that position alignment of the atomization container 195 and the heater holder 196 in the circumferential direction is performed. A bottom surface 224*a* of the concave portion 224 in the cylinder portion 217 is in contact with the internal surface of the engagement piece 206 at the internal side in the radial direction.

The fitting portion 218 of the atomization container 195 is formed in a substantial cylindrical shape capable of fitting into the internal circumferential surface of the circumferential wall 196*b* in the heater holder 196. In other words, the fitting portion 218 is formed that an external diameter is reduced than the external diameter of the cylinder portion 217 via the step portion 217*b*. A slit 225 being insertable into the connection wall 211 of the heater holder 196 is formed in the fitting portion 218. A slit for electrical heating wire that is not shown in figures and communicates with the slit 225 is formed in the fitting portion 218, and the terminal portion 205*b* of the electrical heating wire 205 is insertable into the slit for electrical heating wire. By inserting the terminal portion 205*b* of the electrical heating wire 205 into the slit for electrical heating wire, the terminal portion 205*b* is held by the atomization container 195. The extraction electrodes 213*a*, 214*a* disposed in the connection wall 211 and the terminal portion 205*b* of the electrical heating wire 205 are connected.

A ventilation passage 226 is formed at a position in the fitting portion 218 corresponding to the first air-suction hole 209 of the heater holder 196 and the second air-suction hole 216. A slit 218*a* communicating the slit 225 and the ventilation passage 226 with the atomization room M (accommodation concave portion 220) of the cylinder portion 217 is formed in the fitting portion 218. The ventilation passage 226 and the atomization room M (accommodation concave portion 220) of the atomization container 195 are communicated via the slit 218*a*. Accordingly, the atomization room M (accommodation concave portion 220) is communicated with the first air-suction hole 209 and the second air-suction hole 216 of the heater holder 196 via the ventilation passage 226 and the slit 218*a*.

(Overall Assembly Structure of Suction Device)

Figure 18:
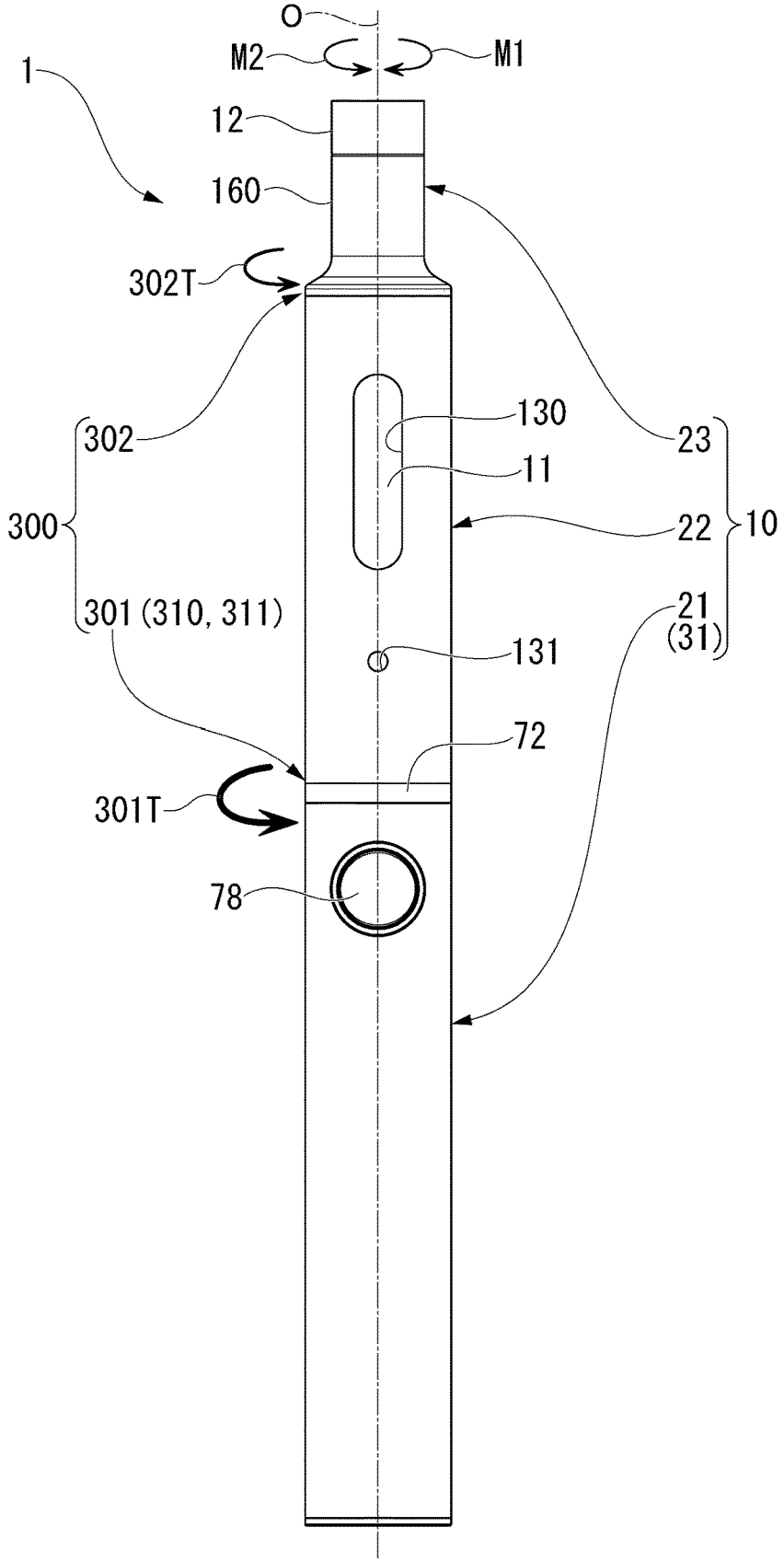
FIG. 18 is a front view showing a suction device according to the present embodiment.

FIG. 18 is a front view of the suction device 1.

As shown in FIG. 18, the main body unit 10 of the suction device 1 has a connection portion 300 configured to connect the power unit 21, the retention unit 22, and the mouthpiece 23 in the axial direction along the axis O (center axis). The connection portion 300 has a first rotation connection portion 301 connecting the power unit 21 and the retention unit 22 and a second rotation connection portion 302 connecting the retention unit 22 and the mouthpiece 23.

In the description hereinafter, in a planar view viewing the power unit 21 side from the mouthpiece 23 side along the axis O, in the circumferential direction around the axis O, a clockwise direction rotating around the axis O is referred to as a rotation direction M1, and a counter-clockwise direction rotating around the axis O is referred to as a rotation direction M2.

The first rotation connection portion 301 is configured to perform a connection and release the connection of the power unit 21 and the retention unit 22 by a relative rotation of the power unit 21 and the retention unit 22 around the axis O. In a case of taking the power unit 21 as a reference, when the retention unit 22 is rotated in the rotation direction M1 with respect to the power unit 21, the power unit 21 and the retention unit 22 are connected. When the retention unit 22 is rotated in the rotation direction M2 with respect to the power unit 21, the connection of the power unit 21 and the retention unit 22 is released.

The first rotation connection portion 301 has a rotation connection mechanism 310 configured by the first connection member 81 and the second connection member 122 shown in FIG. 9, and a lock mechanism 311 configured by the annular piece 82 and the second connection member 122 shown in FIG. 9 and FIG. 10. More specifically, as shown in FIG. 9, the rotation connection mechanism 310 is configured to insert the horizontal engagement convex portion 102 disposed in the first connection member 81 of the power unit 21 into the engagement groove 158 formed in the second connection member 122 of the retention unit 22, and then rotate the retention unit 22 in the rotation direction M1 (see FIG. 18) with respect to the power unit 21 so as to engage the horizontal engagement convex portion 102 to the locking piece 142 and connect the power unit 21 with the retention unit 22.

The lock mechanism 311 is configured to restrict the rotation of the retention unit 22 in the rotation direction M2 for releasing the connection by the rotation connection mechanism 310. More specifically, as shown in FIG. 9 and FIG. 10, the lock mechanism 311 has the bending portion 106 disposed in the annular piece 82 attached to the power unit 21 and protruding outwardly in the radial direction, and a tip end portion 142*a* disposed in the second connection member 122 of the retention unit 22 and protruding inwardly in the radial direction relatively with respect to a bottom portion of the engagement concave portion 155 in the locking piece 142. The tip end portion 142*a* of the locking piece 142 is positioned in a movement passage of the bending portion 106 around the axis O.

At the time of the connection in the rotation connection mechanism 310 (when the retention unit 22 is rotated in the rotation direction M1 with respect to the power unit 21), the bending portion 106 and the tip end portion 142*a* of the locking piece 142 come in contact with each other and the bending portion 106 climbs over the tip end portion 142*a* while elastically deforming inwardly in the radial direction. The bending portion 106 deforms outwardly in the radial direction after overcoming the tip end portion 142*a* to restore the shape and engages with the engagement concave portion 155. When the bending portion 106 engages with the engagement concave portion 155, the bending portion 106 and the tip end portion 142*a* of the locking piece 142 are locked in the rotation direction M1 to be opposite with each other. Accordingly, it is impossible to release the connection of the power unit 21 and the retention unit 22 without applying a certain force.

According to the first rotation connection portion 301, in order to improve manufacturing efficiency or the like, as shown in the present embodiment, even if the power unit 21 and the retention unit 22 are capable of being divided, it is possible to make the connection of the power unit 21 and the retention unit 22 by the rotation connection mechanism 310 easy and improve reliability (connection strength) of the connection state of the power unit 21 and the retention unit 22 by the lock mechanism 311. The locking by the lock mechanism 311 is performed simultaneously with the connection by the rotation connection mechanism 310 such that convenience (usability) of the assembly may be improved.

As shown in FIG. 10, in the lock mechanism 311, the bending portion 106 elastically deforming is disposed at the internal side in the radial direction of the locking piece 142 having a larger thickness and higher rigidness than the annular piece 82. Accordingly, in a state in which the power unit 21 and the retention unit 22 are connected, the bending portion 106 is covered by the locking piece 142 from the external side and protected. Accordingly, even if falling, collision or the like occurs, a number of cases such as the bending portion 106 being damaged become less. Accordingly, strength for repeatedly using the assembly is secured and the reliability of locking is improved.

As shown in FIG. 9, the lock piece 142 configured to lock the bending portion 106 has the engagement groove 158 to which the horizontal engagement convex portion 102 of the rotation connection mechanism 310 is engaged. In this manner, the lock piece 142 forms a portion (engagement groove 158) of the rotation connection mechanism 310 while forms a portion (tip end portion 142*a* (convex portion)) of the lock mechanism 311 such that it is relatively easy to improve the reliability (connection strength) of the connection state.

As shown in FIG. 18, the second rotation connection member 302 is configured to perform a connection and release the connection between the retention unit 22 and the mouthpiece 23 by the relative rotation of the retention unit 22 and the mouthpiece 23 around the axis O. In a case of taking the retention unit 22 as a reference, when the mouthpiece 23 is rotated in the rotation direction M1 with respect to the retention unit 22, the retention unit 22 and the mouthpiece 23 are connected. When the mouthpiece 23 is rotated in the rotation direction M2 with respect to the retention unit 22, the connection of the retention unit 22 and the mouthpiece 23 is released.

As shown in FIG. 11, the second rotation connection portion 302 has a male screw portion 160*a* disposed in the mouthpiece 23 and a female screw portion 123*a* disposed in the retention unit 22. More specifically, the second rotation connection portion 302 is configured to connect the retention unit 22 and the mouthpiece 23 by rotating the male screw portion 160*a* disposed in the mouthpiece 23 in the rotation direction M1 with respect to the female screw portion 123*a* disposed in the retention unit 22. The second rotation connection portion 302 is configured to release the connection of the retention unit 22 and the mouthpiece 23 by rotating the male screw portion 160*a* disposed in the mouthpiece 23 with respect to the female screw portion 123*a* disposed in the retention unit 22.

As shown in FIG. 18, the rotation direction M1 is a connection direction of the retention unit 22 with respect to the power unit 21 and also a connection direction of the mouthpiece 23 with respect to the retention unit 22. The rotation direction M2 is a connection releasing direction of the retention unit 22 with respect to the power unit 21 and also a connection cancelling direction of the mouthpiece 23 with respect to the retention unit 22. In this manner, the rotation directions for the connection and releasing the connection around the axis O in the first rotation connection portion 301 and the second rotation connection portion 302 are the same as each other. Accordingly, it is possible to provide a unified sense of the assembly operation to the user and improve the convenience (usability).

For a replacement of the cartridge 11 or the like, a frequency of releasing the connection of the mouthpiece 23 and the retention unit 22 is higher than a frequency of releasing the connection of the power unit 21 and the retention unit 22. According to the present embodiment, the connection of the power unit 21 and the retention unit 22 is released by applying a first torque 301T around the axis O in the first rotation connection portion 301, and the connection of the retention unit 22 and the mouthpiece 23 is released by applying a second torque 302T that is smaller than the first torque 301T. Accordingly, it is possible to prevent co-rotation of the retention unit 22 and the power unit 21 at the time of detaching the mouthpiece 23 from the retention unit 22.

The first torque 301T is a peak value of a torque value when the retention unit 22 is rotated in the rotation direction M2 with respect to the power unit 21, and the first torque 301T depends on a spring modulus or the like corresponding to the elastically deformation in the radial direction of the bending portion 106 as shown in FIG. 9 and FIG. 10. The second torque 302T is a peak value of a torque value when the mouthpiece 23 is rotated in the rotation direction M2 with respect to the retention unit 22, and the second torque 302T depends on a static friction force or the like between the male screw portion 160*a* and the female screw portion 123*a* as shown in FIG. 11. It is preferable that the first torque 301T is 1.5 times larger than the second torque 302T, for example.

The first rotation connection portion 301 and the second rotation connection portion 302 are different in connection structure such that it is easy to adjust a magnitude relationship between the first torque 301T and the second torque 302T. For example, if a material selection and a thickness adjustment of the bending portion 106 (annular piece 82) configuring the lock mechanism 311 of the first rotation connection portion 301 is performed, the spring modulus of the bending portion 106 corresponding to the elastically deformation in the radial direction is changed and it is easy to adjust the magnitude of the first torque 301T with respect to the second torque 302T.

Figure 19:
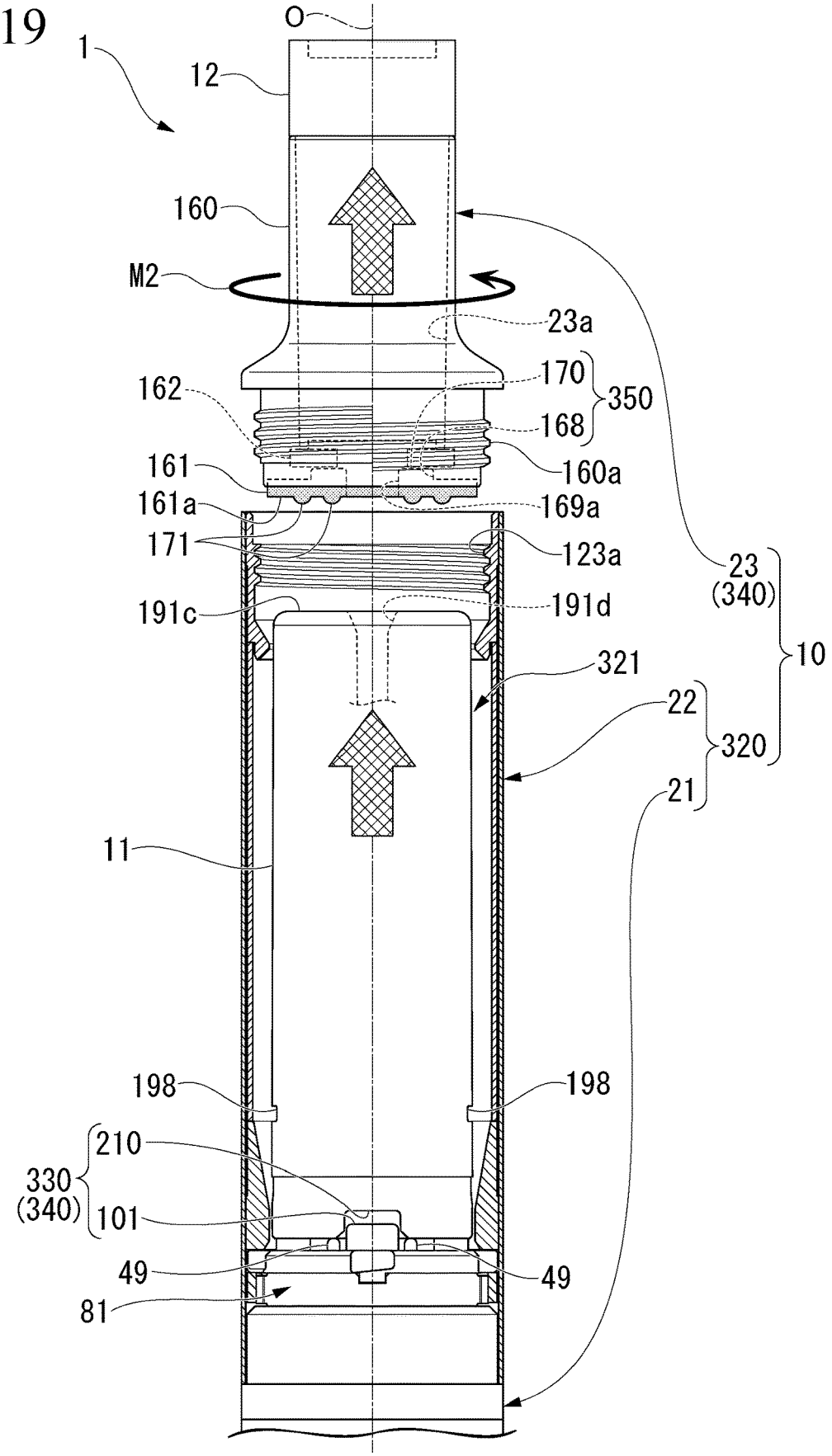
FIG. 19 is a cross-sectional view along the axial direction when the mouthpiece is detached from the suction device.

FIG. 19 is a cross-sectional view along the axial direction when the mouthpiece 23 is removed from the suction device 1.

As shown in FIG. 19, in the suction device 1, the cartridge 11 is attachable and detachable in the axial direction by removing the mouthpiece 23 from the main body unit 10. A configuration for removing the mouthpiece 23 from the main body unit 10 is referred to as a cartridge accommodation portion 320. In other words, the cartridge accommodation portion 320 has the retention unit 22 and the power unit 21.

The cartridge accommodation portion 320 forms a cartridge accommodation space 321 in a bottomed cylindrical shape. A circumferential wall of the cartridge accommodation portion 320 forming the cartridge accommodation space 321 is formed by the retention unit 22. A bottom portion of the cartridge accommodation portion 320 forming the cartridge accommodation space 321 is formed by the power unit 21. In other words, the circumferential wall (retention unit 22) of the cartridge accommodation portion 320 is attachable to and detachable from the bottom portion (power unit 21) of the cartridge accommodation portion 320.

The vertical engagement convex portion 101 (the vertical engagement convex portion 101*a*-101*c* are designated to the reference sign 101 after FIG. 19) disposed in the first connection member 81 is formed to stand in the axial direction in the bottom portion of the cartridge accommodation portion 320. The vertical engagement convex portion 101 is disposed to be insertable into the engagement concave portion 210 disposed in the cartridge 11 in the axial direction. In other words, the vertical engagement convex portion 101 and the engagement concave portion 210 are disposed on the same radius with the axis O as a center. The vertical engagement convex portion 101 and the engagement concave portion 210 form a first rotation restriction portion 330 for restricting a relative rotation of the cartridge 11 around the axis O with respect to the cartridge accommodation portion 320 (cartridge accommodation space 321).

In the first rotation restriction portion 330, when the cartridge 11 and the cartridge accommodation portion 320 are relatively rotated around the axis O, the vertical engagement convex portion 101 is inserted into the engagement concave portion 210 disposed on the same radius and the restriction for the rotation of the cartridge 11 around the axis O is performed. Accordingly, position alignment of the cartridge 11 in the circumferential direction is performed, and electrical conduction of the connection electrodes 213*b*, 214*b* (see FIG. 10) of the bottom portion 196*e* of the cartridge 11 and the pin electrode 49 of the power unit 21 is secured.

The first rotation restriction portion 330 together with the mouthpiece 23 configure a position-alignment mechanism 340 for aligning positions of the cartridge 11 with respect to the cartridge accommodation portion 320 by interlocking with screwing of the mouthpiece 23 with respect to the cartridge accommodation portion 320 (retention unit 22). According to the position-alignment mechanism 340, the position alignment of the cartridge 11 may be performed simultaneously with screwing the mouthpiece 23 to the cartridge accommodation portion 320. Accordingly, the position alignment of the cartridge 11 attachable to and detachable from the cartridge accommodation portion 320 becomes easy and complicatedness of the assembling is eliminated. There is not necessity to rotate the cartridge 11 directly by hands.

More specifically, the mouthpiece 23 has the first slip prevention member (cartridge contact portion) 161 for rotating the cartridge 11 around the axis O with respect to the cartridge accommodation portion 320. The first slip prevention member 161 is attached to the mouthpiece main body 160, and the first slip prevention member 161 comes in contact with the cartridge 11 during a period when the mouthpiece main body 160 is connected to the retention unit 22. When the first slip prevention member 161 comes in contact with the cartridge 11, the cartridge 11 begins to rotate with the mouthpiece 23 together, and when a positon of the engagement concave portion 210 in the circumferential direction and a position of the vertical engagement convex portion 101 in the circumferential direction are coincided with each other, the cartridge 11 falls off toward the bottom portion side of the cartridge accommodation portion 320 due to gravity and the vertical engagement convex portion 101 is inserted into the engagement concave portion 210 so as to perform a positioning of the cartridge 11 in the circumferential direction.

When the mouthpiece 23 is screwed, the first slip prevention member 161 is compressed in the axial direction between the cartridge 11 supported by the power unit 21 (the vertical engagement convex portion 101 and the like) and the mouthpiece main body 160. As shown in FIG. 11, the first slip prevention member 161 presses the cartridge 11 toward the power unit 21 in a state in which the mouthpiece 23 is screwed with the retention unit 22. Accordingly, a positioning of the cartridge 11 in the axial direction is performed.

As described above, the first slip prevention member 161 is formed from the silicone resin such that it is easy to cause the friction force for rotating the cartridge 11 in the circumferential direction and a pressing force for pressing the cartridge 11 in the axial direction to be realized. As shown in FIG. 19, the first slip prevention member 161 has the engagement protrusion 171 formed on an opposite surface 161*a* being opposite to the cartridge 11. According to the engagement protrusion 171, a contact of the first slip prevention member 161 with respect to the cartridge 11 is not a plane contact such that a contact pressure increases and it becomes easy to realize the friction force in the circumferential direction and the pressing force in the axial direction.

As shown in FIG. 11, the engagement protrusion 171 is pressed and crushed in the axial direction such that the penetration hole 191*d* of the cartridge 11 and the communication hole 169*a* of the first slip prevention member 161 are airtightly sealed with each other, the flow passages of the cartridge 11 and the mouthpiece 23 are communicated, and the aerosol generated in the cartridge 11 is capable of being suctioned through the mouthpiece 23. The engagement protrusion 171 is formed in a double annular shape (see FIG. 12) such that a double seal having a high airtightness may be formed.

As shown in FIG. 19, the mouthpiece 23 has a second rotation restriction portion 350 for restricting a relative rotation of the first slip prevention member 161 with respect to the mouthpiece main body 160. The second rotation restriction portion 350 is formed by the fitting protrusion 170 (see FIG. 12) disposed in the first slip prevention member 161 and the oval-shaped penetration hole 168 (see FIG. 12) disposed in the mouthpiece main body 160. A pair of the fitting protrusions 170 extend toward the mouthpiece main body 160 in the axial direction and fit with two end portions in the longitudinal direction of the penetration hole 168.

According to the second rotation restriction portion 350, even if condensed aerosol is stored in a space between the mouthpiece main body 160 and the first slip prevention member 161, idling operation (slip) of the first slip prevention member 161 with respect to the mouthpiece main body 160 may be prevented. Accordingly, a positioning of the cartridge 11 in the circumferential direction may be performed. The penetration hole 168 may be formed in the oval shape to be integrally formed with the suction port 23*a*.

(Assembly Method of the Suction Device)

Next, an assembly method of the suction device 1 will be described.

As shown in FIG. 2, in order to assemble the suction device 1 according to the present embodiment, the retention unit 22 is assembled to the power unit 21 at first. More specifically, after inserting the horizontal engagement convex portion 102 into the engagement groove 158 in the axial direction, the power unit 21 and the retention unit 22 are relatively rotated around the axis O. Therefore, the power unit 21 and the retention unit 22 are assembled with each other in the first rotation connection portion 301 in a state in which position alignments in the axial direction and the circumferential direction are performed. At the time of detaching the power unit 21 and the retention unit 22, operations reverse to the above-described operations are performed.

Subsequently, the cartridge 11 is inserted into the retention unit 22. More specifically, the cartridge 11 is inserted into the retention unit 22 in a state in which the connection electrodes 213*b*, 214*b* of the cartridge 11 are directed to the retention unit 22 side in the axial direction. In a case in which the positions of the vertical engagement convex portions 101*a*-101*c* of the power unit 21 and the position of the engagement concave portion 210 of the cartridge 11 are coincided with each other in the circumferential direction, each of the vertical engagement convex portions 101*a*-101*c* is inserted into the corresponding engagement concave portion 210. In the engagement concave portion 210, the flattening portion 210*a* is formed and on the other hand, inclined surfaces are formed at tip end of the vertical engagement convex portions 101*a*-101*c*. Accordingly, the vertical engagement convex portions 101*a*-101*c* are smoothly inserted into the engagement concave portion 210. Accordingly, position alignments of the cartridge 11 with respect to the power unit 21 in the circumferential direction and the axial direction are performed and the cartridge 11 is assembled with the power unit 21 at a regular position.

In other words, one pin electrode 49 of the pin electrodes 49 of the power unit 21 and either connection electrode 213*b* or 214*b* of the connection electrodes 213*b*, 214*b* in the cartridge 11 are connected with each other. The other pin electrode 49 and the other connection electrode 213*b* or 214*b* of the connection electrodes 213*b*, 214*b* in the cartridge 11 are connected with each other. The power of the power unit 21 is transmittable to the electrical heating wire 205 of the heater 194 via the connection electrodes 213*b*, 214*b* (electrodes 213, 214). The buffer space S3 is formed by the cartridge 11 and the connection cap 80 by engaging the bottom portion 196*e* of the cartridge 11 with the surrounding convex portion 93.

Subsequently, the mouthpiece 23 is assembled with the retention unit 22 by the second rotation connection portion 302. More specifically, the male screw portion 160*a* of the mouthpiece main body 160 is screwed to the female screw portion 123*a* of the sleeve 123. Therefore, the first slip prevention member 161 comes in contact with the bottom portion 191*c* of the cartridge 11. When the mouthpiece 23 is further tightened in this state, the first slip prevention member 161 is elastically deformed such that the cartridge 11 is held in the retaining in the retention unit 22 in a state in which the cartridge 11 is pressed toward the power unit 21 side in the axial direction. A movement of the cartridge 11 with respect to the power unit 21 in the circumferential direction is restricted by the vertical engagement convex portions 101*a*-101*c*. Accordingly, the cartridge 11 is configured to not to rotate following the mouthpiece 23 due to the friction force applied between the first slip prevention member 161 and the cartridge 11.

Subsequently, the tobacco capsule 12 is inserted into the mouthpiece 23. More specifically, the tobacco capsule 12 is fitted into the mouthpiece main body 160 in a state of directing the mesh opening toward the mouthpiece 23.

Therefore, the assembly of the suction device 1 is finished.

However, during the insertion of the cartridge 11, there is a case in which the positions of the vertical engagement convex portions 101*a*-101*c* of the power unit 21 and the position of the engagement concave portion 210 of the cartridge 11 are not coincided in the circumferential direction due to an orientation of the cartridge in the circumferential direction. In this case, the bottom portion 196*e* of the cartridge 11 enters a state of climbing on the vertical engagement convex portions 101*a*-101*c* (hereinafter simply referred to as a "climb-on state").

Figure 20:
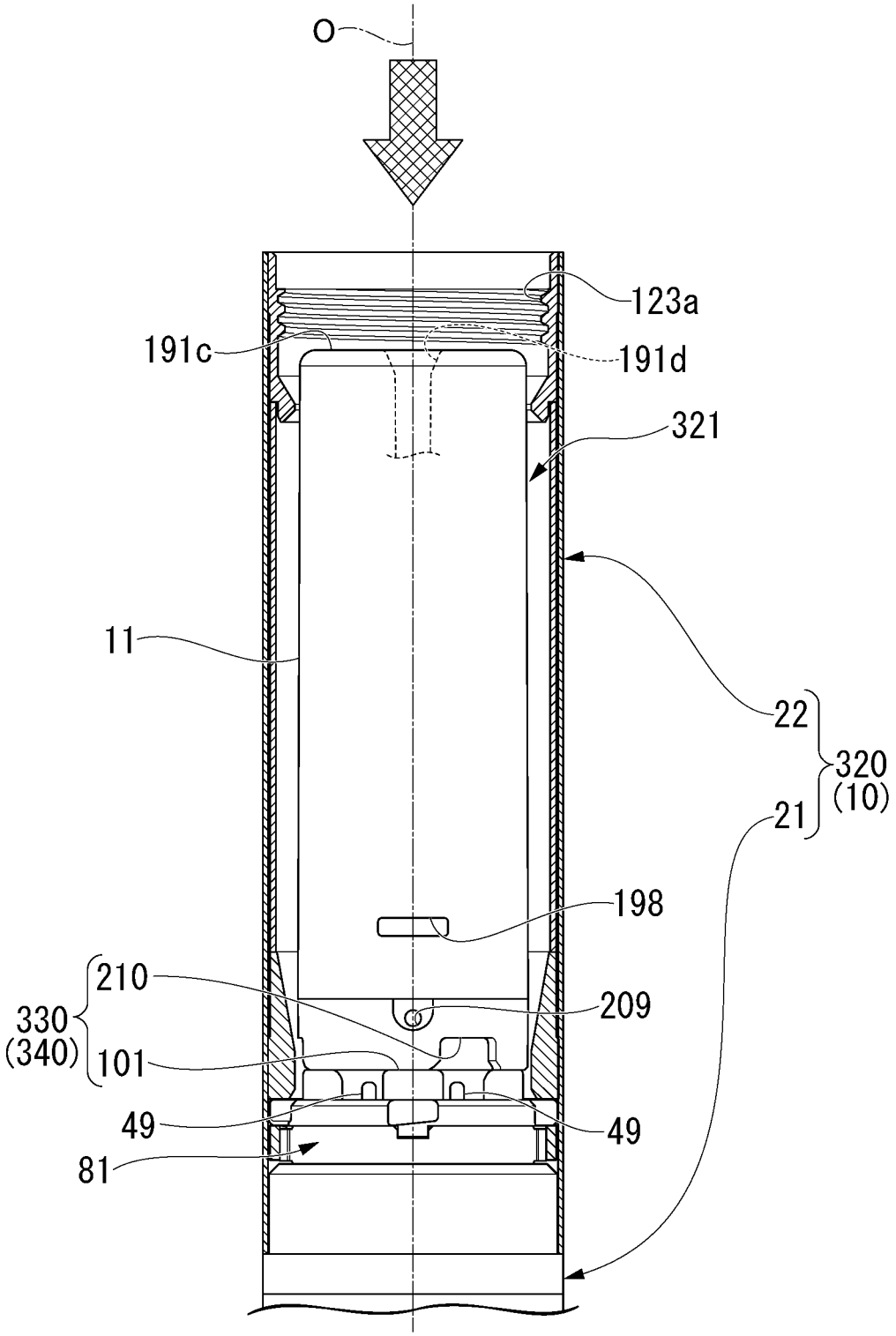
FIG. 20 is a descriptive view showing a state when the cartridge climbs on a vertical engagement convex portion.

FIG. 20 is a view showing the state in which the cartridge 11 climbs on the vertical engagement convex portion 101.

As shown in FIG. 20, in the climb-on state of the cartridge 11, movement of the cartridge 11 toward the power unit 21 side in the axial direction with respect to the power unit 21 is restricted. Accordingly, the pin electrodes 49 and the connection electrodes 213*b*, 214*b* are separated in the axial direction, and a conduction of the power unit 21 and the cartridge 11 is not secured. In the climb-on state, even in a case in which the pin electrodes 49 and the connection electrodes 213*b*, 214*b* are in contact, there is a possibility that the pin electrodes 49 and the connection electrodes 213*b*, 214*b* are not disposed in desired positions in the circumferential direction.

Figure 21:
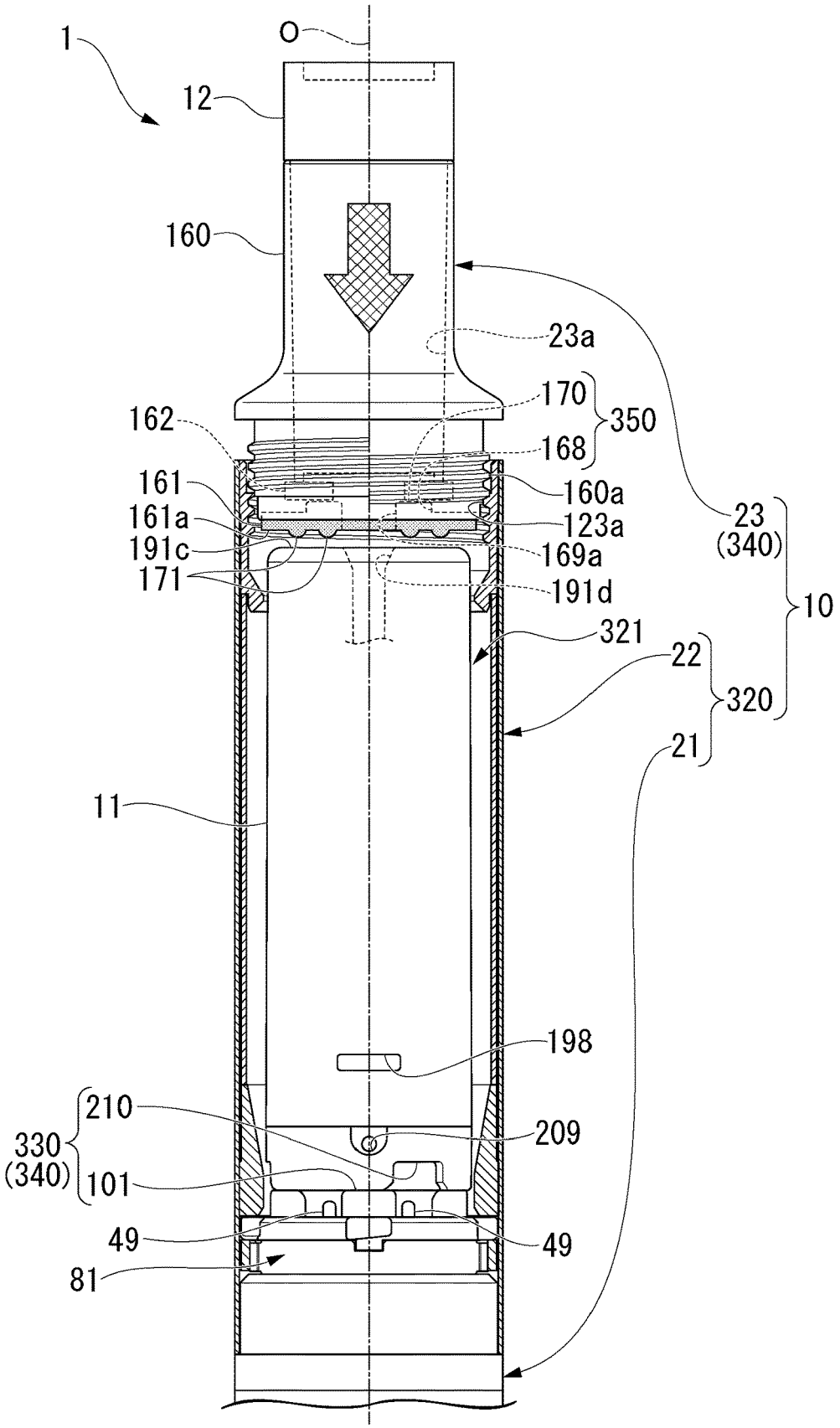
FIG. 21 is a descriptive view showing a state of screwing the mouthpiece during the climb-on state of the cartridge.

FIG. 21 is a view showing a state of screwing the mouthpiece 23 in the climb-on state of the cartridge 11.

Figure 22:
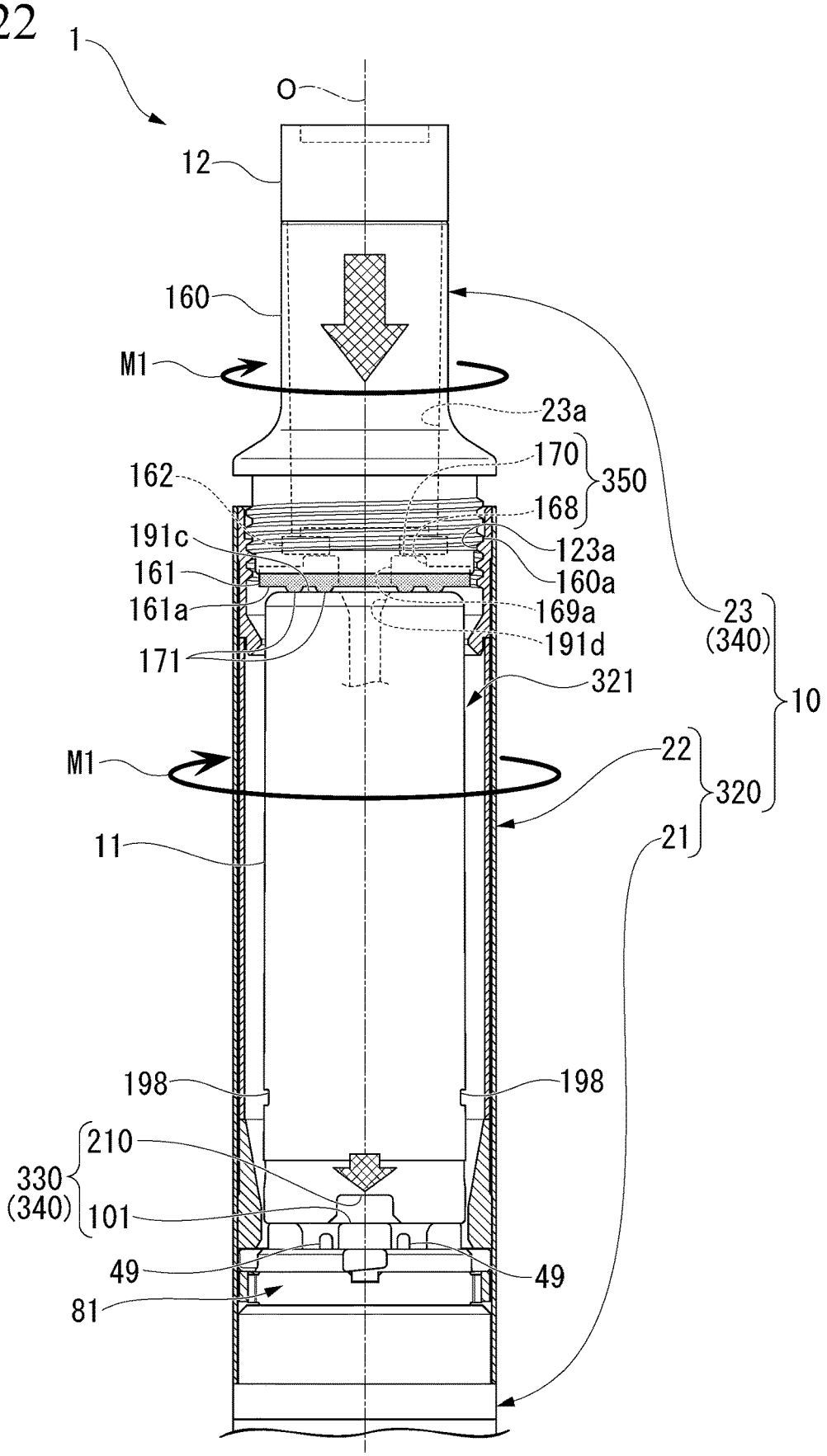
FIG. 22 is a descriptive view showing a state when the mouthpiece and the cartridge are rotated together.

As shown in FIG. 21, when the cartridge 11 is kept in the climb-on state and the mouthpiece 23 is rotated to be screwed with the retention unit 22, as shown in following FIG. 22, the first slip prevention member 161 comes in contact with the cartridge 11 at least before the screwing is finished. More specifically, as shown in FIG. 21, at a moment when the male screw portion 160*a* of the mouthpiece 23 is about to engage with the female screw portion 123*a* of the retention unit 22, the first slip prevention member is not in contact with the cartridge 11; however, as shown in FIG. 22, when the male screw portion 160*a* is screwed with the female screw portion 123*a* and rotated by a half-rotation or 1, 2 rotations, the first slip prevention member 161 is in contact with the cartridge 11.

FIG. 22 is a view showing a state in which the mouthpiece 23 and the cartridge 11 are rotated together.

As shown in FIG. 22, in the state in which the first slip prevention member 161 is in contact with the cartridge 11, if the screwing operation of the mouthpiece 23 is continued, the mouthpiece 23 and the cartridge 11 are rotated together due to the friction force applied between the first slip prevention member 161 and the cartridge 11. In other words, due to the screwing operation of the mouthpiece 23, the cartridge 11 is pressed toward the power unit 21 side in the axial direction and rotated in the circumferential direction (tightening direction (rotation direction M1)).

Subsequently, when the positions of the connection electrodes 213*b*, 214*b* in the circumferential direction and the positions of the vertical engagement convex portions 101*a*-101*c* in the circumferential direction are coincided with each other, the vertical engagement convex portions 101*a*-101*c* enter the corresponding engagement concave portions 210 respectively. In other words, the cartridge 11 is assembled at the regular position by allowing the movement of the cartridge 11 in the axial direction with respect to the power unit 21. Accordingly, the pin electrodes 49 and the connection electrodes 213*b*, 214*b* are in contact in a state in which the movement of the cartridge 11 in the axial direction with respect to the power unit 21 is restricted.

Figure 23:
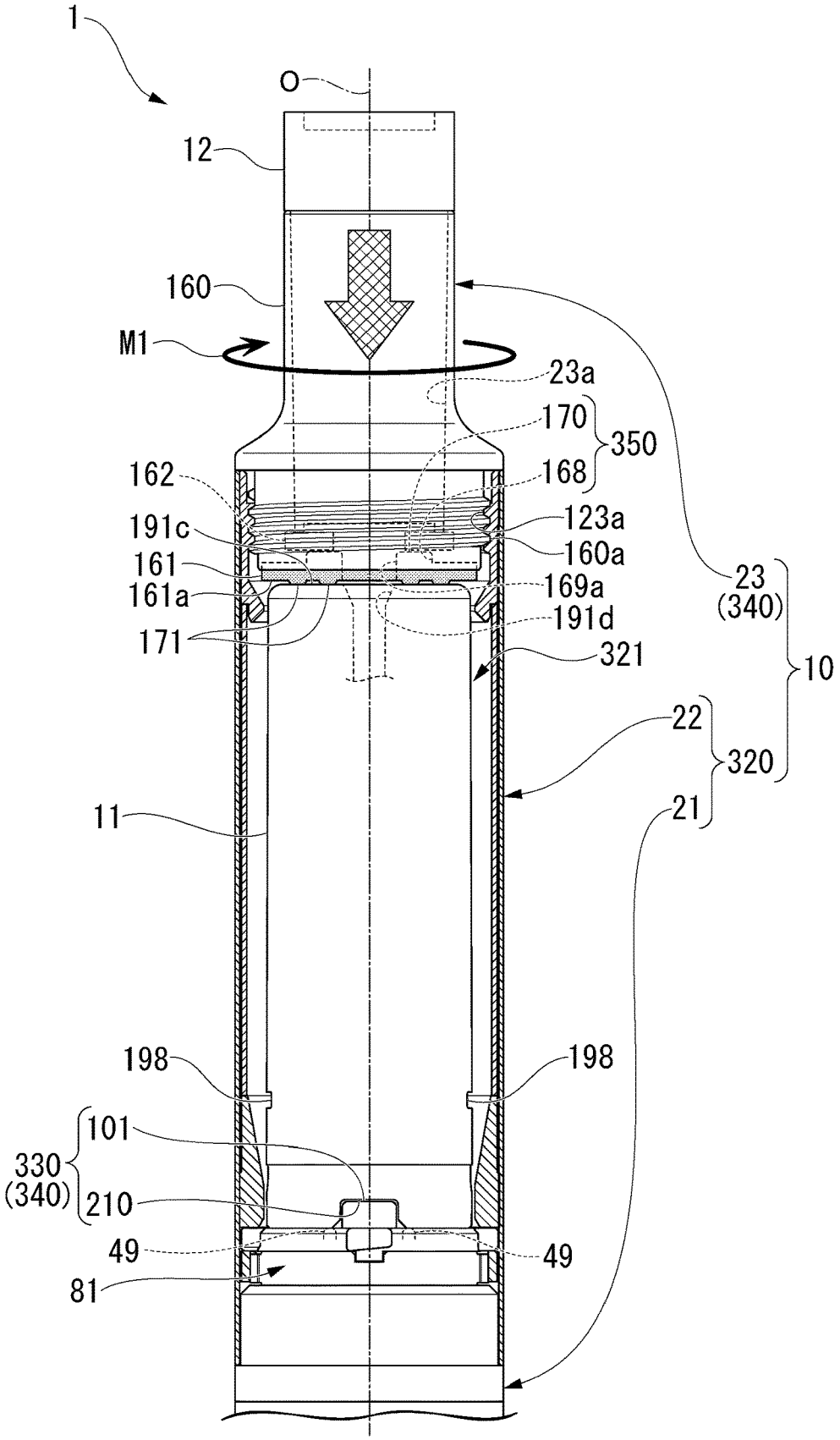
FIG. 23 is a descriptive view showing a state when the mouthpiece is finally tightened.

FIG. 23 is a descriptive view showing the state in which the mouthpiece 23 is finally tightened.

As shown in FIG. 23, due to the position alignment of the vertical engagement convex portion 101 and the engagement concave portion 210 in the circumferential direction, when the movement of the cartridge 11 in the axial direction is allowed, the mouthpiece 23 may be further screwed. When the mouthpiece 23 is finally screwed, the connection electrodes 213*b*, 214*b* are pressed by the pin electrodes 49 and the first slip prevention member 161 between the cartridge 11 supported by the power unit 21 and the mouthpiece main body 160 is compressed in the axial direction that the positioning of the cartridge 11 in the axial direction is performed. In this manner, the positioning of the cartridge 11 in the circumferential direction and the axial direction and further the electrically conduction of the cartridge 11 and the power unit 21 are performed by the screwing of the mouthpiece 23. Additionally, a gap between the cartridge 11 and the mouthpiece 23 is sealed by the engagement protrusion 171 of the first slip prevention member 161 being compressed in the axial direction.

In this manner, when the cartridge 11 is assembled in the regular position, the surrounding convex portion 93 of the connection cap 80 comes in contact with the cartridge 11. Accordingly, the buffer space S3 (see FIG. 3) whose circumference is surrounded by the surrounding convex portion 93 is formed between the bottom portion 196*e* of the heater holder 196 of the cartridge 11 and the connection cap 80.

(Assembly Method of Cartridge)

Next, an assembly method of the cartridge 11 will be described.

Firstly, the liquid aerosol source is filled in the liquid storage room 202 of the tank 191, and then the gasket 192 and the liquid retention body 193 are inserted from the opening portion 191*a* of the tank 191 in this sequence. At this time, the surface 192*b* of the gasket 192 is in contact with the end surface 201*a* of the convex portion 201 of the tank 191. The suction-port-side surface 193*b* of the liquid retention body 193 is caused to overlap the other surface 192*d* of the gasket 192. Accordingly, the inside of the tank 191 is correctly partitioned into the liquid storage room 202 and the opening room 203 by the liquid retention body 193. The liquid retention body 193 itself is soft; however, the orientation the liquid retention body 193 is maintained by the gasket 192 and the poisoning thereof is performed by the gasket 192.

The heater 194 and the atomization container 195 are assembled to the heater holder 196 parallelly to the above-described process. More specifically, firstly, the heater 194 is assembled to the accommodation concave portion 220 of the atomization container 195. Subsequently, the fitting portion 218 side of the atomization container 195 is directed to the opening portion 196*a* of the heater holder 196 and the atomization container 195 is inserted into the heater holder 196. The fitting portion 218 is fitted to the internal circumferential surface of the circumferential wall 196*b* in the heater holder 196. At this time, directions of the connection wall of the heater holder 196 and the slit 225 of the fitting portion 218 are aligned and the connection wall 211 is inserted into the slit 225.

Subsequently, the heater holder 196 is assembled to the opening portion 191*a* of the tank 191. More specifically, the engagement piece 206 side of the heater holder 196 is directed to face the opening portion 191*a* side of the tank 191 and the heater holder 196 is inserted into the opening portion 191*a* of the tank 191. At this time, positions of the engagement hole 198 and the guide concave portion 198*a* formed in the circumferential wall 191*b* of the tank 191 and a position of the engagement piece 206 of the heater holder 196 are aligned.

When the heater holder 196 is inserted into the opening portion 191*a* of the tank 191 in this state, firstly, the inclined surface 207*a* formed in the engagement claw 207 of the engagement piece 206 comes in contact with the circumferential wall 191*b* of the tank 191. The engagement claw 207 smoothly comes in contact with the guide concave portion 198*a* of the tank 191 by the inclined surface 207*a*.

Thereafter, when the heater holder 196 is further pushed into the inside of the tank 191, the engagement claw 207 is carried in the guide concave portion 198*a*. The engagement piece 206 is pressed to be elastically deformed inwardly in the radial direction by the guide concave portion 198*a*. At this time, the engagement piece 206 is smoothly elastically deformed inwardly in the radial direction by the inclined surface 207*a* of the engagement claw 207. The two engagement pieces 206 are disposed at two sides of the axis Q to sandwich the axis Q and face each other such that it is difficult for forces applied inwardly in the radial direction to the two engagement pieces 206 to be biased when the heater holder 196 is viewed as a whole. At this time, the forces causing the engagement pieces 206 to be elastically deformed are balanced such that it is easy for the heater holder 196 to be inserted into the opening portion 191*a* of the tank 191. The bottom surface 224*a* of the concave portion 224 of the atomization container 195 is in contact with the internal surface at the internal side of the engagement piece 206 in the radial direction. Accordingly, when the engagement piece 206 is elastically deformed inwardly in the radial direction, the concave portion 224 of the atomization container 195 is slightly deformed inwardly in the radial direction.

Thereafter, when the heater holder 196 is further pushed, the engagement claw 207 moves along the guide concave portion 198*a*. Then, the engagement claw 207 climbs on a terminal end of the guide concave portion 198*a* (end portion at the engagement hole 198 side of the tank 191), and further the engagement claw 207 is inserted into the engagement hole 198 of the tank 191 by a restoring force of the engagement piece 206 and a restoring force of the concave portion 224 of the atomization container 195. Accordingly, the heater holder 196 is fixed to the tank 191 and the assembly of the cartridge 11 is finished.

In a state in which the heater holder 196 is fixed to the tank 191, a surface at the external side in the radial direction of the engagement piece 206 is covered by the circumferential wall 191*b* of the tank 191. When the engagement of either of the two engagement claws 207 is about to be released, for example, when the tank 191 or the heater holder 196 is about to be tilted so as to cause one of the engagement claw 207 to be removed from the engagement hole 198, the other engagement claw 207 is pressed outwardly in the radial direction. Accordingly, once the engagement hole 198 and the engagement piece 206 are engaged with each other, it is difficult to release the engagement.

(Usage Method of Suction Device)

When the suction device 1 is used, the user operates to press the button 78. At this time, for example, by pressing the button 78 for several times (for example, five times), a start-up preparation signal is output from the switch element 52 to a controller included in the first substrate module 34.

Subsequently, the user suctions in a state of biting the mouthpiece 23 or the tobacco capsule 12. Therefore, the air in the retention unit 22 is suctioned and tie pressure inside the retention unit 22 becomes negative. When the pressure inside the retention unit 22 becomes negative, the air in the pressure change room S1 is suctioned through the inside of the atomization container 195 (inside the atomization room M) of the cartridge 11, the buffer space S3, and the communication port 51 such that it also becomes the negative pressure inside the pressure change room S1. More specifically, the air in the pressure change room S1 flows into the buffer space S3 through the communication port 51 and then flows into the heater holder 196 through the second air-suction hole 216. The air flowing into the heater holder 196 passes through the flow passage tube 197 through the ventilation passage 226 and the atomization container 195 and then enters the mouth of the user through the mouthpiece 23. The pressure sensor 53 outputs a start-up signal to the controller when the pressure sensor 53 detects that the pressure inside the pressure change room S1 is less than a predetermined value, for example.

The controller receiving the start-up signal causes the heater 194 of the cartridge to be electrified. Since it becomes the negative pressure inside the retention unit 22, fresh air is introduced in the retention unit 22 through the ventilation hole 131. The fresh air is introduced into the atomization room M of the cartridge 11 (the opening room 203 of the tank 191) through the first air-suction hole 209 formed in the heater holder 196 of the cartridge 11 and the ventilation passage 226 of the atomization container 195.

The electrical heating wire 205 generates heat when the heater 194 is electrified. Therefore, the liquid aerosol source impregnating the wick 204 through the liquid retention body 193 is heated and atomized. The atomized aerosol fills the atomization room M. Then, the atomized aerosol together with the fresh air introduced into the atomization room M is suctioned to the mouthpiece 23 side through the flow passage tube 197 of the tank 191. Thereafter, a gaseous mixture of the atomized aerosol and air enters the mouth of the user through the tobacco capsule 12. Accordingly, the user may taste a flavor of the tobacco.

In the cartridge 11, the suction-port-side surface 193*b* of the liquid retention body 193 is in contact with the liquid storage room 202 of the tank 191 through the opening portion 192*c* of the gasket 192. Accordingly, the liquid aerosol source stored in the liquid storage room 202 of the tank 191 is absorbed by the liquid retention body 193 and further absorbed by the wick 204. When the liquid retention body 193 and the wick 204 is saturated (exceeding a liquid retention force), there is a tendency that the liquid aerosol source preferentially leaks out to the heater holder 196 side from an interval between the external circumferential portion of the liquid retention body 193 and the internal circumferential surface of the circumferential wall 191*b* in the tank 191 and through the internal circumferential surface.

The liquid accumulation portion 223 is formed on the external circumferential surface of the atomization container 195 positioned at the heater holder 196 side of the liquid retention body 193. The liquid accumulation portion 223 (the narrow portion 279) is in contact with the opposite-suction-port-side surface 193*c* of the liquid retention body 193. The narrow portion 279 (the liquid accumulation portion 223) is disposed at the position overlapping the external circumferential surface of the liquid retention body 193 and the region of the internal circumferential surface of the tank 191 when viewed from the axial direction (viewing the opposite-suction-port side from the mouthpiece 23). Accordingly, the liquid aerosol source is smoothly introduced to the liquid accumulation portion 223 and stored in the liquid accumulation portion 223 and leakage to the heater holder 196 side (the side where the heater 194 is disposed) is prevented.

More specifically, according to the present embodiment, a volume (space volume) of the liquid accumulation portion 223 is approximately 53.4 cubic millimeters. In a case of assuming that a residual liquid quantity in the liquid storage room 202 of the tank 191 is ⅓ and a headspace volume expansion coefficient (a volume expansion coefficient of the air in the residual ⅔ space in the liquid storage room 202) is 6%, there is approximately 100 cubic millimeters of the liquid aerosol source being extruded from the liquid storage room 202 due to the air expansion in the liquid storage room 202 of the tank 191. Among the extruded liquid aerosol source, there is approximately 20-30 cubic millimeters of the liquid aerosol source may be retained by the liquid retention body 193 and the wick 204. Among the approximately 100 cubic millimeters of the liquid aerosol source, the remaining 70-80 cubic millimeters of the liquid aerosol source is accumulated in the accumulation portion 223.

The first contact portion 193*d* and the second contact portion 193*e* of the liquid retention body 193 are not overlapped with each other viewed from the axial direction such that the first contact portion 193*d* and the second contact portion 193*e* are separated from each other as much as possible. Accordingly, it is impossible that the liquid aerosol source is introduced to the liquid accumulation portion 223 without being sufficiently absorbed by the liquid retention body 193. In other words, the liquid aerosol source is sufficiently retained by the liquid retention body 193 and then the liquid aerosol source is introduced to the liquid accumulation portion 223.

The liquid accumulation portion 223 is formed that the gap between the external circumferential surface of the cylinder portion 217 and the circumferential wall 191*b* of the tank 191 gradually becomes narrower towards the tip end of the protrusion portion 219 from the seal portion 222. In other words, in the vicinity of the protrusion portion 219 of the cylinder portion 217, the narrow portion 279 where the gap between the protrusion portion 219 and the circumferential wall 191*b* of the tank 191 becomes narrow is formed. Accordingly, among the liquid aerosol source extruded from the liquid storage room 202 of the tank 191, it is easy for the residual aerosol source after the liquid retention body 193 and the wick 204 are saturated to be suctioned due to the narrow portion 279 and the residual aerosol source actively flows to the liquid accumulation portion 223 through the narrow portion 279.

In other words, the liquid aerosol source stored in the liquid storage room 202 of the tank 191 is firstly absorbed by the liquid retention body 193 and then absorbed by the wick 204. After the liquid retention body 193 and the wick 204 are saturated, the liquid aerosol source is suctioned by the narrow portion 279 and accumulated in the liquid accumulation portion 223.

On the other hand, when the saturation state of the liquid retention body 193 is resolved, the liquid aerosol source stored in the liquid accumulation portion 223 is suctioned through the narrow portion 279 (the interval between the protrusion portion 219 and the circumferential wall 191*b* of the tank 191). Then, the liquid aerosol source is absorbed by the liquid retention body 193. In other words, the liquid aerosol source stored in the liquid accumulation portion 223 flows back to the liquid storage room 202 of the tank 191 through the narrow portion 279. At this time, since the narrow portion 279 is covered (blocked) by the external circumferential portion of the liquid retention body 193, a capillary force due to the liquid retention body 193 also applies such that the liquid aerosol source efficiently flows back to the liquid storage room 202 of the tank 191.

Since two notch portions 222*a* are formed in the seal portion 222 of the cylinder portion 217, the liquid accumulation portion 223 and the external air are communicated through the notch portions 222*a* of the seal portion 222 and a gap between the engagement hole 198 of the tank 191 and the engagement piece 206 (engagement claw 207) of the heater holder 196. As another example, the liquid accumulation portion 223 and the external air may be communicated through the notch portions 222*a* of the seal portion 222 and the first air-suction hole 209 of the heater holder 196. Accordingly, it is impossible to generate a pressure difference between the inside and outside the liquid accumulation portion 223. As a result, an unintentional leakage of the liquid aerosol source to the outside from the liquid accumulation portion 223 is prevented and the liquid aerosol source efficiently flows back to the liquid storage room 202 of the tank 191.

In this manner, the cartridge 11 according to the present embodiment has the liquid accumulation portion 223 formed on the external circumferential surface of the cylinder portion 217. The liquid accumulation portion 223 and the heater 194 are disposed to be separated from each other via the cylinder portion 217 in the radial direction. Accordingly, when the liquid retention body 193 and the wick 204 are saturated, even if the liquid aerosol source leaks out from the interval between the external circumferential portion of the liquid retention body 193 and the internal circumferential surface of the circumferential wall 191*b* in the tank 191 and through the internal circumferential surface, the liquid aerosol source may be accumulated in the liquid accumulation portion 223. Accordingly, it is possible to prevent the liquid aerosol source from leaking out to the heater holder 196 side (the side where the heater 194 is disposed).

The liquid retention body 193 in in contact with the opening portion 191*a* of the tank 191. Accordingly, the liquid retention body 193 is capable of efficiently retaining the liquid aerosol source stored in the liquid storage room 202 of the tank 191.

The liquid accumulation portion 223 is connected with the tank 191 via the liquid retention body 193. Accordingly, in the case in which the liquid retention body 193 and the wick 204 are saturated, it is possible to introduce and store the liquid aerosol source to the liquid accumulation portion 223. Therefore, the liquid retention body 193 is always capable of retaining enough liquid aerosol source. As a result, it is possible to stabilize an atomization performance of the liquid aerosol source by the heater 194.

The liquid accumulation portion 223 is disposed at the opposite-suction-port side more than the tank 191 (the liquid storage room 202). In other words, the liquid storage room 202 of the tank 191 and the liquid accumulation portion 223 are disposed at the two sides of the liquid retention body 193 to sandwich the liquid retention body 193. Accordingly, in a case in which the liquid aerosol source is retained by the liquid retention body 193, and the liquid retention body 193 and the wick 204 are saturated, the liquid accumulation portion 223 is capable of storing the liquid aerosol source.

The first contact portion 193*d* of the suction-port-side surface 193*b* in the liquid retention body 193 and the tank 191 (liquid storage room 202) and the second contact portion 193*e* of the opposite-suction-port-side surface 193*c* in the liquid retention body 193 and the liquid accumulation portion 223 (narrow portion 279) are disposed to not to overlap each other viewed from the axial direction (viewing the opposite-suction-port side from the mouthpiece 23). Accordingly, the first contact portion 193*d* and the second contact portion 193*e* may be separated as much as possible. As a result, it is possible to prevent the liquid aerosol source stored in the liquid storage room 202 of the tank 191 from being directly introduced to the liquid accumulation portion 223 without being sufficiently absorbed by the liquid retention body 193. In other words, it is possible to cause the liquid aerosol source to be introduced to the liquid accumulation portion 223 after being sufficiently retained in the liquid retention body 193.

The liquid retention body 193 is formed in the substantial disc shape to have the suction-port-side surface 193*b* in contact with the other surface 192*d* of the gasket 192 and toward the mouthpiece 23 side and the opposite-suction-port-side surface 193*c* at the opposite side of the suction-port-side surface 193*b*. The suction-port-side surface 193*b* is in contact with the liquid storage room 202 through the opening portion 192*c* of the gasket 192. The opposite-suction-port-side surface 193*c* is in contact with the narrow portion 279 of the liquid accumulation portion 223. In this manner, the liquid storage room 202 of the tank 191 and the liquid accumulation portion 223 are in contact with the front and rear surfaces (the suction-port-side surface 193*b* and the opposite-suction-port-side surface 193*c*) of the liquid retention body 193 respectively. Accordingly, it is possible to prevent the liquid aerosol source from flowing to the liquid accumulation portion 223 in the state in which the liquid aerosol source is not sufficiently retained by the liquid retention body 193.

However, as described above, when the liquid retention body 193 and the wick 204 are saturated (exceeding the liquid retention force), there is a tendency for the liquid aerosol source to preferentially leak out from the interval between the external circumferential portion of the liquid retention body 193 and the internal circumferential surface of the circumferential wall 191*b* in the tank 191 and through the internal circumferential surface.

In the cartridge 11 according to the present embodiment, the narrow portion 279 (the liquid accumulation portion 223) is disposed at the position overlapping the external circumferential surface of the liquid retention body 193 and the region of the internal circumferential surface of the tank 191 when viewed from the axial direction (viewing the opposite-suction-port side from the mouthpiece 23). Accordingly, the liquid aerosol source leaked from the liquid retention body 193 may be smoothly introduced to the liquid accumulation portion 223 and stored in the liquid accumulation portion 223.

The liquid accumulation portion 223 is a concave portion (space) configured by forming the overall external circumferential surface so as to make the gap between the external circumferential surface of the cylinder portion 217 and the circumferential wall 191*b* of the tank 191 to gradually become narrower towards the tip end of the protrusion portion 219 from the seal portion 222. In other words, the liquid accumulation portion 223 is the concave portion where the gap between the external circumferential surface of the cylinder portion 217 and the circumferential wall 191*b* of the tank 191 gradually becomes wider towards the opening portion 191*a* of the tank 191.

The liquid accumulation portion 223 capable of storing the liquid aerosol source may be formed in such a simple structure. Since the space volume of the liquid accumulation portion 223 gradually becomes larger towards the opening portion 191*a* of the tank 191, it is possible to smoothly introduce the liquid aerosol source to the liquid accumulation portion 223 and sufficiently store the aerosol source.

The narrow portion 279 is formed in the vicinity of the protrusion portion 219 of the cylinder portion 217 as the micro gap between the protrusion portion 219 and the circumferential wall 191*b* of the tank 191. An aperture of the narrow portion 279 is smaller than an aperture of the liquid accumulation portion 223. Accordingly, among the liquid aerosol source extruded from the liquid storage room 202 of the tank 191, it is easy for the residual aerosol source after the liquid retention body 193 and the wick 204 are saturated to be suctioned by the narrow portion 279 and the residual aerosol source may actively flow to the liquid accumulation portion 223 through the narrow portion 279. Accordingly, the liquid leakage to the heater holder 196 side may be effectively prevented.

The narrow portion 279 is covered (blocked) by the external circumferential portion of the liquid retention body 193. Accordingly, the liquid aerosol source stored in the liquid accumulation portion 223 may efficiently flow back to the liquid storage room 202 of the tank 191 using the capillary force of the liquid retention body 193.

The liquid accumulation portion 223 is formed on the whole external circumferential surface of the cylinder portion 217. In other words, the liquid accumulation portion 223 may be formed across the whole circumference of the cylinder portion 217. Accordingly, the volume of the liquid accumulation portion 223 may be set to be as large as possible.

The gasket 192 is configured in the tank 191 and the liquid retention body 193 is disposed on the other surface 192*d* of the gasket 192. According to the gasket 192, the positioning of the soft liquid retention body 193 may be performed and the orientation of the liquid retention body 193 may be retained.

The flow passage tube 197 is configured in the bottom portion 191*e* of the tank 191 to communicate the penetration hole 191*d* formed in the bottom portion 191*c* and the atomization room M. The aerosol atomized in the atomization room M is suctioned to the mouthpiece 23 side through the flow passage tube 197. Even in the case in which the liquid aerosol source is stored inside the heater holder 196, the aerosol of the atomization room M is introduced to the mouthpiece 23 side through the flow passage tube 197 such that it is possible to prevent the user from suctioning the liquid aerosol source through the mouthpiece 23.

The plurality of ribs 199 (three according to the present embodiment) are formed in the tank 191 between the internal circumferential surface of the circumferential wall 191*b* and the external circumferential surface of the flow passage tube 197. Accordingly, the flow passage tube 197 may be supported in the tank 191. The mechanical strength of the tank 191 may be enhanced by the ribs 199.

According to the above-described embodiment, a case in which the liquid accumulation portion 223 is the concave portion configured by obliquely forming the overall external circumferential surface so as to make the gap between the external circumferential surface of the cylinder portion 217 and the circumferential wall 191*b* of the tank 191 to gradually become narrower towards the tip end of the protrusion portion 219 from the seal portion 222 is described; however, the liquid accumulation portion 223 is not limited to the configuration. The liquid accumulation portion 223 only has to be a configuration capable of storing the liquid aerosol source. For example, a configuration may be configured by forming the overall external circumferential surface in a bending manner so as to make the gap between the external circumferential surface of the cylinder portion 217 and the circumferential wall 191*b* of the tank 191 to gradually become narrower towards the tip end of the protrusion portion 219 from the seal portion 222. Simply, the liquid accumulation portion 223 only has to be a concave portion communicating with the narrow portion 279 and the shape is not limited. As shown in each modification example described below, a cylinder portion 217 having the accumulation portion 223 may be provided.

First Modification Example

Next, a first modification example of the above-described embodiment will be described with reference to FIG. 24.

Figure 24:
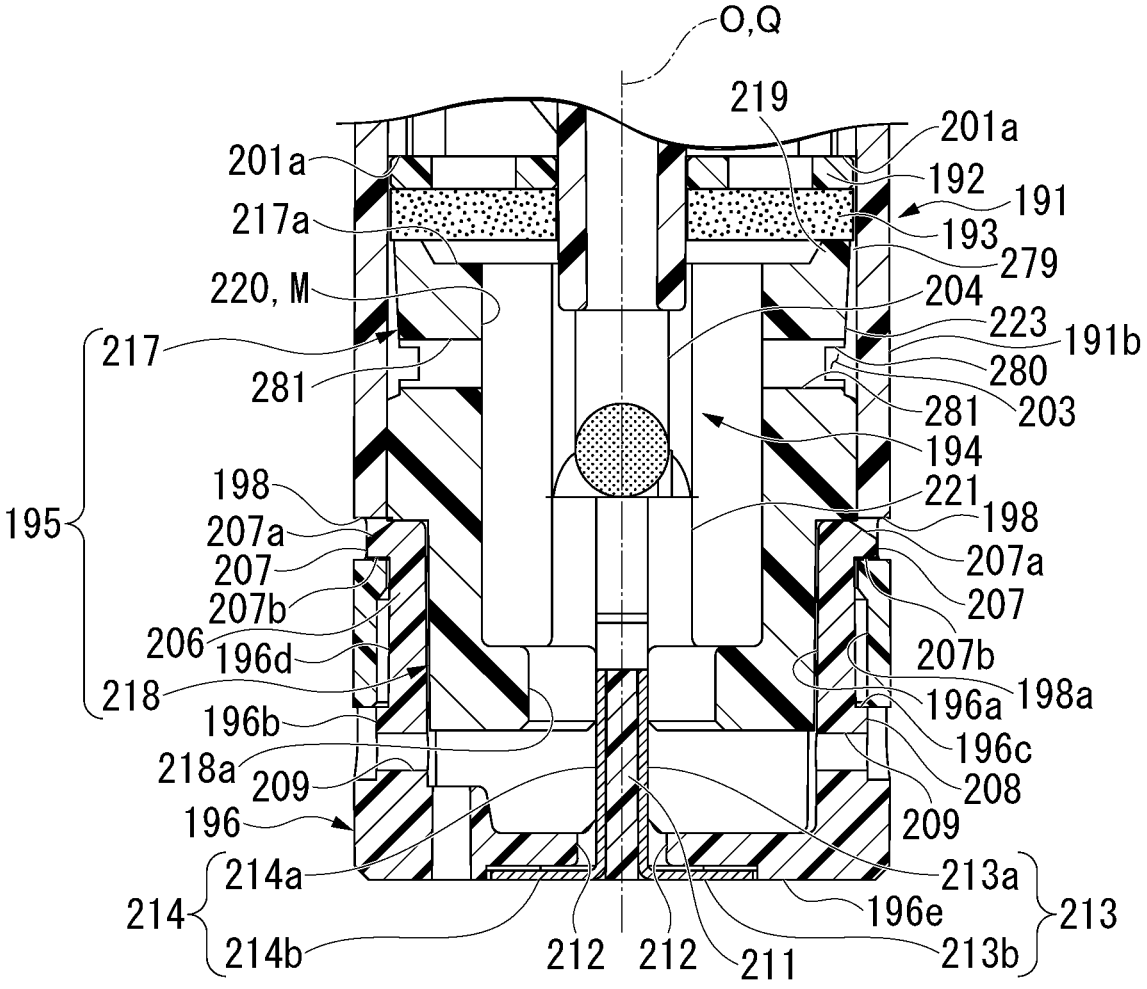
FIG. 24 is an enlarged cross-sectional view showing a portion corresponding to the atomization container of the cartridge according to a first modification example of the present embodiment.

FIG. 24 is an enlarged cross-sectional view in the axial direction showing a portion corresponding to the atomization container 195 of the cartridge 11 according to the first modification example. FIG. 24 corresponds to FIG. 13.

As shown in FIG. 24, the first modification example is different from the embodiment in that a shape of the atomization container 195 is different.

According to the first modification example, a concave portion 280 having a cross section in a substantial rectangle shape is formed across the whole circumference in the liquid accumulation portion 223 in the cylinder portion 217 of the atomization container 195. Two penetration holes 281 are formed in the concave portion 230 so as to allow communication between the inside and outside of the cylinder portion 217, in other words, communicate the liquid accumulation portion 223 and the accommodation concave portion 220 (atomization room M). The seal portion 222 and the notch portion 222*a* (see FIG. 17) are not formed in the atomization container 195.

The two penetration holes 281 are formed along a direction orthogonal to the axis Q. The two penetration holes 281 are formed to be opposite to each other with the axis Q as a center. In this manner, the penetration holes 281 communicate the first air-suction hole 209 of the heater holder 196 and the liquid accumulation portion 223 instead of the notch portion 222*a*. In other words, the first air-suction hole 209 of the heater holder 196 and the liquid accumulation portion 223 are communicated with each other through the penetration holes 281, the accommodation concave portion 220, and the slit 218*a* of the atomization container 195.

A hole diameter of the penetration hole 281 is set to be suitable for a surface tension of the liquid aerosol source to apply. Accordingly, even in a case the liquid aerosol source is stored in the liquid accumulation portion 223, it is impossible that the liquid aerosol source flows out to the accommodation concave portion 220 side through the penetration hole 281.

In this manner, according to the cartridge 11 of the first modification example, the same effect may be achieved with the above-described embodiment. In addition, the volume of the liquid accumulation portion 223 may be increased by forming the concave portion 230 in the cylinder portion 217. Since the penetration holes 281 are formed in the concave portion 280, it is possible to prevent a generation of a pressure difference between the inside and outside the liquid accumulation portion 223 without forming the notch portion 222*a* in the seal portion 222.

According to the first modification example, a case in which the concave portion 230 formed in the cylinder portion 217 has the cross section in the substantial rectangle shape is described. However, it is not limited thereto, the concave portion 230 only has to be formed across the whole circumference of the cylinder portion 217. For example, the concave portion 230 may be formed in a V-groove shape, or the concave portion 230 may be formed to have a cross section in an arc shape.

According to the first modification example, a case in which the penetration holes 281 are formed along the direction orthogonal to the axis Q and formed to be opposite to each other with the axis Q as the center is described. However, it is not limited thereto, the penetration hole 281 only has to communicate the liquid accumulation portion 223 and the accommodation concave portion 220. It is suitable for at least one penetration holes 281 to be formed, and the penetration holes 281 may be formed in a plural number equal to two or more than two.

Second Modification Example

Next, a second modification example of the embodiment will be described with reference to FIG. 25.

Figure 25:
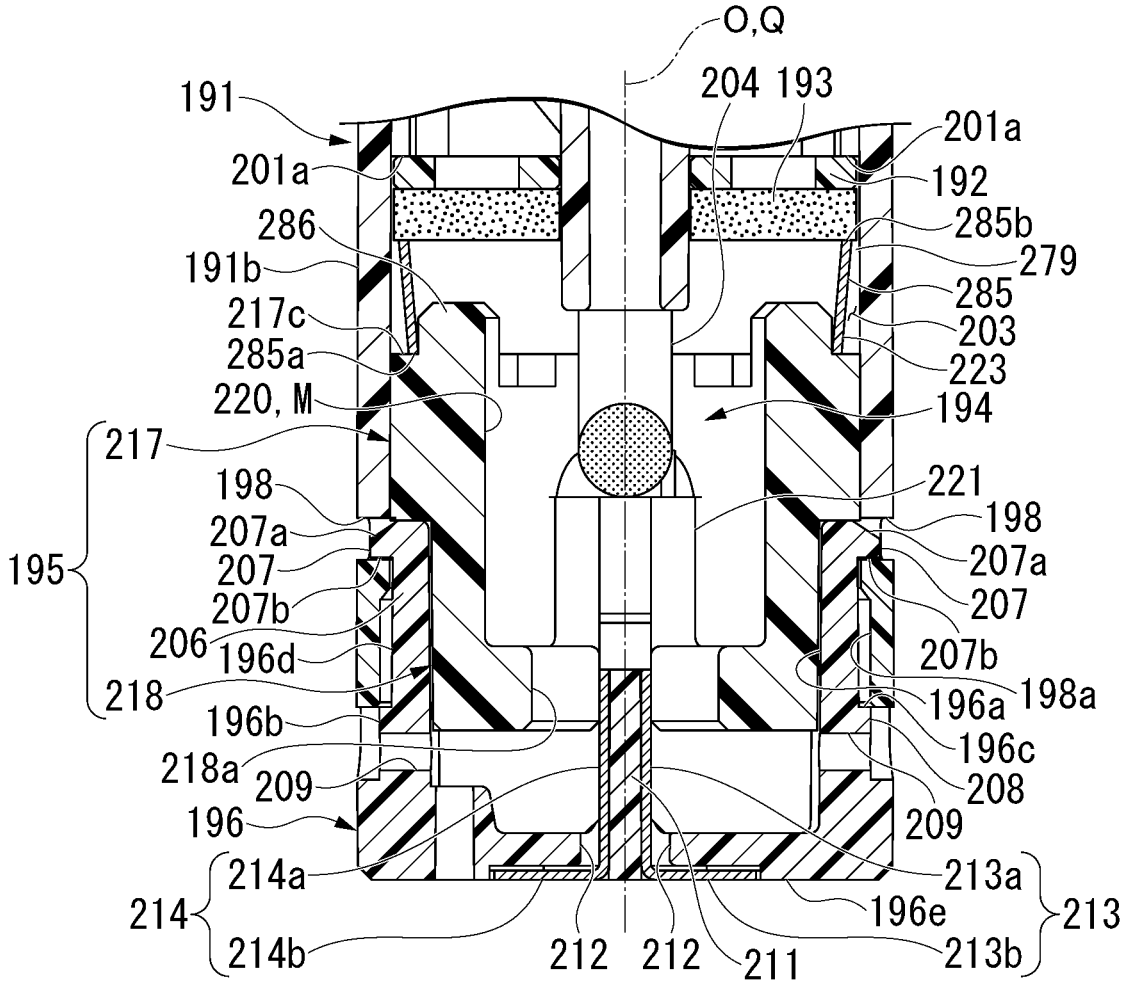
FIG. 25 is an enlarged cross-sectional view showing a portion corresponding to the atomization container of the cartridge according to a second modification example of the present embodiment.

FIG. 25 is an enlarged cross-sectional view in the axial direction showing a portion corresponding to the atomization container 195 of the cartridge 11 according to the second modification example. FIG. 25 corresponds to FIG. 13.

As shown in FIG. 25, the second modification example is different from the embodiment in that a shape of the atomization container 195 is different.

In the cylinder portion 217 of the atomization container 195, a portion for forming the liquid accumulation portion 223 is removed and a support member 285 different from the cylinder portion 217 is disposed in the removed portion. The removed surface of the cylinder portion 217 is referred to as a flat surface 217*c* orthogonal to the axis Q. A fitting convex portion 286 in a substantial cylindrical shape and protruding toward the liquid retention body 193 side is formed at a circumferential edge of the accommodation concave portion 220 on the flat surface 217*c*. The support member 285 is disposed on the flat surface 217*c* for positioning of the fitting convex portion 286.

The support member 285 is formed from a metal material. For example, it is desirable that the support member 285 is formed from stainless steel or the like having high rust-preventive performance. The support member 285 is formed in a substantial frustro-conical shape so as to be a substantial cylindrical shape and becoming wider as approaching from the flat surface 271*c* toward the liquid retention body 193 side when viewed from a direction orthogonal to the axis Q. An internal surface of a small-diameter portion 285*a* of the support member 285 fits to an external circumferential surface of the fitting convex portion 286 of the cylinder portion 217. Accordingly, the positioning of the support member 285 with respect to the cylinder portion 217 is performed.

An end portion of a large-diameter portion 285*b* of the support member 285 is in contact with the opposite-suction-port-side surface 193*c* of the liquid retention body 193. An external diameter of the large-diameter portion 285*b* is set to be slightly smaller than the internal diameter of the circumferential wall 191*b* of the tank 191. Accordingly, a micro gap formed between the large-diameter portion 285*b* and the circumferential wall 191*b* of the tank 191 functions as the narrow portion 279.

The support member 285 is formed in the substantial frustro-conical shape as described above such that the gap between the support member 285 and the circumferential wall 191*b* of the tank 191 gradually becomes narrower from the small-diameter portion 285*a* toward the large-diameter portion 285*b*. The gap functions as the liquid accumulation portion 223.

In this manner, according to the cartridge 11 of the second modification example, the same effect may be achieved as the above-described embodiment. In addition, the cylinder portion 217 of the atomization container 195 is configured by being divided by the support member 285, and the liquid accumulation portion 223 is formed on the external circumferential surface of the support member 285. Accordingly, a moldability of the atomization container 195 may become easy. The support member 285 is formed from metal such that a mechanical strength of the support member 285 may be improved. The liquid retention body 193 may be supported by an end portion of the large-diameter portion 285*b* of such support member 285.

Third Modification Example

Next, a third modification example of the above-described embodiment will be described with reference to FIG. 26.

Figure 26:
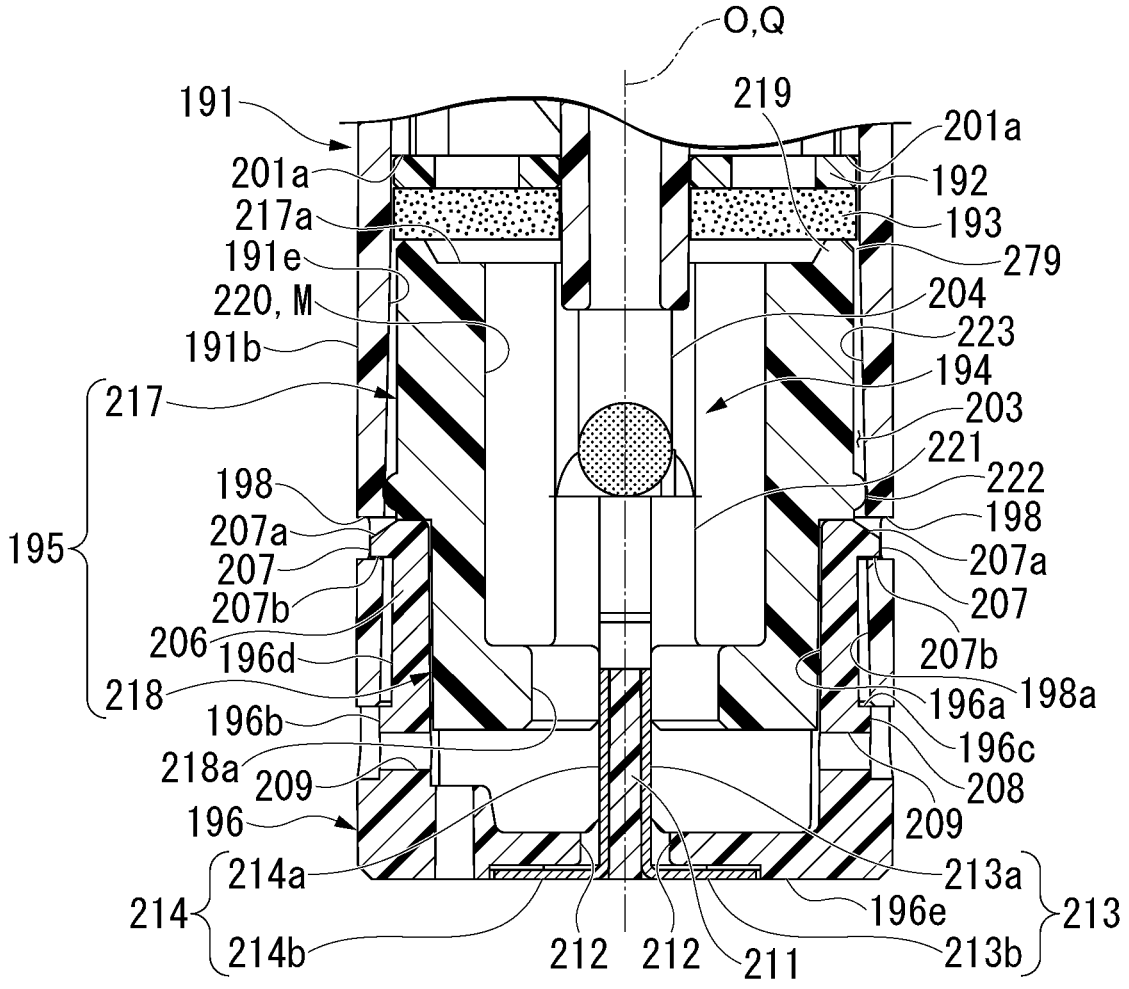
FIG. 26 is an enlarged cross-sectional view showing a portion corresponding to the atomization container of the cartridge according to a third modification example of the present embodiment.

FIG. 26 is an enlarged cross-sectional view in the axial direction showing a portion corresponding to the atomization container 195 of the cartridge 11 according to the third modification example. FIG. 26 corresponds to FIG. 13.

As shown in FIG. 26, the second modification example and the above-described embodiment are different in that shapes of the atomization container 195 and the circumferential wall 191*b* of the tank 191 are different.

The external circumferential surface of the cylinder portion 217 of the atomization container 195 is not obliquely formed in an interval between the seal portion 222 and the tip end of the protrusion portion 219 and formed substantially parallel to the axis Q.

On the other hand, in the circumferential wall 191*b* of the tank 191, the internal circumferential surface at the portion corresponding to the cylinder portion 217 is obliquely formed as an inclined surface 191*e* whose diameter gradually increases from the protrusion portion 219 of the cylinder portion 217 toward the seal portion 222. Accordingly, an interval between the circumferential surface of the cylinder portion 217 and the circumferential wall 191*b* of the tank 191 gradually becomes narrower toward the protrusion portion 219 of the cylinder portion 217.

Therefore, according to the above-described third modification example, the same effect may be achieved with the above-described embodiment.

In the third modification example, an external diameter of the seal portion 222 of the atomization container 195 becomes larger by the increase of the internal diameter of the circumferential wall 191*b* of the tank 191. Accordingly, in the state in which the atomization container 195 is accommodated in the tank 191, the seal portion 222 is compressed in the radial direction. Accordingly, it is possible to secure the seal performance of the seal portion 222 and prevent the slipping of the atomization container 195 from the tank 191 due to the friction resistance of the seal portion 222.

Fourth Modification Example

Next, a fourth modification example of the above-described embodiment will be described with reference to FIG. 27.

Figure 27:
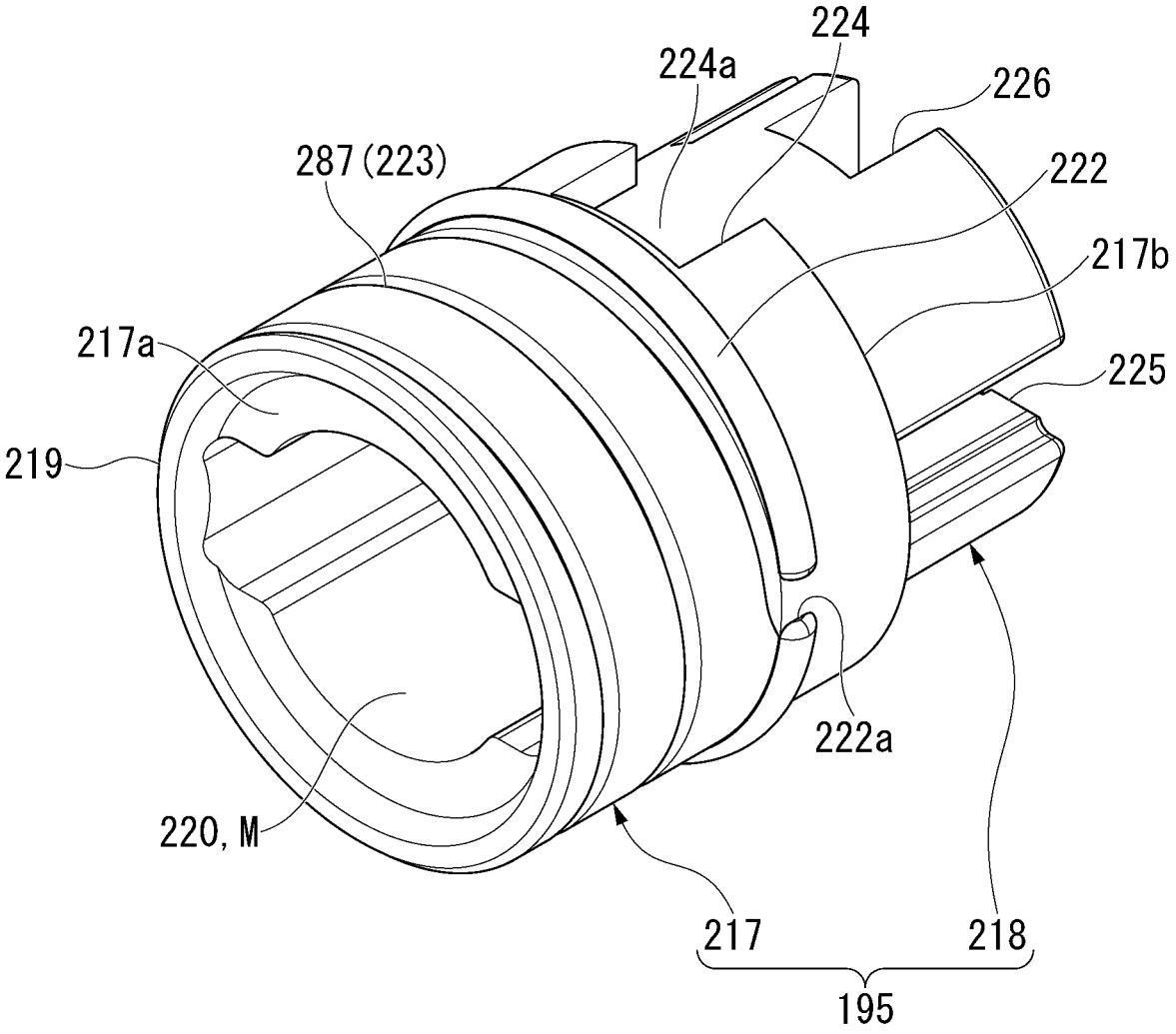
FIG. 27 is an enlarged cross-sectional view showing a portion corresponding to the atomization container of the cartridge according to a fourth modification example of the present embodiment.

FIG. 27 is a perspective view of the atomization container 195 according to the fourth modification example viewed from the liquid retention body 193 side (second side in the axial direction). FIG. 27 corresponds to FIG. 17.

As shown in FIG. 27, the fourth modification example and the above-described embodiment are different in that the shape of the atomization container 195 is different.

The external circumferential surface of the cylinder portion 217 of the atomization container 195 is not obliquely formed in an interval between the seal portion 222 and the tip end of the protrusion portion 219 and formed substantially parallel to the axis Q. A helix-shaped groove 287 is formed on the external circumferential surface of the cylinder portion 217. The groove 287 is formed between the seal portion 222 and an end portion of the protrusion portion 219. Accordingly, the groove 287 functions as the liquid accumulation portion 223.

An end portion of the groove 287 at the seal portion 222 side is communicated with the notch portion 222*a* formed in the seal portion 222. Accordingly, it is impossible to generate a pressure difference between the inside and outside the liquid accumulation portion 223.

In this manner, according to the cartridge 11 of the fourth modification example, the same effect with the above-described embodiment may be achieved. In addition, the groove 287 formed in the helix shape on the external circumferential surface of the cylinder portion 217 functions as the liquid accumulation portion 223. The groove 287 is formed in the helix shape such that it is difficult for the air to enter the groove 287. Accordingly, it may be easy for the liquid aerosol source stored in the groove 287 to flow back to the liquid storage room 202 of the tank 191.

Fifth Modification Example

Next, a fifth modification example of the above-described embodiment will be described with reference to FIG. 28.

Figure 28:
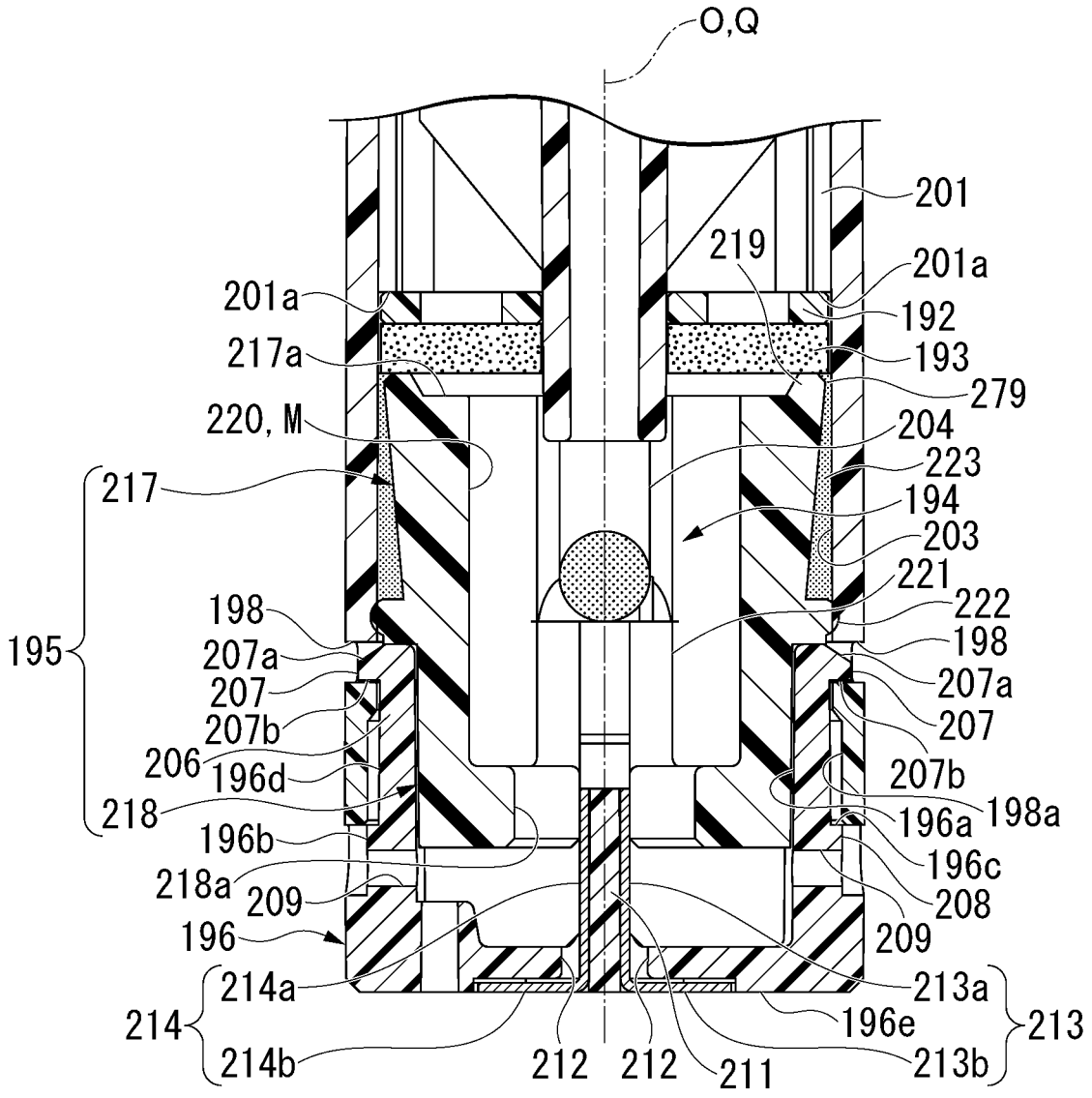
FIG. 28 is an enlarged cross-sectional view showing a portion corresponding to the atomization container of the cartridge according to a fifth modification example of the present embodiment.

FIG. 28 is an enlarged cross-sectional view of a portion corresponding to the atomization container 195 of the cartridge 11 according to the fifth modification example. FIG. 28 corresponds to FIG. 13.

As shown in FIG. 28, according to the fifth modification example, a porous member having liquid absorbency is disposed in the concave portion formed across the whole external circumferential surface of the cylinder portion 217. Such a member is referred to as the liquid accumulation portion 223.

Even if such a configuration is provided, the liquid aerosol source is absorbed by the liquid accumulation portion 223 such that the same effect with the above-described embodiment may be achieved.

The liquid accumulation portion 223 formed from the porous member may be disposed in the concave portion formed across the whole external circumferential surface of the cylinder portion 217 without any gap or with a slight gap therebetween. Even in a case in which a slight gap is formed therebetween, the liquid aerosol source may be stored in the gap.

An internal space of the liquid accumulation portion 223 according to the above-described embodiment may be filled by the porous member having the liquid absorbency.

Other Modification Example

Preferred embodiments of the present invention have been described above, the present invention is not limited to the embodiments and modifications thereof. Additions, omissions, substitutions and other changes in the structure are possible without departing from the spirit of the present invention. The present invention is not limited by the foregoing description and is limited only by the scope of the appended claims.

For example, according to the above-described embodiment, an example of the suction device 1 configured for the tobacco capsule 12 to be attachable to and detachable from is described as an example of an aerosol generation device for generating aerosol without combustion is described; however, the aerosol generation device is not limited to the configuration only. As another example of the aerosol generation device, a configuration without the tobacco capsule 12 such as an electrical tobacco may be provided. In this case, the aerosol source including a flavor is accommodated in the cartridge 11 and the aerosol including the flavor is generated by the aerosol generation device.

According to the above-described embodiment, a case in which the main body unit 10 is a divided configuration of the power unit 21, the retention unit 22, and the mouthpiece 23 is described; however, the main body unit 10 is not limited to the configuration only. For example, the power unit 21 and the retention unit 22 may be integrally formed, and the retention unit 22 and the mouthpiece 23 may be integrally formed.

According to the above-described embodiment, a configuration that the retention unit 22 is formed in a cylindrical shape to surround the circumference of the cartridge 11 is described; however, the retention unit 22 is not limited to the configuration only. The retention unit 22 only has to be a configuration capable of retaining the cartridge 11. In the present description, attachment and detachment of the cartridge 11 and the main body unit 10 (power unit 21) is not limited to the configuration of accommodating the cartridge 11 in the retention unit 22 and being retained by the mouthpiece 23, and the configuration of simply connecting or disconnecting the pin electrodes 49 with the connection electrodes 213*b*, 214*b* is included.

According to the above-described embodiment, a configuration that the power unit 21 and the retention unit 22 are formed in cylindrical shapes and disposed coaxially is described; however, the power unit 21 and the retention unit 22 are not limited only to this configuration. The power unit 21 and the retention unit 22 may be formed in different shapes.

According to the above-described embodiment, a configuration that the storage battery 33 and the substrate modules 34, 35 are carried on the storage battery holder 36 is described; however, the configuration is not limited thereto. The storage battery 33 and the substrate modules 34, 35 may be directed carried in the housing 31.

According to the above-described embodiment, a configuration of the button 78 (switch element 52) for outputting the start-up preparation signal is described; however, a configuration without the button 78 (a configuration for start-up by a detection by the pressure sensor 53) may be configured.

According to the above-described embodiment and each modification example, a case in which the liquid accumulation portion 223 is disposed in either of the external circumferential surface of the cylinder portion 217 or the circumferential wall 191*b* in the tank 191 is described. However, it is not limited only to the configuration. The concave portion may be formed in both of the external circumferential surface of the cylinder portion 217 or the circumferential wall 191*b* in the tank 191 to configure the liquid accumulation portion 223.

According to the above-described embodiment, a case in which the liquid retention body 193 is the porous member having liquid absorbency and formed from the cotton-type fibrous material, for example, is described. However, the liquid retention body 193 is not limited to the configuration. A plate-shaped member which does not have the liquid absorbency may be used instead of the liquid retention body 193. The inside of the tank 191 only has to be partitioned by the plate-shaped member into the liquid storage room 202 at the bottom 191*c* side and the opening room 203 at the opening portion 191*a* side. However, it is necessary to process the plate-shaped member so as to cause the liquid aerosol source stored in the liquid storage room 202 to be absorbed by the wick 4 through the plate-shaped member.

According to the above-described embodiment, a case in which the heater holder 196 is fitted to the internal circumferential surface of the circumferential wall 191*b* in the tank 191 is described. A case in which the engagement hole 198 is formed in the tank 191 and the engagement piece 206 is formed in the heater holder 196 so as to configure a means for engaging the tank 191 and the heater holder 196 with each other is described. However, it is not limited only to this configuration. The circumferential wall 191*b* of the tank 191 may be configured to fit to the internal circumferential surface of the heater holder 196. In this case, the engagement piece 206 is formed in the circumferential wall 191*b* of the tank 191 positioned at the internal side in the radial direction and the engagement hole 198 is formed in the heater holder 196 positioned at the external side in the radial direction.

The configuration only has to be engageable with the engagement piece 206, and may not configured as the engagement hole 198. In other words, a concave portion engageable with the engagement piece 206 may be configured instead of the engagement hole 198. According to such a configuration, a case in which the engagement claw 207 exposes to the outside through the engagement hole 198 will not occur. Accordingly, it is possible to configure the tank 191 and the heater holder 196 to be more difficult to disassemble.

According to the above-described embodiment, a case in which two engagement holes 198 are formed in the tank 191 and two engagement pieces 206 are formed in the heater holder 196 so as to fix the tank 191 and the heater holder 196 is described. However, it is not limited only to this configuration. Two or more than two engagement holes 198 and engagement pieces 206 may be formed in the tank 191 and the heater holder 196 respectively.

According to the above-described embodiment, a case in which the first contact portion 193*d* between the suction-port-side surface 193*b* of the liquid retention body 193 and the tank 191 (liquid storage room 202), and the second contact portion 193*e* between the opposite-suction-port-side surface 193*e* of the liquid retention body 193 and the liquid accumulation portion 223 (narrow portion 279) do not overlap each other viewed from the axial direction (viewing the opposite-suction-port side from the mouthpiece 23) is described. However, it is not limited only to this configuration. The first contact portion 193*d* and the second contact portion 193*e* may have part overlapping each other viewed from the axial direction.

Part of the above-described embodiment or the whole embodiment may be disclosed in the following appendix and are not limited thereto.

According to the embodiment, in a case when the first liquid retainer is saturated, the liquid in the tank can be stored in the second liquid retainer via the first liquid retainer. Accordingly, unnecessary liquid leakage to the rooms.

According to the embodiment, the first liquid retainer can efficiently retain the liquid in the tank via the opening portion of the tank.

According to the embodiment, the liquid and the second liquid retainer are disposed at two sides of the first liquid retainer to sandwich the first liquid retainer. Accordingly, it is possible to cause the first liquid retainer to retain the liquid of the tank and in the case when the first liquid retainer is saturated, it is possible to cause the second liquid retainer to retain the liquid.

According to the embodiment, it is possible to separate the first contact portion and the second contact portion as much as possible. Accordingly, it is possible to prevent the liquid of the tank from not being held by the first liquid retainer and being directly introduced to the second liquid retainer. In other words, it is possible to cause the liquid to be sufficiently held in the first liquid retainer and then introduced to the second liquid retainer.

According to the embodiment, the tank and the second liquid retainer are in contact with a front surface and a rear surface (the suction-port-side surface and the opposite-suction-port-side surface) respectively. Accordingly, it is possible to sufficiently retain the liquid in the first liquid retainer. In other words, it is possible to prevent the liquid from flowing into the second liquid retainer in a state in which the liquid is not sufficiently held in the first liquid retainer.

According to the embodiment, when the first liquid retainer is saturated, there is high possibility that the liquid leaks away from the region between the external lateral surface of the first liquid retainer and the internal lateral surface of the tank. Accordingly, when viewing the opposite side of the suction port side from the suction port side, it is possible to retain the liquid leaked from the first liquid retainer by the second liquid retainer by disposing the second liquid retainer at the position overlapping the region between the external lateral surface of the first liquid retainer and the internal lateral surface of the tank.

According to the embodiment, the second liquid retainer can retain the liquid.

According to the embodiment, it is possible to utilize the space to keep the liquid to be stored in the second liquid retainer.

According to the embodiment, even if the liquid accommodated in the liquid storage room of the tank leaks out between the external circumferential surface of the partition plate and the internal circumferential surface of the container, the leaked liquid is introduced through the internal circumferential surface of the tank to the liquid retainer between the external circumferential surface of the cylindrical portion of the container and the internal circumferential surface of the container. Accordingly, it is possible to prevent liquid leakage to the inside of the cylindrical portion of the container.

According to the embodiment, it is possible to keep the liquid to be stored between the external circumferential surface of the partition plate and the internal circumferential surface of the tank.

According to the embodiment, there is no pressure difference between the inside and outside of the liquid retainer. Accordingly, it is possible to prevent the liquid from leaking outside from the liquid retainer while causing the liquid to be efficiently circulated to the liquid store room side.

According to the embodiment, in a case in which the partition plate has liquid absorbency and the partition plate is saturated, there is a tendency that the liquid leaks through the internal circumferential surface of the tank from the gap between the external circumferential surface of the partition plate and the internal circumferential surface of the tank. However, the liquid retainer is disposed between the external circumferential surface of the cylindrical portion and the internal circumferential surface of the tank such that it is possible to prevent the liquid leakage to the inside of the cylindrical portion of the container.

According to the embodiment, a liquid accumulator having a simple structure may be formed.

According to the embodiment, since a spatial volume of the liquid retainer gradually increases from the partition plate side, it is possible to smoothly introduce the liquid to the liquid retainer. It is possible to sufficiently store the liquid in the liquid retainer.

According to the embodiment, as described above, by forming the narrow portion having a smaller aperture area than an aperture area at a position where the concave portion (liquid retainer) is formed, it is possible to make the liquid accumulated in the liquid retainer to be easily suctioned up to the liquid storage room side due to the narrow portion. In other words, it is easy for the liquid accumulated in the concave portion to be circulated to the liquid storage room side.

According to the embodiment, it is possible to cause the liquid to be more easily circulated to the liquid storage room side via the gap between the external circumferential surface of the partition plate and the internal circumferential surface of the tank. For example, in a case in which the partition plate has the liquid absorbency, by covering the narrow portion by the partition plate, it is possible to cause the liquid to be more efficiently circulated to the liquid storage room side by utilizing capillary force of the partition plate.

According to the embodiment, it is possible to cause the volume of the liquid retainer to be as large as possible.

According to the embodiment, for example, even if the partition plate is a flexible member, it is easy to keep the partition plate in a desired posture and at a desired position by the support member.

According to the embodiment, even in a case in which the wick and the heater are disposed inside a case, it is possible to prevent dousing the wick and the heater with the liquid due to the liquid retainer.

According to the embodiment, it is possible to introduce the steam atomized in the opening room to the outside of the bottom in the tank through the flow path. Accordingly, it is possible to improve the layout flexibility and design freedom of the atomization unit. Even in a case in which the liquid is accumulated in the opening room, the steam in the opening room is introduced to the bottom side through the flow path, wherein the liquid storage room is sandwiched therebetween. Accordingly, it is possible to prevent the user from suctioning up the liquid through the suction port.

According to the embodiment, the tubular flow path can be supported in the liquid storage room of the tank. It is possible to enhance mechanical strength of the tank by disposing the rib.

According to the embodiment, it is possible to provide a non-combustion suction device capable of preventing the liquid leakage to the inside of the cylindrical portion in the container.

Appendix 1

An atomization unit comprises a tank formed in a bottom cylindrical shape; a partition plate configured to partition the tank into a liquid storage room at the bottom side of the tank and an opening room at a side of an opening portion of the tank, and a container having a cylindrical portion fitted into an internal circumferential surface at the opening room side of the tank, wherein liquid is stored in the liquid storage room, and a concave portion is formed to introduce the liquid leaked from a gap between an external circumferential surface of the partition plate and an internal circumferential surface of the tank to an external circumferential surface of the cylindrical portion and the concave portion is capable of storing the liquid.

Appendix 2

The atomization unit comprises a flow passage disposed in the tank and penetrating the bottom portion of the tank and the partition plate; a wick having liquid absorbency that is disposed in the container and formed in a U shape so as to connect two ends of the partition plate; and a heater having electrical heating wires helicoidally surrounding a circumference of the wick to heat the wick without combustion.

Appendix 3

A non-combustion suction device comprises an atomization unit; a container retaining cylinder formed in a cylindrical shape to accommodate the atomization unit; a power unit connected to an end portion at the container side of the container retaining cylinder; and a holder (heater holder in the embodiment) disposed between the power unit and the container and having an electrode to which the electrical heating wires are connected and capable of being in contact with a pin electrode of the power unit.

Additions, omissions, substitutions and other changes in the structure are possible without departing from the spirit of the present invention. Each of the above-described modification examples may be suitably combined.

What is claimed is:

1. A cartridge used in a non-combustion suction device having a suction port, comprising:

a tank capable of storing liquid;

a first liquid retainer capable of retaining the liquid in the tank and configured to supply the liquid to the heater; and a second liquid retainer being in contact with the first liquid retainer and separated from the heater, the second liquid retainer being capable of retaining the liquid through the first liquid retainer, wherein the first liquid retainer is formed in a plate shape having a first surface and a second surface, wherein the second surface is on an opposite side of the first surface, wherein the first surface is closer to the suction port than the second surface, wherein the first surface is in contact with the tank, and wherein the second surface is in contact with the second liquid retainer.

2. The cartridge according to claim 1, wherein an opening portion coming in contact with the first liquid retainer is formed in the tank.

3. The cartridge according to claim 1, wherein the second liquid retainer is connected with the tank via the first liquid retainer.

4. The cartridge according to claim 1, wherein the second liquid retainer is disposed at an opposite side with respect to a suction port side of the tank.

5. The cartridge according to claim 1, wherein when viewing the opposite side of the suction port from the suction port, at least part of a first contact portion between the opening portion of the tank and the first liquid retainer and a second contact portion between the first liquid retainer and the second liquid retainer are shifted with each other.

6. The cartridge according to claim 1, wherein when viewing the opposite side of the suction port side from the suction port side, the second liquid retainer is disposed at a position overlapping a region between an external lateral surface of the first liquid retainer and an internal lateral surface of the tank.

7. The cartridge according to claim 1, wherein the first liquid retainer is a porous member.

8. The cartridge according to claim 1, wherein a space capable of storing the liquid is formed in the second liquid retainer.

9. An atomization unit, comprising:

a tank formed in a bottomed cylindrical shape;

a partition plate configured to partition the tank into a liquid storage room at a bottom side of the tank and an opening room at a side of an opening portion of the tank; and a container having a cylindrical portion fitted into an internal circumferential surface of the tank at the opening room side of the tank, wherein liquid is accommodated in the liquid storage room, wherein a liquid retainer is formed between an external circumferential surface of the cylindrical portion and an internal circumferential surface of the opening room in the tank, wherein the liquid retainer is a concave portion formed in at least one of the external circumferential surface of the cylindrical portion or the internal circumferential surface of the tank.

10. The atomization unit according to claim 9, wherein the liquid retainer is capable of storing the liquid leaked from a gap between the external circumferential surface of the partition plate and the internal circumferential surface of the tank.

11. The atomization unit according to claim 9, wherein part of the liquid retainer is communicated with an external side of the tank.

12. The atomization unit according to claim 9, wherein the partition plate has liquid absorbency.

13. The atomization unit according to claim 9, wherein the liquid retainer is formed such that a gap between the external circumferential surface of the cylindrical portion and the internal circumferential surface of the tank gradually becomes wider along a direction toward the opening portion of the tank.

14. The atomization unit according to claim 9, wherein a narrow portion communicating with the concave portion is formed in the gap between the external circumferential surface of an end portion at a partition plate side in the cylindrical portion and the internal circumferential surface of the tank.

15. The atomization unit according to claim 14, wherein an end of the narrow portion opposite to the concave portion is covered by the partition plate.

16. The atomization unit according to claim 9, wherein the concave portion is formed over a whole circumference of either of the external circumferential surface of the cylindrical portion or the internal circumferential surface of the tank.

17. The atomization unit according to claim 9, wherein the partition plate is formed from fibers, and a support member fitted into the internal circumferential surface of the tank to support the partition plate is disposed in a surface at the liquid storage room side of the partition plate.

18. A non-combustion suction device, comprising:

the atomization unit according to claim 9, a container-retaining cylinder configured to accommodate the atomization unit, and a mouthpiece attached to the container-retaining cylinder, wherein the opening room is communicated with the mouthpiece.

19. An atomization unit, comprising:

a tank formed in a bottomed cylindrical shape, a partition plate configured to partition the tank into a liquid storage room at a bottom side of the tank and an opening room at a side of an opening portion of the tank, and a container having a cylindrical portion fitted into an internal circumferential surface of the tank at the opening room side of the tank, wherein liquid is accommodated in the liquid storage room, wherein a liquid retainer is formed between an external circumferential surface of the cylindrical portion and an internal circumferential surface of the opening room in the tank, wherein the tank has a flow path penetrating a bottom and the partition plate, wherein the flow path is disposed at a center in a radial direction of the tank and formed in a tubular shape along an axial direction, and a rib is disposed across the internal circumferential surface of the tank and the external circumferential surface of the flow path.

* * * * *